US007527450B2

(12) United States Patent
Russell

(10) Patent No.: US 7,527,450 B2
(45) Date of Patent: May 5, 2009

(54) SELECTABLY OPERABLE FIELD MATEABLE PIN ASSEMBLY

(75) Inventor: Larry Rayner Russell, Houston, TX (US)

(73) Assignee: RRI Holdings, Inc., Dallas, TX (US)

( * ) Notice: Subject to any disclaimer, the term of this patent is extended or adjusted under 35 U.S.C. 154(b) by 179 days.

(21) Appl. No.: 11/344,727

(22) Filed: Feb. 1, 2006

(65) Prior Publication Data

US 2006/0177272 A1 Aug. 10, 2006

Related U.S. Application Data

(60) Provisional application No. 60/650,196, filed on Feb. 4, 2005, provisional application No. 60/660,404, filed on Mar. 10, 2005.

(51) Int. Cl.
*F16C 11/04* (2006.01)

(52) U.S. Cl. ..... 403/39; 403/31; 403/36; 403/150; 403/324; 114/265; 405/197; 405/202

(58) Field of Classification Search ..... 403/31, 403/35, 36, 37, 38, 39, 150, 154, 322.3, 324; 114/264, 265; 405/196, 197, 201, 202
See application file for complete search history.

(56) References Cited

U.S. PATENT DOCUMENTS

| | | | | |
|---|---|---|---|---|
| 3,720,066 | A | 3/1973 | Vilain | |
| 4,142,820 | A | 3/1979 | Tuson | |
| 4,455,108 | A | 6/1984 | Lausberg | |
| 4,756,240 | A * | 7/1988 | Mielke | 403/150 |
| 4,762,442 | A | 8/1988 | Thomas et al. | |
| 5,398,569 | A * | 3/1995 | Carr | 403/154 |
| 5,915,882 | A | 6/1999 | Darwiche et al. | |
| 5,988,932 | A | 11/1999 | Haney et al. | |
| 6,925,904 | B2 * | 8/2005 | Sundaesan et al. | 403/154 |

* cited by examiner

*Primary Examiner*—Michael P Ferguson
(74) *Attorney, Agent, or Firm*—Elizabeth R. Hall

(57) ABSTRACT

The present invention relates to pins that may be selectably operated to engage and disengage socket bores in the assembly and disassembly of large structures, such as floating offshore platforms for deepwater applications. The pin connections can be engaged or disengaged robotically or under direct operator control. The construction and installation of structures utilizing the pin connections will typically use multiple sets of selectably operable pins to connect, support and stabilize the structural components of the structure.

36 Claims, 29 Drawing Sheets

318
124
319
Taper Angle 103
302
108
115
107
113
301
114
112
Taper Angle
106
109

518

10
11
118
118
100
101
101
86
26
43
84
87
78
78
70
101
36
118
101
118
90

SELECTABLY OPERABLE FIELD MATEABLE PIN ASSEMBLY

CROSS-REFERENCE TO RELATED APPLICATION

The present application, pursuant to 35 U.S.C. 111(b), claims the benefit of the earlier filing date of provisional application Ser. No. 60/650,196 filed Feb. 4, 2005, and entitled "Selectably Operable Field Mateable Pin Assembly" and provisional application Ser. No. 60/660,404 filed Mar. 10, 2005, and entitled "Selectably Operable Field Mateable Pin Assembly"

BACKGROUND OF THE INVENTION

1. Field of the Invention

The invention relates to the apparatus and a method for the construction and installation of floating oilfield production structures having their main structural elements pin-connected. More particularly, the present invention relates to the pin assembly used to interconnect the structural elements of the floating oilfield production structures.

2. Description of the Related Art

Pinning structures in underwater applications is often performed by robots, by personnel working from some distance utilizing submersible craft with remote manipulators, or by personnel in underwater suits. Currently used pins for engaging and disengaging structural connections between different components of a floating offshore platform are solid cylindrical pins that engage cylindrical socket bores.

A need exists for pinned connections that are easy to stab and which can have the gaps between the mating elements minimized or eliminated when the pins are engaged.

A further need exists for pinned connections that can be accessed for maintenance and repair underwater.

In addition, a need exists for robust pinned connections that have very low stress levels in operation so that metal fatigue and contact surface galling or fretting are not a problem.

SUMMARY OF THE INVENTION

The present invention relates to pins that may be selectably operated to engage and disengage socket bores in the assembly and disassembly of large structures, such as floating offshore platforms for deepwater applications. The pin connections can be engaged or disengaged robotically or under direct operator control. The construction and installation of structures utilizing the pin connections will typically use multiple sets of selectably operable pins to connect, support and stabilize the structural components of the structure.

One aspect of the present invention is a pin assembly comprising: (a) a pair of pin sockets mounted on a first structure, wherein the pin sockets are spaced apart and have opposed coaxially aligned pin receiving bores; (b) a second structure having a pin mounting bore; (c) a pair of opposed pins, reciprocably mounted in the pin mounting bore, the pins being coaxial and comateable with the pin receiving bores, wherein each pin includes (i) a hollow pin casing, (ii) at least one internal diaphragm to support the casing, and (iii) a pressure equalization means for equalizing a pressure in the pin casing with an environmental pressure outside the pin casing; (d) a sealing means for sealing a gap between the pin casing and the pin mounting bore, and (e) a selectably operable, bidirectional pin actuator mounted on a first end of each pin.

A second aspect of the present invention is a pin assembly comprising: (a) a pair of pin sockets mounted on a first structure, wherein the pin sockets are spaced apart and have opposed coaxially aligned pin receiving bores; (b) a second structure having a longitudinal midline and a through bore penetrating a distal end of the second structure, wherein the through bore has a through bore diaphragm coplanar with the midline of the second structure and fixedly mounted in the through bore; (c) a pair of opposed pin members, with one pin member positioned on each side of the through bore diaphragm, wherein the pin members are coaxially aligned in the through bore and the pin members are reciprocably comateable with the pin receiving bores, wherein each pin member has a hollow pin casing and at least one pin diaphragm to support the casing; (d) a pin chamber bounded by the pin member, the through bore and the through bore diaphragm; (e) a sealing means for sealing a gap between the pin casing and the through bore, (f) a flow passage communicating between an inside of the pin chamber and an outside of the pin chamber; (g) a selectably operable valve, wherein whenever the valve is open flow is permitted through the flow passage and whenever the valve is closed flow is prevented through the flow passage; and (h) a pair of selectably operable, reciprocable actuators, each actuator fixedly attached at a first end to the through bore diaphragm and at a second end to the pin member.

Another aspect of the present invention is a pin assembly comprising: (a) a pair of pin sockets mounted on a first structure, wherein the pin sockets are spaced apart and have opposed coaxially aligned pin receiving bores; (b) a second structure having a longitudinal midline and a through bore penetrating a distal end of the second structure, wherein the through bore has a through bore diaphragm coplanar with the midline and fixedly mounted in the through bore; (c) a pair of opposed pin members, with one pin member positioned on each side of the through bore diaphragm, wherein the pin members are coaxially aligned in the through bore and the pin members are reciprocably comateable with the pin receiving bores, wherein each pin member has a hollow pin casing and three pin diaphragms including an end transverse diaphragm closing a first end of the pin casing, and a first and second transverse diaphragm fixedly attached to the pin casing and spaced apart from the end diaphragm and from each other; (d) a pin chamber bounded by the pin member, the through bore and the through bore diaphragm; (e) a sealing means for sealing a gap between the pin casing and the through bore, (f) a flow passage communicating between an inside of the pin chamber and an outside of the pin chamber; (g) a selectably operable valve, wherein whenever the valve is open flow is permitted through the flow passage and whenever the valve is closed flow is prevented through the flow passage; (h) a selectably openable access passage in the end transverse diaphragm of the pin member, wherein the access passage passes from the outside of the pin chamber to the inside of the pin chamber; (i) a pair of selectably operable, reciprocable actuators, each actuator fixedly attached at a first end to the through bore diaphragm and at a second end to the pin member, wherein the actuator reciprocates between a first position and a second position such that when the actuator is in the first position the pin member is partially extended from the through bore and when the actuator is in the second position the pin member is within the through bore and an external face of the pin member is substantially flush with an outer end of the through bore; () a pumping means for selectably pumping fluid into or out of the pin casing; and (k) a lubricant injection port for injecting lubricant into a lubricant distribution groove in an external surface of the pin casing.

Yet another aspect of the present invention is a method for using a pin assembly to interconnect structural components, the method comprising the steps of: (a) mounting a pair of pin sockets on a first structure, the pin sockets being spaced apart and having opposed coaxial pin receiving bores; (b) mounting a pair of opposed coaxially aligned pins in a pin mounting bore positioned in one end of a second structure, wherein each pin includes a hollow pin casing, a sealing means for sealing a gap between the casing and the pin mounting bore, at least one internal diaphragm to support the casing, and a pressure equalization means for equalizing a pressure in the pin casing with an environmental pressure outside the pin casing, and wherein a distal end of the pins is extendable from the pin mounting bore and retractable into the pin mounting bore; (c) positioning the pins in the pin mounting bore of the second structure between the pin sockets such that the pin receiving bores and the pins are coaxially aligned; and (d) extending the pins into the pin receiving bores to rotatably connect the first structure to the second structure.

Still yet another aspect of the present invention is a method for using the pin assembly described above to interconnect structural components, the method comprising the steps of: (a) positioning the pin members in the pin mounting bore of the second structure between the pin sockets mounted on the first structure such that the pin receiving bores and the pin members are coaxially aligned; (b) injecting lubricant into the lubricant distribution groove of the pin members to lubricate the gap between the pin casing and the through bore; (c) opening the valve to allow pressure equalization between an inside and an outside of the pin chambers; (d) moving the actuators to a first position to extend the pin members into the pin receiving bores; (e) closing the valve to prevent fluid from leaving the pin chamber; and (f) locking the pin members into the pin receiving bores using a keeper pin.

Another aspect of the present invention is a method for disconnecting structural components connected using the pin assembly described above, the method comprising the steps of: (a) unlocking the pin members extended into the pin receiving bores by removing a keeper pin; (b) injecting lubricant into the lubricant distribution groove to lubricate the gap between the pin casing and the through bore; (c) opening the valve to allow pressure equalization between an inside and an outside of the pin chamber; (d) moving the actuators to a second position to retract the pin members into the pin mounting bore; and (e) closing the valve.

Yet another aspect of the present invention is a method for using the pin assembly described above to interconnect structural components, the method comprising the steps of: (a) positioning the pin members in the pin mounting bore of the second structure between the pin sockets mounted on the first structure such that the pin receiving bores and the pin members are coaxially aligned; (b) injecting lubricant into the lubricant distribution groove of the pin member to lubricate the gap between the pin casing and the through bore; (c) closing the valve, if the valve is open; (d) moving the actuators to a first position while pumping fluid into the pin chambers of the pin members to extend the pin members into the pin receiving bores; and (e) locking the pin members into the pin receiving bores using a keeper pin.

Still yet another aspect of the present invention is a method for disconnecting structural components connected using the pin assembly of claim 62, the method comprising the steps of: (a) unlocking the pin members extended into the pin receiving bores by removing a keeper pin; (b) injecting lubricant into the lubricant distribution groove to lubricate the gap between the pin casing and the through bore; (c) closing the valve, if the valve is open; (d) releasing the hydraulic cylinder; (d) moving the actuators to a second position while pumping fluid out of the pin chamber so that the differential in hydrostatic pressure external to the pin chamber and pressure within the pin chamber urge the pin members to retract into the pin mounting bore.

The foregoing has outlined rather broadly several aspects of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed might be readily utilized as a basis for modifying or redesigning the structures for carrying out the same purposes as the invention. It should be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

The present invention relates to pins that may be selectably operated to engage and disengage socket bores in the assembly and disassembly of large structures, such as floating offshore platforms for deepwater applications. The pin connections can be engaged or disengaged robotically or under direct operator control. The construction and installation of structures utilizing the pin connections will typically use multiple sets of selectably operable pins to connect, support and stabilize the structural components of the structure. For example, the pins are useful in the assembly and disassembly of a new type of floating moored oilfield offshore platform for deepwater applications. This new platform type is described in a copending U.S. patent application Ser. No. 11/051,691 entitled "Inclined Leg Floating Production Platform with a Damper Plate", filed Feb. 4, 2005.

The pin connections are used for the assembly and disassembly of the offshore platform described below. The construction and installation of the described floating oilfield drilling and production structure utilizes multiple sets of inclined buoyant legs in which are mounted selectably operable pins to connect, support and stabilize the deck structure and a subsurface damping plate.

Figure 1:
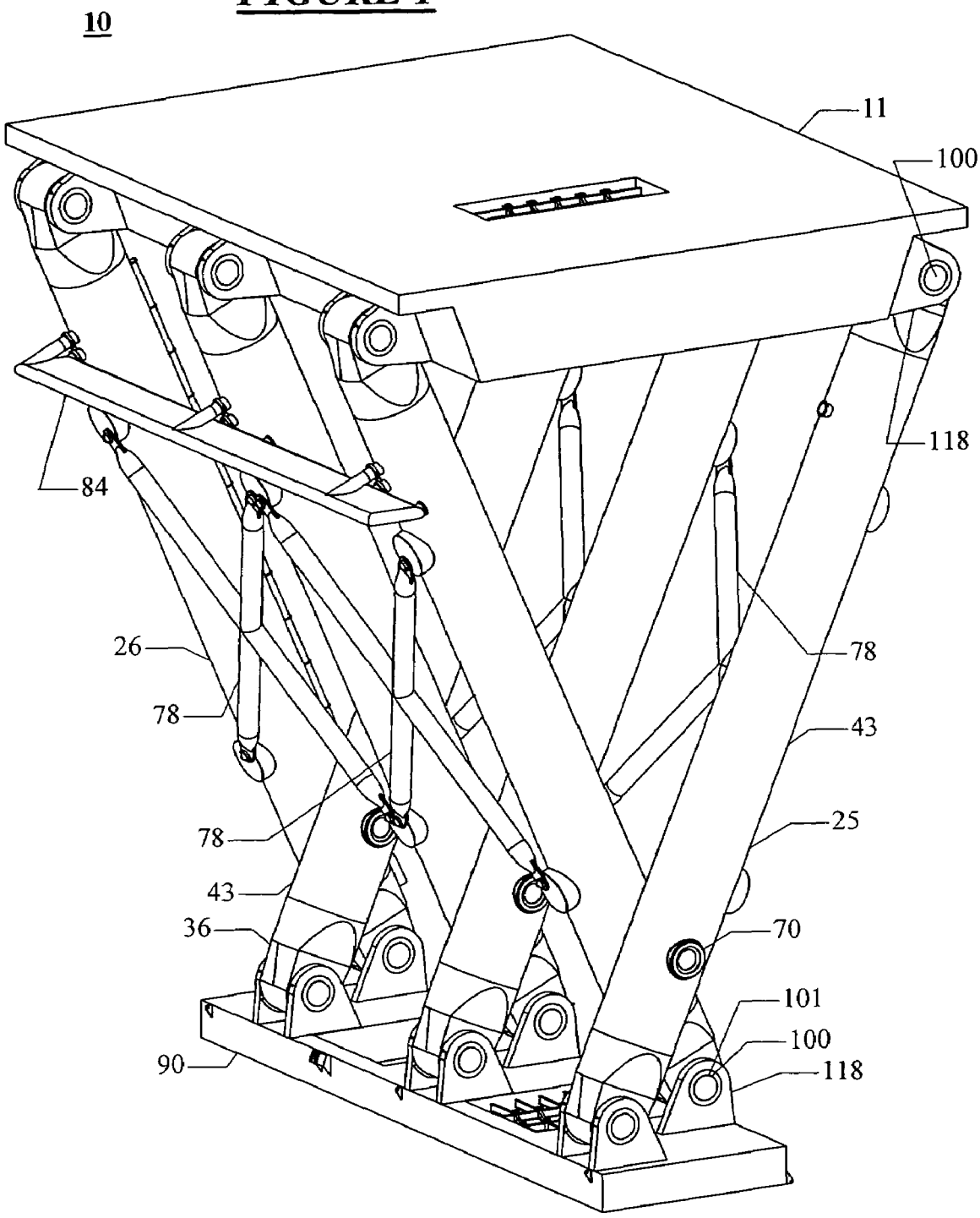
FIG. 1 is an oblique view of a floating oilfield production platform that utilized the pin assemblies of the present invention.
Figure 29:
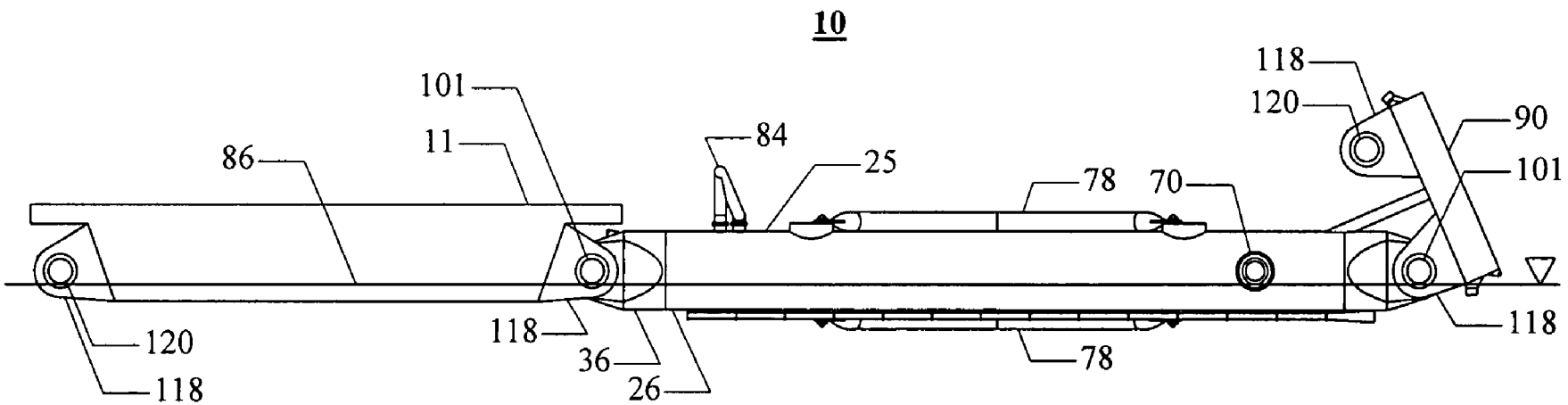
FIG. 29 is a side profile view of the partially assembled floating production platform of FIG. 1 using the first pin connection embodiment showing the configuration of the platform that is used for towing out to the offshore site for its final assembly.
Figure 30:
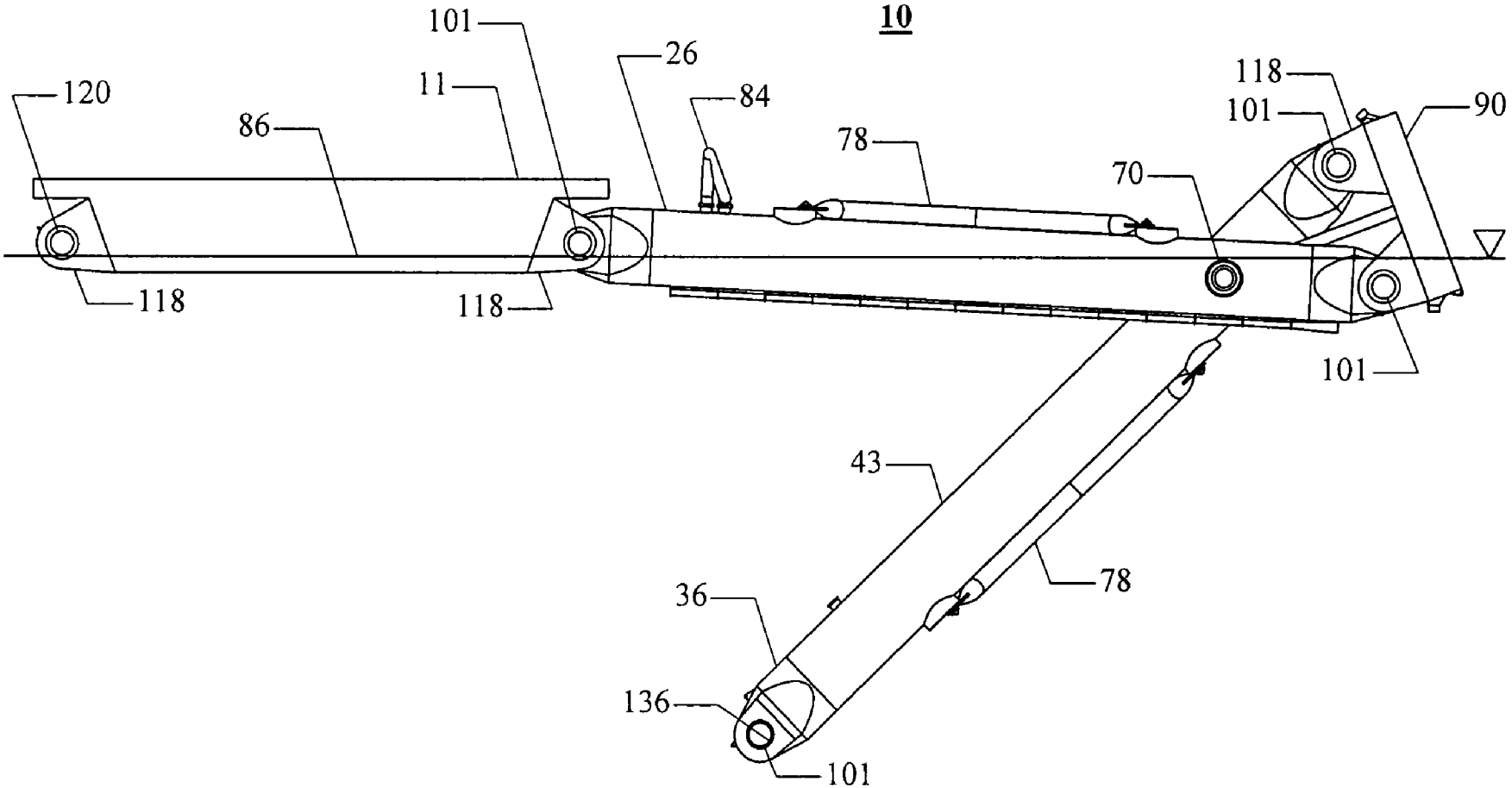
FIG. 30 is a side profile view that shows the platform of FIG. 29 from the same side, wherein the platform is in a second, intermediate partially assembled condition.
Figure 31:
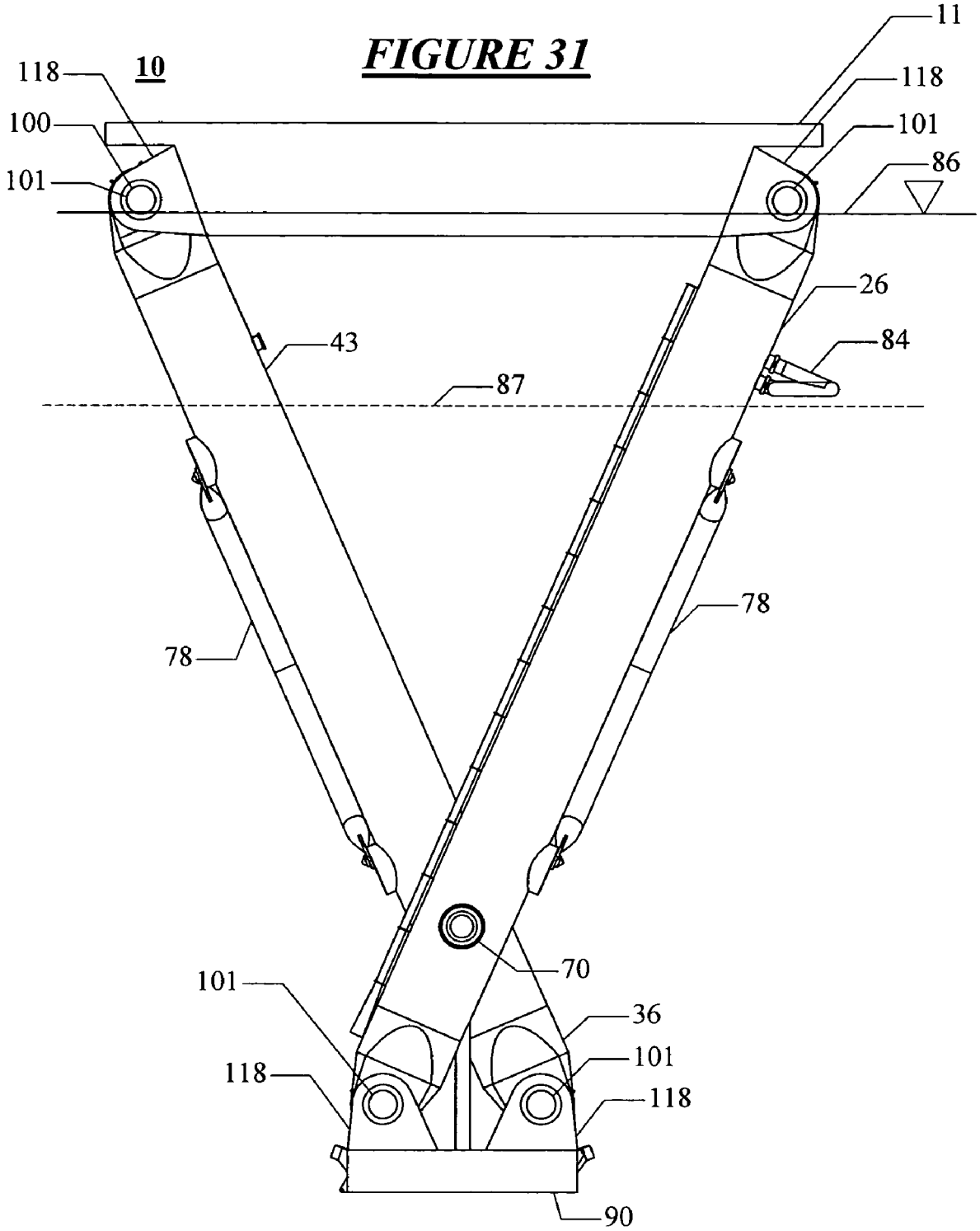
FIG. 31 is a side profile view that shows the platform of FIGS. 29 and 30 from the same side, where the platform is in a third, fully assembled condition. In this figure, the platform is not yet deballasted to raise it to its final operational draft.

The pin connections are selectably engagable and disengagable connectors between the subassemblies of structural components of the floating oilfield production structure. The structure components are initially assembled and configured in relatively shallow water, and then the preassembled structure is towed to a deepwater location and reconfigured to its operational configuration. FIGS. 29, 30, and 31 show the assembly of the oilfield production structure, or floating platform, in sequential assembly states and FIG. 1 shows the structure completely assembled.

The illustrated platform operates in a manner similar to a folding table, in that its pins serve as rotationally free hinge connections. For purposes of illustration of the need for and operation of the pins, the operation of the platform using the first embodiment 100 of the pin connections of the present invention is discussed herein.

Platform 10 has multiple parallel buoyant leg pairs 25, each pair consisting of a leg 26 and a leg 43 pivotably interconnected by a permanent pin 70. The legs are internally compartmented down their lengths and the compartments are interconnected by ballast piping to permit selectable adjustment of their buoyancy. Opposed pairs of selectably extendable and retractible pins 101 are positioned in pin mounting bores 136 in the upper and lower leg ends 36 of the legs 26 and 43 of the platform. Adjacent legs 26 are transversely interconnected by diagonal braces 78, as are the adjacent legs 43. The legs 26 are all coplanar in a plane containing the axes of their coaxial permanent pins 70. The legs 43 are also all coplanar in a plane containing the axes of their coaxial permanent pins 70.

The axes of the permanent pins 70 and the selectably operable pins 101 located in the leg ends 36 are always parallel. The legs in each pair 25 are crossed as seen in FIG. 1 when fully connected by the selectably operable pins 101 both to the deck 11 at their upper ends and the damper plate 90 at their lower ends. When connected, a pin 101 is extended from its pin mounting bore 136 in a leg end 36 into engagement in the bore of a socket 118 mounted on either the deck 11 or the damper plate 90. The sockets 118 are provided in spaced-apart mirror-image pairs that are a close fit to the sides of a leg end 36, with one socket pair for each leg end.

Initially, platform 10 is preassembled inshore by means of the half of the selectably operable pins of the present invention that are located in the leg ends 36 of the legs 26. The platform deck 11, the leg pairs 25 with their pins 101, and the damper plate are separately fabricated and completed prior to preassembly. The preassembly consists of arranging the separate deck 11, leg pairs 25, and damper plate 90 components as shown in FIG. 29, so that the leg and deck subassemblies of the platform are afloat and coplanar on the water surface for transport. As shown in FIG. 29, at completion of the preassembly the damper plate 90 is supported in a position inclined from the vertical by the floating legs. In this preassembled state, the platform only draws a minimal draft, enabling it to be fabricated and preassembled in locations inaccessible for other types of deeper draft deepwater platforms. The platform components are built near the ground surface, and the preassembly shown in FIG. 29 is done near either the ground or water surface. The preassembly will typically be done with the components afloat and alongside a pier or bulkhead.

In the preassembled condition of FIG. 29, the platform 10 may be towed to its installation location, even though not all of its structural connections required to fully rigidize the platform have been made. The structure shown in FIG. 29 is not fully restrained by all of its connections at this point, so that it is articulated at its horizontal connections of the pins 101 in the legs 26 to the sockets 118 of the deck 11 and damper plate 90.

Upon arrival at its installation location, the platform 10 is reconfigured in a two-step sequence by means of controlled buoyancy adjustments of the legs and further engagement of previously disengaged pins. FIGS. 30 and 31 respectively show the first and second steps in the reconfiguration, which requires that rotations take place in the connections between the pins 101 located in the ends of legs 26 and the sockets 118 of the deck 11 and damper plate 90 in which the pins are engaged. The connection of the pins 101 in the legs 43 fully completes the reconfiguration of the platform 10. With all of its structural connections having been made using the pins of the present invention, the platform 10 is deballasted so that it floats at its deep operational draft, indicated by water surface level 87 in FIG. 31.

The components of the main structural elements of the novel floating production platform 10 of the present invention are typically constructed of steel. The design of the structural platform uses tubular members, stiffened shells, frames, and stiffened plate structures commonly found in shipyard and offshore construction. Welding is the primary means of assembly for the structural components of the individual subassemblies. Components related to the pins, such as connecting pins, pin mountings, and pin sockets, require closer tolerances and are typically machined. Standard shipyard, steel fabrication, and machining techniques are available for the manufacture of each of the primary structural components, such as the deck 11, the legs 26 and 43, and the damper plate 90. Other than for application to the pins of the present invention, the manufacturing techniques for those platform components are well known to those skilled in the art and are not discussed herein.

The pins of the pin embodiments 100, 200, 300, 400, 500, and 600 may be cast in one piece and then machined. In such a case, the pin material would probably be a ductile iron or an austempered ductile iron. Alternatively, the pins could be made of a combination of rolled plate rings and either cast or forged disks and rings, with steel being used throughout for weldability. For the fabricated pins, the pins would be machined following welding. Lathe or horizontal boring mill turning is necessary for the exterior of the pins in order to carefully control their size and configuration.

Typically, the pin sockets 118 are welded from plate, but cast and machined subassemblies alternatively could be used around the bores of the pin sockets. In all cases, the pin mounting bores 136 of each group of the leg ends 36 at the upper and lower ends of legs 26 and 43 must all be machined to be coaxial. This machining generally will be performed in situ with portable boring equipment when the leg pairs 25 are finally assembled by their permanent pins 70 and the diagonal braces 78. The final assembly of the set of leg pairs 25 in the fabrication yard requires that adjacent legs 26 from separate leg pairs be interconnected by diagonal braces 78 and that, additionally, adjacent legs 43 from separate leg pairs be interconnected by other diagonal braces 78. Likewise, the mounted pin sockets of each group must be machined to be coaxial. This machining in most cases will have to be done after assembly of the legs and assembly of the sockets to either the deck or the damper-plate in order to ensure proper fit.

In FIG. 1 the general arrangement of the platform 10 can be seen in its operational configuration. The following description of the platform 10 assumes use of the first pin connection embodiment 100. A buoyant barge-like deck section 11, suitable for supporting a drilling system or a production system or a combined drilling and production system, is positioned horizontally at the upper end of the structure 10. For the purposes of illustration, the deck 11 is provided with a well conductor guide tray such as would be used for a production deck arrangement.

The deck is supported by a leg system consisting of multiple buoyant leg pairs 25. Each leg pair includes similar legs 26 and 43 cojoined by a permanent pin 70 which is located in the central portion of the legs and which serves as a hinge or pivot. The first leg 26 and the second leg 43 of a leg pair are laterally offset from each other in the direction of the axis of the permanent pin 70, to permit them to freely rotate in parallel planes relative to each other about permanent pin 70. The permanent pins 70 of the set of leg pairs 25 are coaxial, with all of the first legs 26 of the leg system coplanar in a plane containing their longitudinal axes and their permanent pins 70, and with the second legs 43 similarly mutually coplanar in a separate plane.

The selectably extendable and retractible field mateable pin assemblies of the present invention are mounted in opposed pairs in the pin mounting bores 136 of the distal leg ends 36 of each leg 26 and 43. Each pin assembly embodiment 100 includes a pin and a comateable pin socket.

Figure 8:
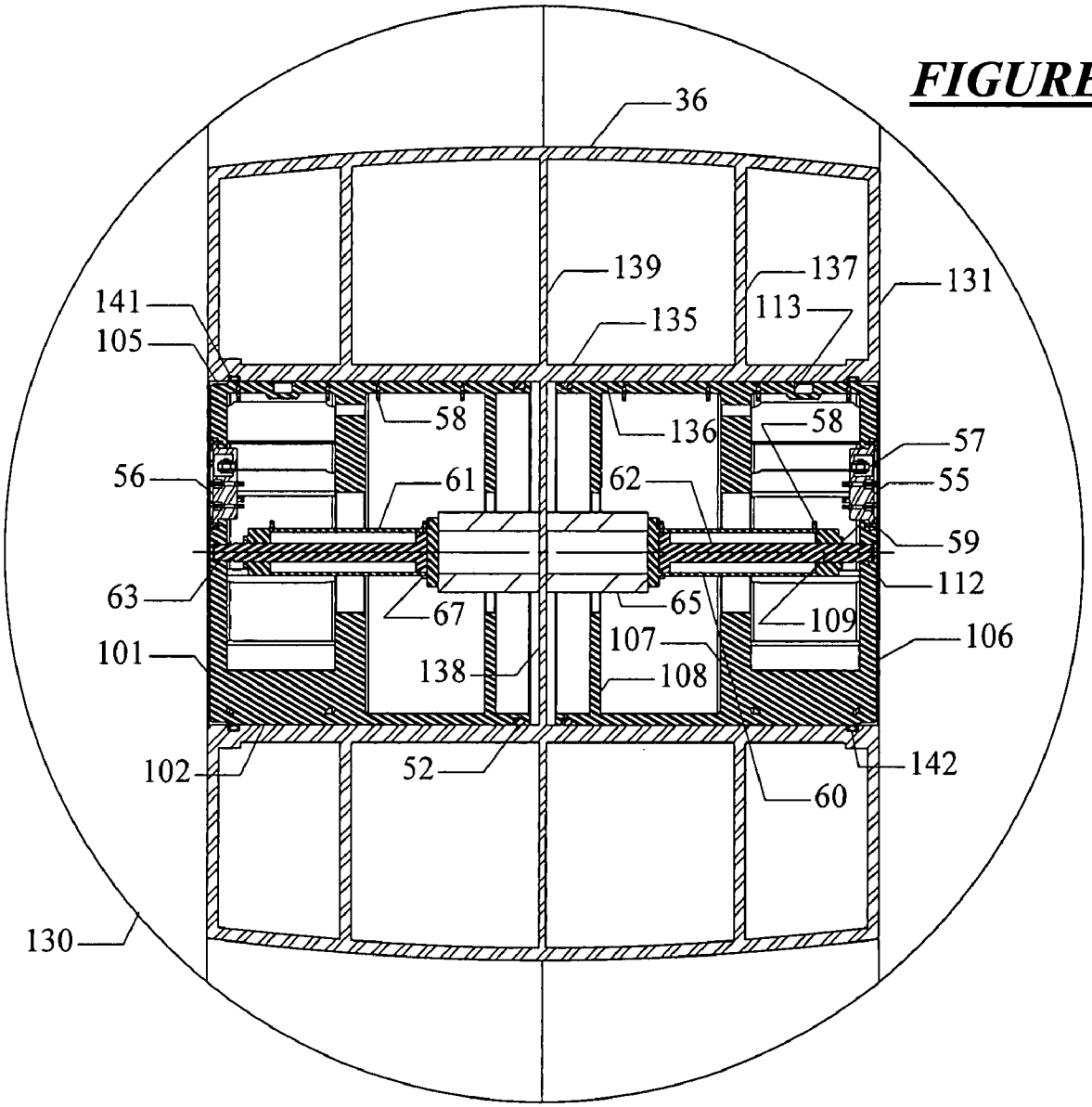
FIG. 8 is a transverse cross-section normal to the leg axis and through the pin axes of the retracted pins shown in FIG. 4 mounted in the leg end.
Figure 9:
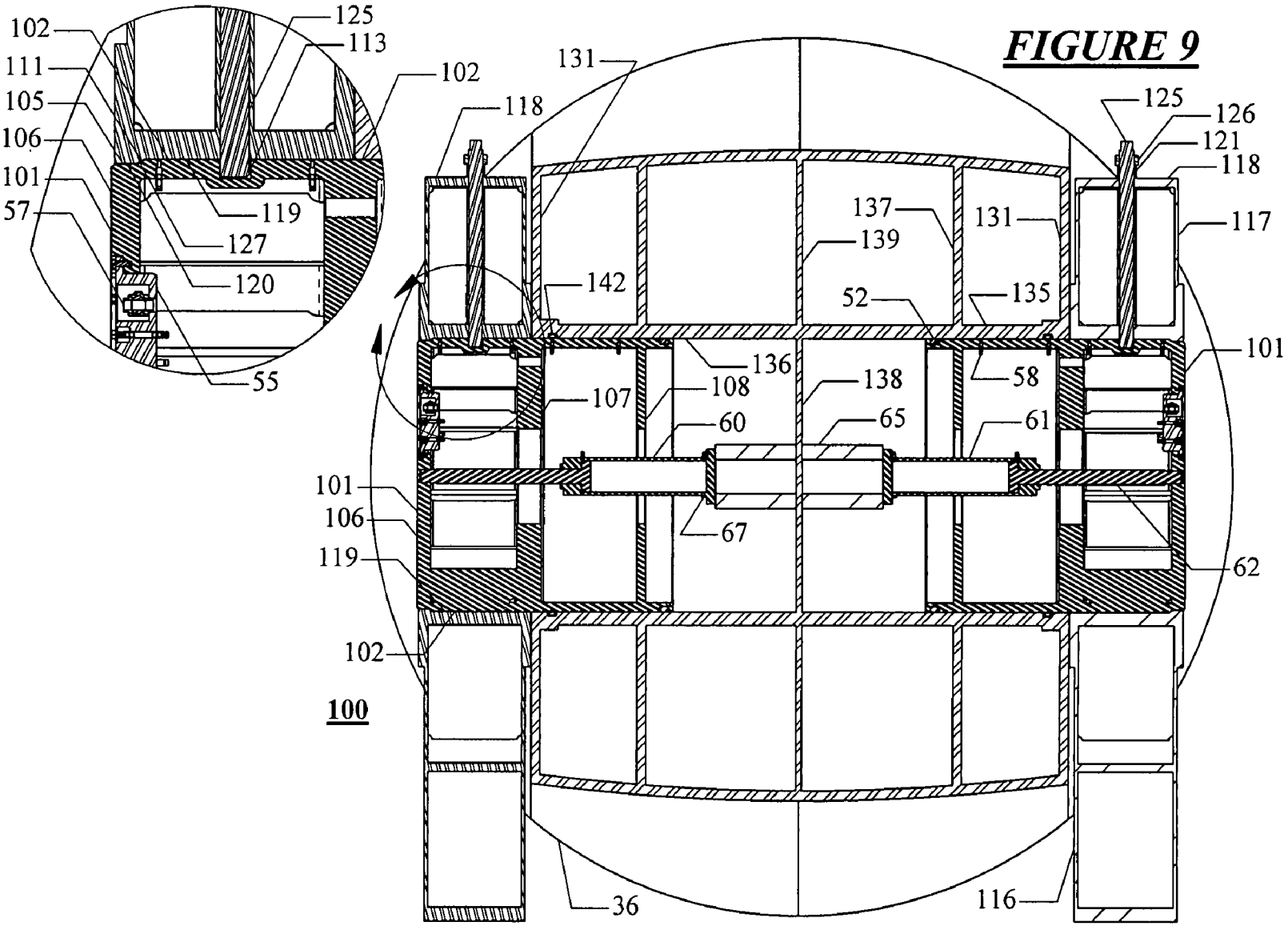
FIG. 9 is a view corresponding to FIG. 8, but showing the pins extended outwardly to engage the pin sockets of the connection.

The first embodiment of the pin assembly 100 has a hollow pin 101 with a coaxial internal double-acting hydraulic cylinder 60 and an access flange assembly 55 as its major subassemblies as shown in FIGS. 1, 8, and 9. The pins 101 are hydraulically axially extendable and retractable and serve to interconnect the legs 26 and 43 to both the deck 11 and the damper plate assembly 90 when extended into and engaged with a pin socket 118.

The leg system consisting of multiple leg pairs 25 is transversely connected and fixedly spaced apart by tubular diagonal braces 78 in order to maintain the leg pairs mutually parallel and so that loads may be efficiently transferred between adjacent leg pairs. The combination boat landing and strongback 84 is a tubular truss rigidly attached to the legs 26 just above the operational waterline for the platform 10. The combination boat landing and strongback 84 serves as a strongback when it is also temporarily connected to the legs 43 during towout of the platform 10. This temporary connection maintains the legs 43 parallel to the legs 26 during towout, thereby avoiding overstress of the permanent pin 70 interconnecting the legs 26 and 43 of each leg pair 25.

The damper plate assembly 90 primarily serves to provide a large hydrodynamic mass to contribute to lower platform response to wave action, but it also interconnects the bottom end of the leg pairs 25 to help rigidize the platform 10 in the planes perpendicular to the axes of the permanent pins 70.

Figure 2:
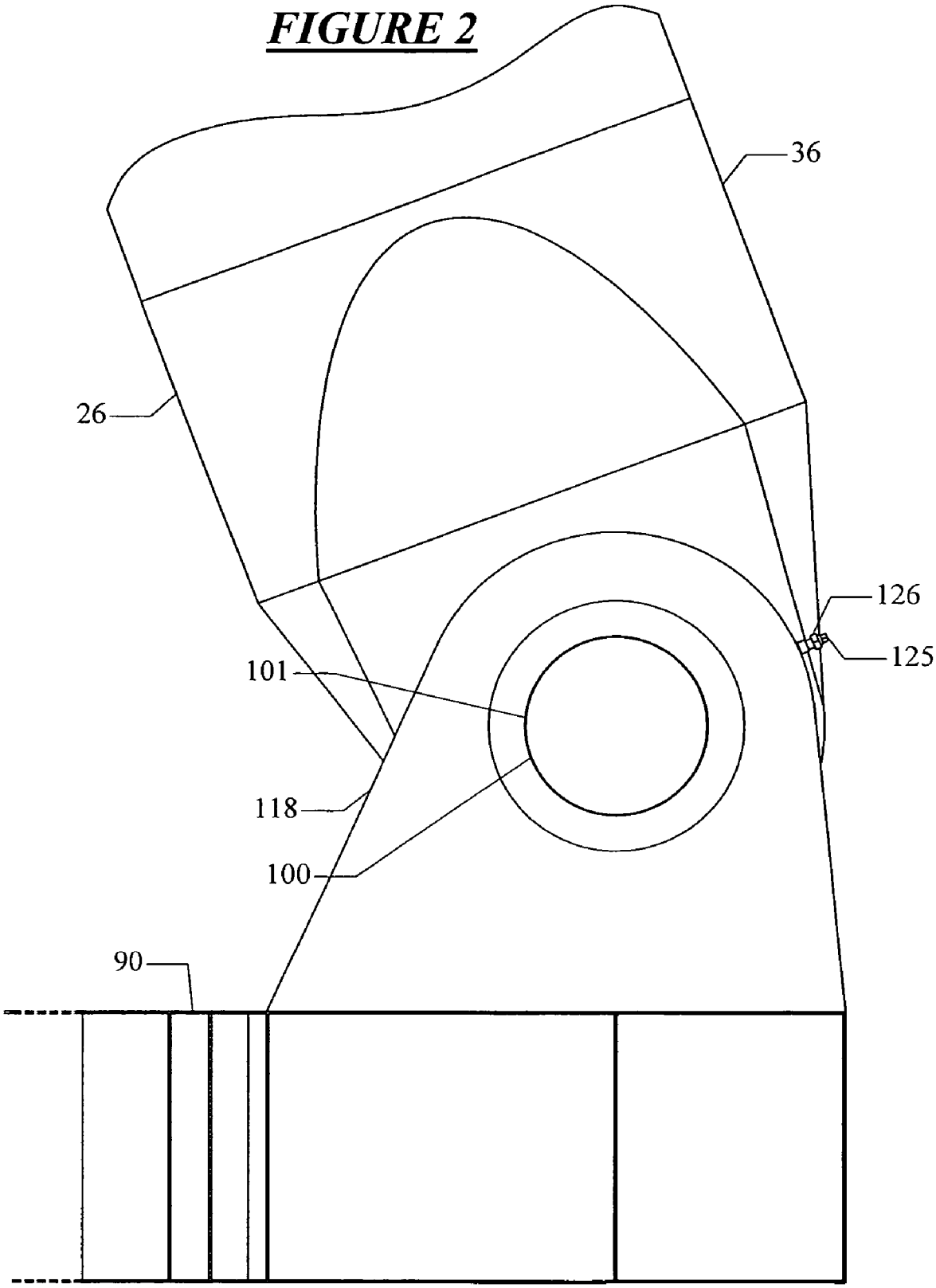
FIG. 2 is a partial vertical cross-sectional view of a supporting structure showing an axial view of a pin connection of the present invention.

FIG. 2 is a profile view of a typical pin connection for the platform, wherein the pin is shown without a manway flange for simplicity. The rigidization of the platform 10 in these primary planes is due to the formation of multiple parallel four-bar linkages, each with five pins, wherein the pin assemblies 100 provide reciprocable, selectably operable pinning. Considering the multiple leg linkages as a single aggregate linkage, the deck 11, the first legs 26, the second legs 43, and the damper plate 90 serve as the four bars, and the permanent pins 70 and the field mateable pin assemblies 100 constitute the pins.

Prior to the connection of the last set of corresponding pins on the linkage, the linkage is not rigid. The diagonal braces 78 assist the pin connection joints formed by the field mateable pin sockets 118 with the field mateable pin assemblies 101 in maintaining the overall rigidity of the platform in the transverse vertical secondary plane containing the axes of the permanent pins 70. Additionally, a combination boat landing and strongback 84 is used to further connect the legs 26 of the platform 10 on one side of the platform. If a second, optional combination boat landing and strongback 84 is used on the other side of the platform, it also further connects the legs 43.

Preassembly and Assembly of the Platform

Referring to FIG. 1, the primary components of the platform 10 are the deck assembly 11, the leg pairs 25 connected by their diagonal braces 78, the combination boat landing and strongback 84, and the damper plate 90. The payload for the platform is preinstalled on the deck before preassembly of the primary components. The platform 10 is first preassembled inshore in sheltered waters and then its assembly is completed in two steps offshore in deep water as described above.

In contrast to most platform types, the preassembly, shown in FIG. 29, connects all of the components of the platform at least partially. Thus, the final assembly offshore is limited to reconfiguration, rather than assemblage of separated components. This arrangement is possible because of the properties of the pin connections of the present invention, namely the selectable and reversible engagement of the pins into the sockets to enable the transfer of large loads between the legs 26 and 43 of the platform and both the deck 11 and damper plate 90. An additional critical property of the pins 101 used in the offshore reconfiguration of the platform is their ability to rotate relative to the sockets 118.

Referring to FIG. 29, the platform primary components are preassembled in a largely planar configuration that floats with shallow draft. Each of the legs 26 is connected to a leg 43 by a permanent pin 70 to constitute a leg pair 25. The diagonal braces 78 interconnect the assemblage of parallel leg pairs 25, and the combination boat landing and strongback 84 is rigidly connected to the legs 26. The diagonal braces 78 are attached between adjacent legs 26 and likewise between adjacent legs 43. Additionally, the legs 43 are also temporarily rigidly connected to the combination boat landing and strongback 84 at this stage in order to eliminate relative motion of the legs 26 and 43 when the preassembled platform 10 is under tow. This temporary connection of legs 43 is made by means of selectably engagable connectors such as split hub connectors.

For this preassembly arrangement, the pins 101 at the upper ends of the legs 26 are engaged with the pin sockets 118 on the first side of the fully outfitted deck 11 so that the legs 26 are rotatably connected thereto. The pins 101 at the lower end of the legs 26 are rotatably engaged with the pin sockets 118 at the first side of the damper plate 90. The damper plate 90 is lifted into position for connection to the legs 26 by cranes or, alternatively, floated into position with its first side ballasted down. This preassembled arrangement of the platform 10 is rigid in the horizontal plane, but is articulated about its pins 101 engaged in the pin sockets 118 of the deck 11 and the damper plate 90.

When towing offshore, the damper plate 90 is normally restrained from movement relative to the legs 26 by tiedowns or hydraulic cylinders or both. As shown in FIG. 29, knees mounted on the damper plate 90 abut the sides of the legs 26 and hold the damper plate in its inclined position relative to the legs. Accordingly, when under tow in a seaway, the platform will experience relative rotation only about the axis of pins 101 between the deck 11 and the leg pairs 25 with their attached damper plate 90. For this reason, towout of the platform is done when the wave forecast is good for several days.

After arrival at or near the installation location for the platform 10, the second step of the platform assembly can be performed. To prepare for this second step of the platform assembly, the temporary connections of the legs 43 to the combination boat landing and strongback 84 are removed and arrangements for controlled adjustment of the ballast in the legs 26 and 43 are made. In addition, any fixed restraints used to hold the damper plate 90 rigid relative to the legs 26 during towout are removed and the structure of the damper plate is made free-flooding.

Following these preparatory steps, the transition of the linked primary elements of the platform 10 from the preassembled state shown in FIG. 29 to the second assembly stage shown in FIG. 30 is started. The damper plate 90 is brought to a vertical or near vertical position relative to the horizontal legs by pivoting it about its pinned connection to the legs 26. This pivoting is done using either hydraulic cylinders (not shown) or a derrick barge. If used, the hydraulic cylinders are attached to both the legs 26 and the damper 90 at points offset from the pins 101 of the lower ends 36 of legs 26 engaged in the pin sockets 118 of the damper plate. This pivoting of the damper plate 90 is necessary to avoid interference of the damper with the lower end of the legs 43 when those legs are rotated about the pins 70 which join them to their respectively paired legs 26.

Figure 32:
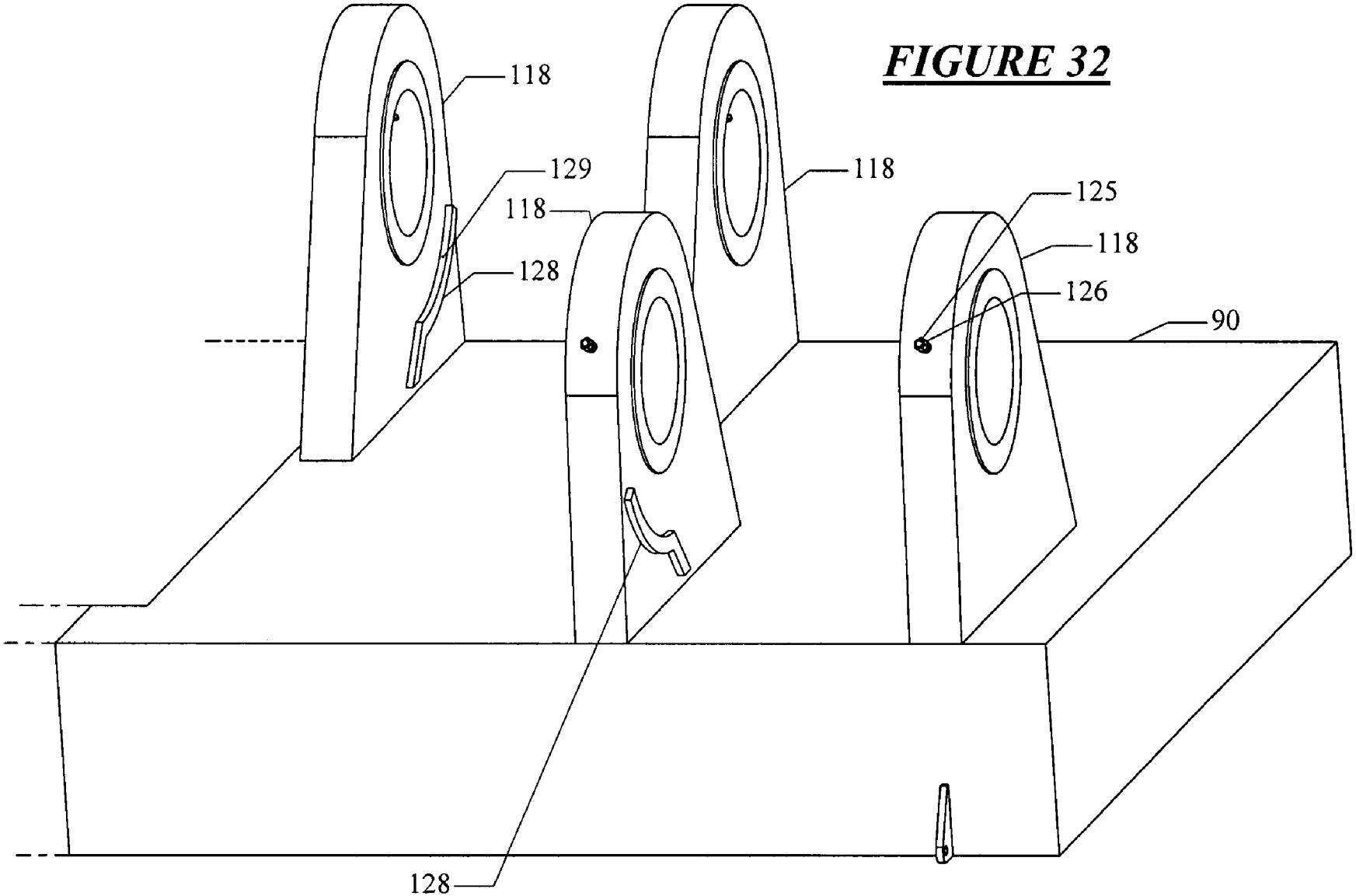
FIG. 32 is an oblique view of one end of the damper plate assembly of the platform of FIG. 1, wherein the location of the leg travel stops which are attached to the interior faces of the pin sockets are shown for the pin sockets of the first pin connection embodiment.

The legs 43 are caused to rotate to the position shown in FIG. 30 by adding water into their upper ends. This adjustment of ballasting of the legs 43 is done in a manner such that the legs 43 are nearly neutrally buoyant. After the legs 43 have been rotated counterclockwise approximately halfway between their position in FIG. 29 and their position in FIG. 30, the damper plate 90 is allowed to rotate back to return to a position where its pin sockets 118 on the second upper side of the damper plate will be aligned with the arcuate path of pins 101 in the lower ends 36 of the legs 43. When the legs 43 have rotated sufficiently, the outer edges of the distal ends of the leg ends 36 of the legs 43 abut the travel stops 128 mounted on the inner faces of each of the sockets 118 in an opposed pair, as shown in FIG. 32.

The installed position of the travel stops 128 is such that when the leg end 36 abuts the travel stop, the pins 101 are aligned or substantially aligned with the bore of their sockets 118. At this time, the selectably operable opposed pins 101 of the lower ends 36 of the legs 43 are extended outwardly to fully engage their corresponding sockets 118. This pinning of the legs 43 to the damper plate 90 rigidizes the combination of the leg pairs 25 and the damper plate. In this rigidized condition shown in FIG. 30, the pins 101 engaged with the sockets 118 of the damper plate no longer rotate. However, the rigid combination of the leg pairs 25 and the damper plate 90 is able to rotate as a rigid body about the connection of the pins 101 of the upper leg ends 36 of the legs 26 to the sockets 118 at the first side of the deck 11.

The transition from the completed second assembly step shown in FIG. 30 to the third and final assembly step shown in FIG. 31 is performed as follows. Ballast is added to the lower end of the legs 26 and 43 while the damper plate 90 is allowed to freely flood. The combination of the legs and the damper plate is kept slightly neutrally buoyant, but the combination is caused to have a torque causing it to rotate in a clockwise direction about the pins 101 engaged in the sockets 118 on the first side of the deck 11. As the upper ends of the legs 43 in the rigid combination of the legs and damper plate pass beyond the vertical plane through the axes of the pins 101 engaged in the sockets 118 on the first side of the deck 11, ballast water is shifted from the upper ends of legs 43 to elsewhere in the leg pairs 25.

The adjustment of the ballast in the legs 26 and 43 is necessary so that a clockwise torque about the pinned connection of the legs to the deck is always acting on the combination. Again, the net buoyancy of the leg-damper plate combination is maintained at neutral or slightly negative during the rotation. When the leg-damper combination is fully rotated, as shown in FIG. 31, the upper ends 36 of the legs 43 abut the travel stops 128 on the inner faces of their corresponding pin sockets 118 on the second side of the deck 11.

After the alignment produced by the abutment of the leg ends on the travel stops is achieved, the pins 101 at the upper end 36 of legs 43 are fully or nearly aligned with their respective bores in the pin sockets 118 on the second side of the deck 11. At this time, the remaining unengaged pins 101 at the upper end of the legs 43 are extended into full engagement with their corresponding sockets 118 and the platform 10 is fully rigidized and floating on the water surface 86 shown in FIG. 31. Deballasting of the platform so that it reaches its operational draft, shown with the water level at 87, completes the assembly of the structure. It can then be moored and used for a variety of operations.

The First Embodiment of the Pin Assembly

Figure 3:
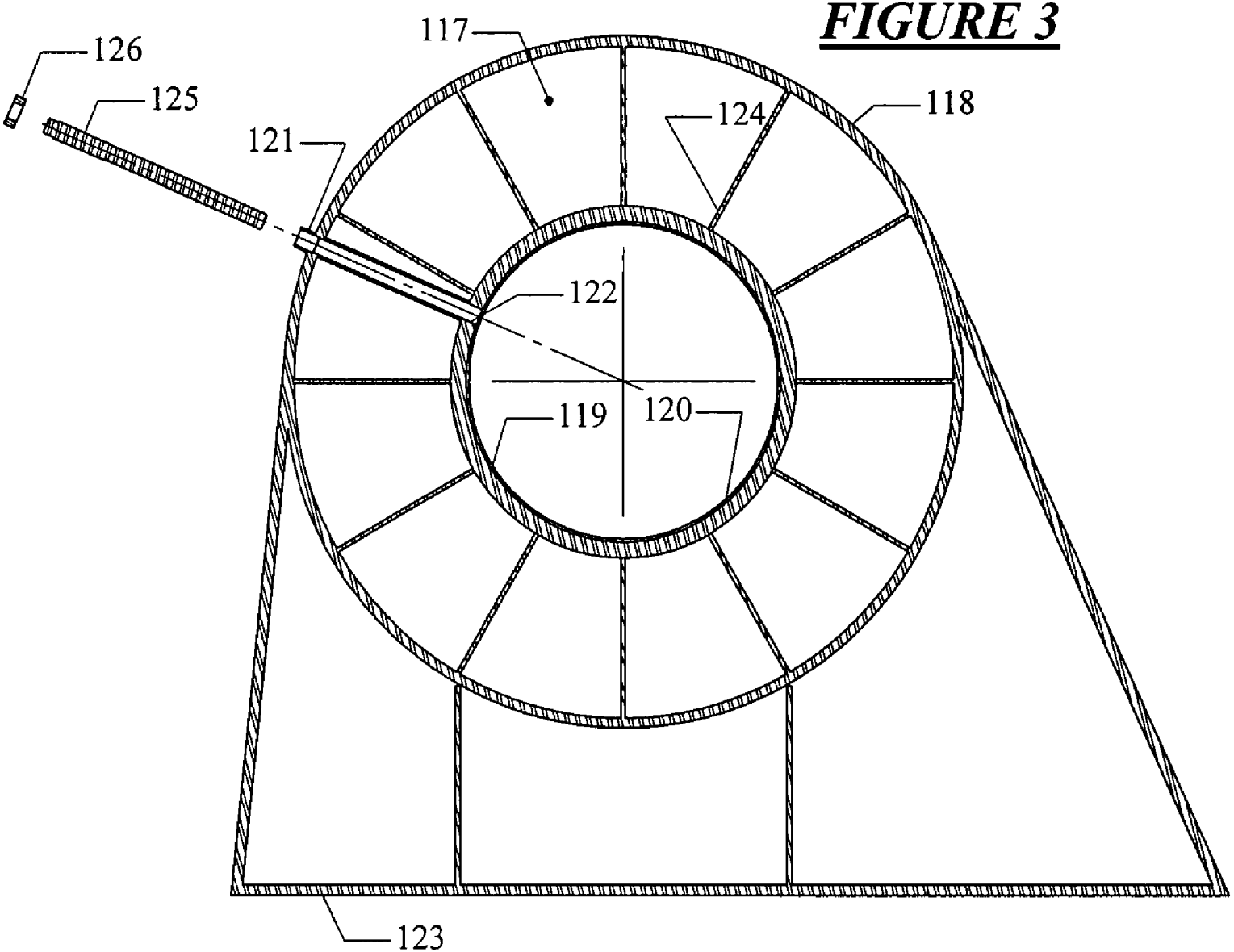
FIG. 3 is a longitudinal vertical cross-sectional view of a pin socket taken on the transverse midplane of the pin socket normal to the centerline of the bore through the socket.

The various constituents of the first pin assembly embodiment 100 are shown in FIGS. 3 through 9. The major components of the pin assembly are a pair of pins; a pair of pin sockets, or receptacles for receiving the pins; and a selectably operable, bi-directional pin actuator mounted on one end of each pin. FIG. 3 shows a cross-sectional view of a first pin socket embodiment 118 taken transverse to the axis of the bore of the socket. This first pin assembly 100 is configured with a hydraulically extendable and retractable pin 101 having a frustro-conical taper near its outer, distal end. The first pin socket has its bore configured to accommodate and abut the tapered portion of the extended pin.

1. Field Mateable Pins

Figure 5:
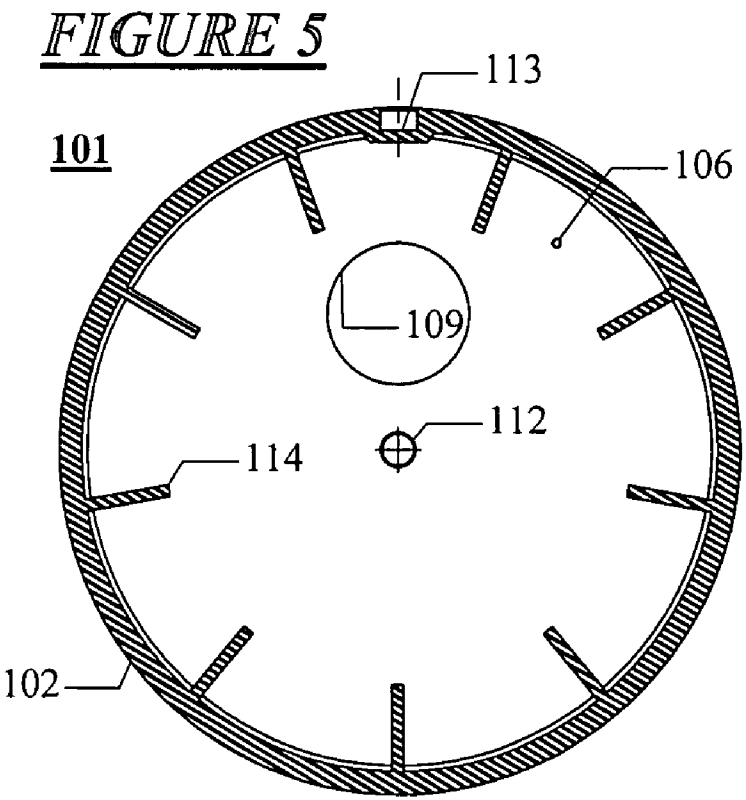
FIG. 5 is a transverse cross-sectional view taken along the section line 5-5 of FIG. 4.
Figure 4:
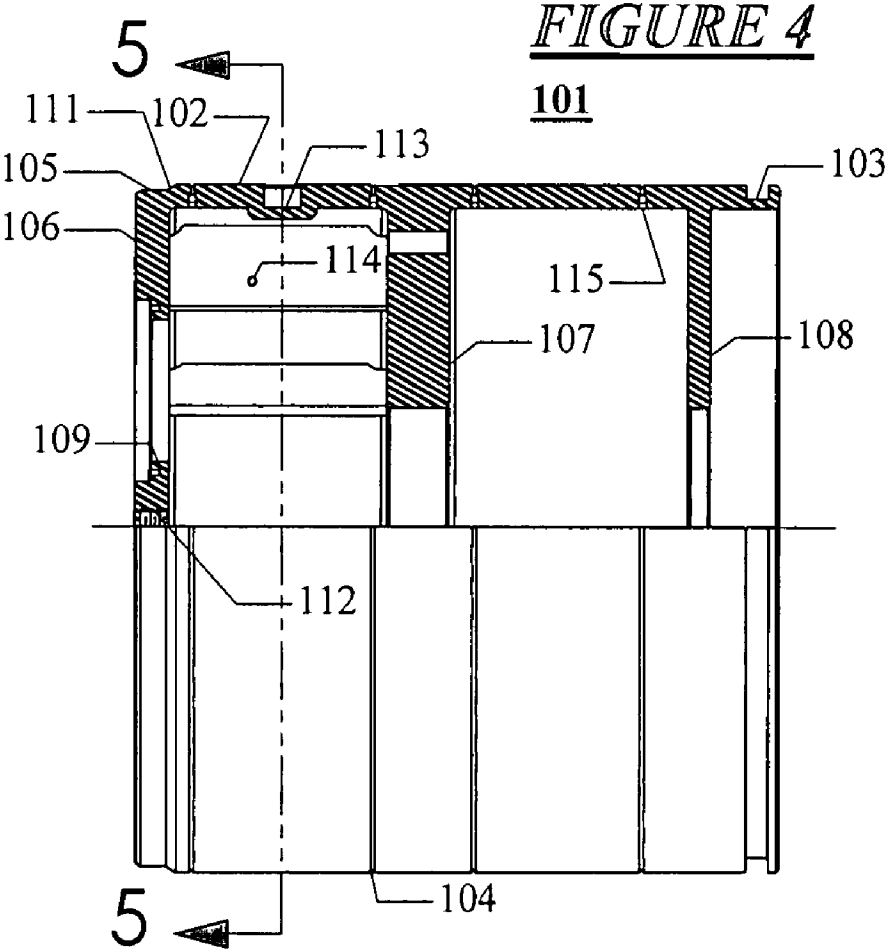
FIG. 4 is a longitudinal quarter-sectional view of a pin of the first pin embodiment of the present invention.

FIGS. 4 and 5 respectively show a longitudinal quarter-section and a transverse cross-section of the field mateable pin assembly 100 of the first embodiment. The pins of the present invention have a hollow casing with at least one internal transverse diaphragm and a pressure equalization means for equalizing the pressure within the pin casing with the pressure of the environment.

The pins are mounted in coaxial outwardly extending opposed pairs which, when extended, are cantilevered from their housings in the pin mounting bores 136 of the leg ends 36. In addition, FIG. 8 shows a longitudinal cross-sectional view of the pins 101 of the pin assembly 100, where the pins are installed in their retracted positions in a leg end 36. FIG. 9 further shows the engaged pin assembly 100 with its pins 101 extended and engaged with the comating latch sockets 118. Referring to those figures, two field mateable pins 101 are mounted antisymmetrically in the latch pin bore 136 of each leg end 36, with the two mounted pins straddling the central diaphragm 138 of the field mateable pin leg end 36.

Each side of the field mateable pin assembly 100 consists of a pin 101, an access flange assembly 55, a hydraulic cylinder assembly 60, and a spacer block 65, all mounted to the central diaphragm 138 of the leg end 36 by means of threaded mounting studs 66 with nuts 67 assembled through comating holes in the cylinder base flange, the spacer block 65, and the diaphragm 138. As an example of a typical case, the diameter of the pin 101 is approximately 120 inches (3.28 m) so that sufficient space can be provided for personnel access inside. The diameter of the pin typically will be from 27% to 32% of the diameter of the leg end 36 in which the pin is housed, and the diameter of the manway passage 109 is 24 inches (0.656 m).

The pin 101 has a right circular cylindrical outer body or casing with an outer cylindrical surface 102 which is a close slip fit to the bore 136 and which has an external annular O-ring groove 103 containing O-ring 52 adjacent its open interior end. O-ring 52 sealingly mates with pin mounting bore 136 of the field mateable pin leg end 36. At its outer end, pin 101 has a slightly reduced diameter concentric entry cylindrical outer surface 105. A short concentric frustro-conical transition section 111 connects outer cylindrical surface 102 with the entry cylindrical outer surface 105. Although it is not shown here, the pin 101 is restrained against rotation about its longitudinal axis by means of a key and comating keyway or other similar means. The diameter of the pin 101 is such that it is a slip fit into and freely rotatable within a bore 119 of a pin socket 118.

A large bevel is provided on each external end of the external cylindrical body of each pin 101, and the pins are lubricated at assembly into their mounting bores 136. The outer end of pin 101 has an integral thick transverse end diaphragm 106 and a relatively thicker integral transverse annular ring middle diaphragm 107 positioned coaxially with the cylindrical pin body 101 and spaced inwardly from the end diaphragm. The distance between the distal side of the end diaphragm 106 and the transverse midplane of the middle diaphragm 107 is approximately equal to the axial thickness of the pin socket 118. End diaphragm 106 has an off-center externally counterbored hole 109 parallel to its axis for the mounting of access flange assembly 55. The hole 109 for flange 55 is made large enough to serve as a manway. Drilled and tapped holes are provided on the outwardly facing transverse face between the bore and counterbore in end diaphragm 106 consistent with the bolt hole pattern in the access flange 56. Additionally, the inner side of the end diaphragm 106 has a concentric drilled and tapped hole 112 for the attachment of the threaded rod end 63 of the hydraulic cylinder 60.

Close to the interior open end of pin 101 is located transverse interior end diaphragm 108, which is a thinner, relatively to diaphragms 106 and 107, annular right circular ring concentrically attached to the inner wall of the casing, or cylindrical body, of pin 101. Intermediate between the end diaphragm 106 at the outer end of pin 101 and middle diaphragm 107 is an interior boss reinforcing the cylindrical wall and sealing thereto to prevent leakage through a mutually concentric external blind radial locking pin socket 113 which is engageable by threaded keeper pin 125 of the field mateable pin socket 118.

The cylindrical body 102 of pin 101 is provided with multiple radial through holes 115, which serve as lubricant injection ports. Ports 115 are drilled and tapped on their interior ends and intersect corresponding shallow circumferential annular lubricant distribution grooves 104 on the cylindrical exterior 102 of pin 101. These grooves 104, shown in FIG. 4, serve as lubricant distribution channels through which grease is pumped via the hydraulic quick connect fittings 58 mounted in holes 115 to ease the movement of the pins into and out of engagement with the bores 119 of the pin sockets 118. The interior of the cylindrical body of the pin 101 may also be reinforced to handle the thrust loads from the actuator cylinder 60 by means of multiple radial stiffener plates 114 positioned between and joined to the internal transverse diaphragms 106, 107, and the optional diaphragm 108. The plates 114 are shown between diaphragms 106 and 107 in FIGS. 4 and 5.

Figure 7:
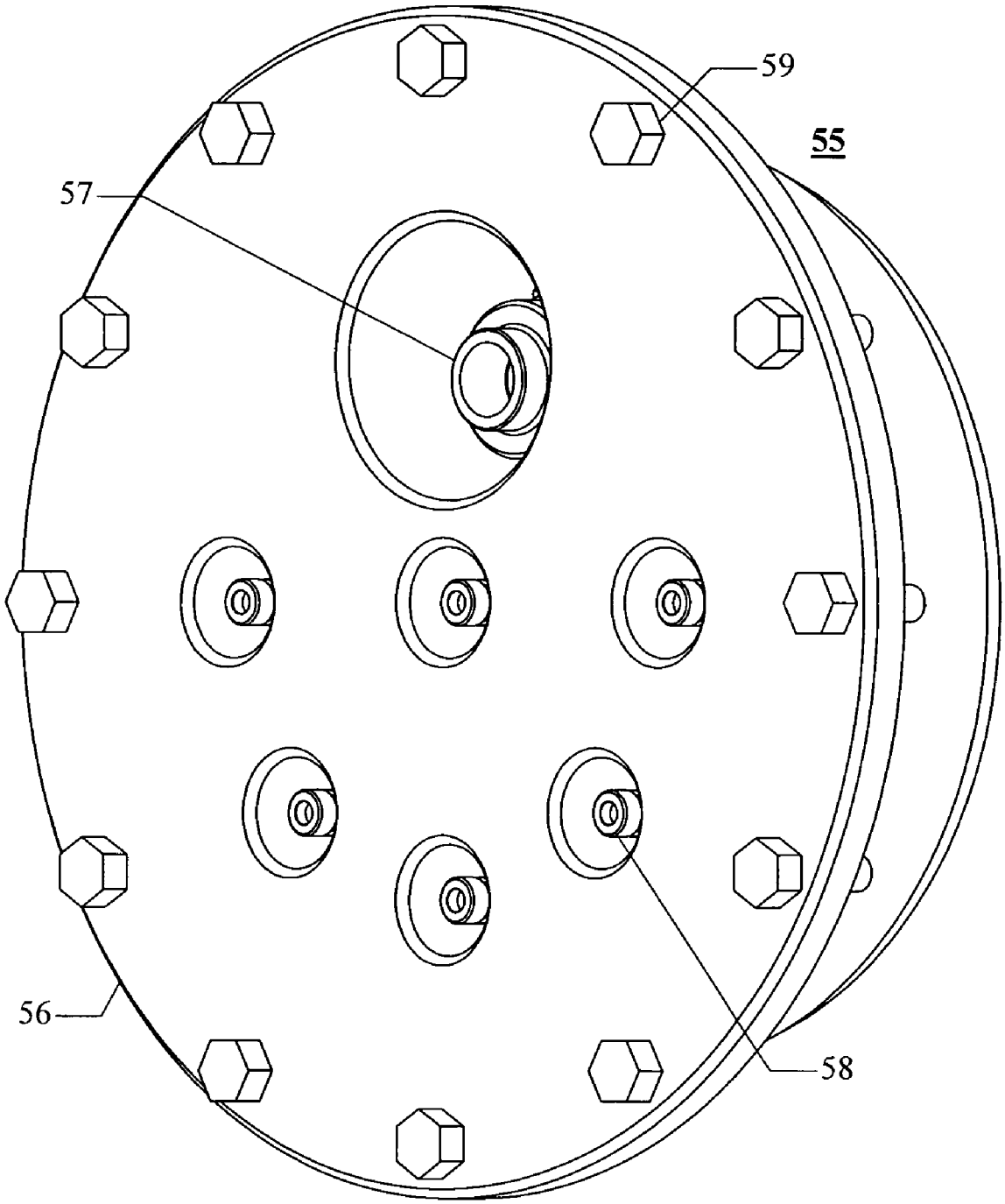
FIG. 7 is an oblique view of the manway access flange assembly used in the transverse outer end of the pin.

Access flange 56 of the access flange assembly 55 shown in FIG. 7 is a thick right circular cylindrical disk with a concentric outwardly extending flange on its outside end. A bolt hole circle is provided in the periphery of the flange 56 for its mounting by means of flange mounting bolts 59, and a sealing gasket (not shown) is located inwardly of the bolts so that the interior of the pin 101 is pressure-tight, as it is sealed by O-ring 52. Access flange 56 has multiple through holes drilled and tapped on both ends and parallel to its axis and having outwardly opening counterbores.

A selectively operable ball valve 57 and hydraulic quick connect fittings 58 are threadedly and sealingly mounted to the ends of the through holes on the outward side of flange 56 and are recessed within the counterbores of those holes. The valve 57 and the quick connect fittings 58 do not extend outwardly past the transverse outer face of the access flange 56. The thickness of the radially outwardly extending flange of the access flange 56 is such that the heads of the bolts 59 do not extend outwardly of the outer face of the end diaphragm 106 of pin 101. Additionally, the interior ends of the through holes in flange 56 accommodating the outer quick connect fittings 58 are also tapped, thereby permitting the installation of a corresponding number of quick connect fittings 58 on the interior side of the flange 56. These quick connect fittings permit independent external supply of grease through hoses (not shown) to the quick connects in the lubricant injection ports 115, as well as permitting external powering and control of the hydraulic cylinder assembly 60.

The ball valve is selectably operated externally so that hydraulic lock of the pin 101 in the pin mounting bore 136 of the leg end 36 is avoided by permitting pressure equalization between the exterior and interior of pin 101 when shifting the pin position. The ball valve 57 is closed following completion of a pin move. For example, for underwater operations the ball valve may be opened to allow water into the pin casing to equalize the pressure with the water in the exterior environment.

The access flange assembly 55 is placed where it can be accessed and operated by a diver or a remotely operated vehicle (ROV) if underwater or by conventional means if it is above the water surface. This accessibility permits the connection and disconnection of hydraulic control lines, grease supply lines, and a valve operating means so that the ball valve 57 and the hydraulic cylinder 60 can be operated externally. Additionally, grease can be injected as required in order to lubricate the pin. Alternatively, the ball valve 57 and the quick connect fittings 58 may be mounted directly in the outer transverse diaphragm 106 if it is anticipated that the access flange assembly 55 will be utilized regularly.

Figure 28:
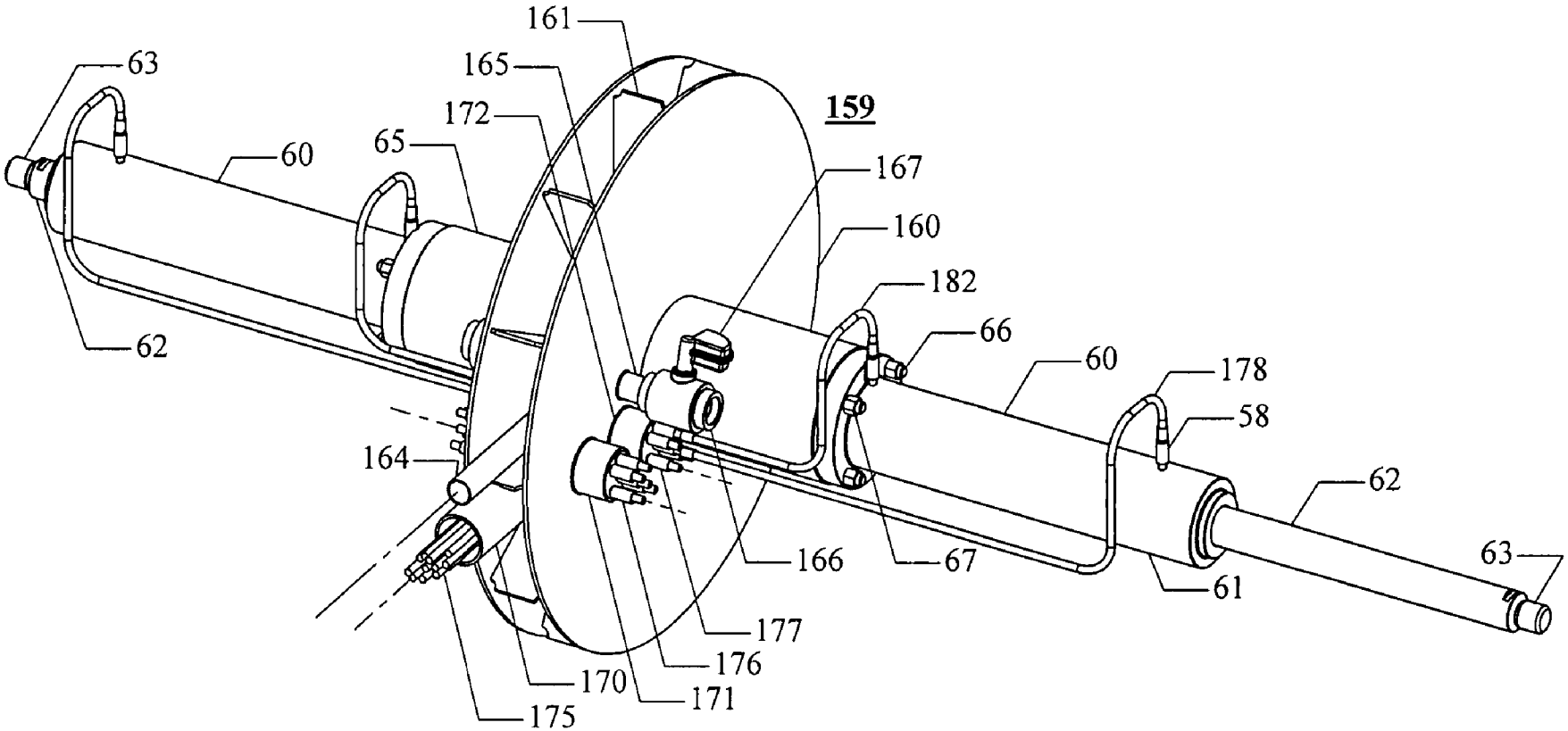
FIG. 28 is an oblique view of an alternate bore middle diaphragm assembly for mounting in the pin mounting bore of a leg end, wherein the actuating hydraulic cylinders for the pins and the positioning of control and lubrication lines are shown.

The hydraulic cylinder 60 is of conventional double-acting design, with an outwardly extending transverse base mounting flange having mounting holes in a regular bolt hole pattern on the inner end of its generally hollow cylinder body 61. The flange permits cylinder mounting to the spacer blocks 65 and the bore middle diaphragm 138 by means of mounting studs 66 and hex nuts 67, as shown in FIG. 28. The spacer blocks 65 are right circular cylindrical heavy wall tubes having a pattern of through bolt holes parallel to their longitudinal axes. The pattern of the bolt holes in the spacer blocks 65 is the same as that in the mounting flange of the cylinder body 61. When mounted to the diaphragm 138, the cylinders 60 are opposed with their rods extending outwardly from the diaphragm. The cylinder rod 62, which has distal wrench flats and a male thread 63 at its outer end, is relatively large in order to avoid buckling under the high thrusts required during insertion of the pin 101. Although not shown in the drawings for reasons of clarity, it is assumed that the cylinders 60 are provided with passively set, pressure-released rod locks of conventional construction. In the event that the pin 101 is not fitted with an antirotation means, such as a key and keyway combination, a cylinder rod swivel (not shown) is interposed between the end of cylinder rod 62 and the threaded hole 112 of the pin.

2. The Field Mateable Pin Sockets

Mounted on the pin socket mounting surfaces of both the deck 11 and the damper plate assembly 90 and extending perpendicularly thereto are a series of multiple pairs of parallel, spaced-apart, antisymmetric, coaxially mounted field mateable pin sockets 118 used to attach the leg ends 36, as described in more detail below. The number and positioning of the pairs of pin sockets 118 corresponds to the number and positioning of leg ends 36 attaching to the deck 11 or the damper plate assembly 90. The sockets 118 are rigidly connected to internal supporting structures (not shown) inside the deck and damper sections. The spacing of the leg sockets 118 in a pair is such that they are a relatively close fit to the external flats 131 of the leg ends 36, with only 0.125 to 0.25 inch (3 to 6 mm) of clearance gap. The corners of the sockets 118, which the leg ends 36 must pass during entry of the leg ends, are chamfered to ease entry. While not shown herein, the pin sockets 118 alternatively also may be structurally connected on their outer sides to their mounting surfaces with transverse lateral supports such as buttresses and knees in order to strengthen them for resistance to transverse loadings in the direction of their bore axes, as may be readily understood by those skilled in the art.

The field mateable pin sockets 118 are arranged in antisymmetrical pairs of buttress construction, so that they closely straddle a leg end 36 when a connection is made. The sockets 118 in a pair are perpendicular to the axis of the pins 101. The sockets 118 in a pair have coaxial horizontal axis straight bores 119 extending from their inner sides (which face the sides of the leg ends 36) most of the way through their thicknesses. The thickness of the sockets will be on the order of 50 inches (1.27 m). The bores 119 are parallel to the axes of the pins 101.

For simplicity, the lefthand socket shown in profile in FIG. 2 is described herein. At the outer side of socket 118, the bore is reduced slightly to provide concentric reduced bore 120 which is joined to the larger straight bore 119 by a short concentric frustro-conical segment 127. The socket bores 120 and 119 are close slip fits to, respectively, outer surfaces 105 and 102 of pin 101, while frustro-conical surfaces 127 of the socket and 111 of the pin have the same angle of inclination.

As may be seen in FIG. 3, between the parallel vertical side plates, the socket 118 structure consists of an integral cross tube housing the bores 119, 120, and 127 and extending between the inner side plate 116 and the outer side plate 117, outwardly extending radial stiffeners 124, an outer cylindrical ring, and attached mounting structure extending toward the base plate from the outer ring. A base plate 123 serves as a mounting surface, and the side plates are provided with external annular ring reinforcement plates around the bore. All of the bores 119, 120, and 127 of the side plates of the sockets 118 on either side of the deck 11 or of the damper plate assembly 90 are coaxial. Although the number of pin sockets 118 will vary with the number of leg pairs used in the structure, a preferred embodiment shown in FIG. 1 has three pairs of pin sockets 118 on two opposed sides of the deck 11 and of the damper plate 90 to accommodate the three leg pairs of the leg system 25.

Each pair of the field mateable pin sockets 118 are optionally provided with a pair of horizontal travel stops 128 welded on their interior facing transverse sides, as shown in FIG. 32. The travel stops 128 are narrow strips of thick plate having a primary circular arcuate section and a straight lead-in section extending outwardly at an acute angle to the tangent to the arcuate section. The inner radius of the travel stop 128 forms an abutment surface 129 for and has the same radius as the outer periphery of a leg end 36. The travel stop is positioned on the side of the bore 119 opposed to the entry path of the leg end 36 during platform 10 assembly, with the straight lead-in section being on the side of the interior face of the socket 118 where it is attached to the deck 11 or the damper plate 90. The abutment surface 129 of the travel stop 128 is concentric with the axis of the bore 119 of the socket 118 so that it is able to centralize and properly locate the leg end 36 to align the pin mounting bore 136 of the leg end and hence the pins 101 to permit ready stabbing of the pins into their sockets.

Referring to FIG. 3, it can be seen that an internally threaded radially outwardly extending tubular boss 121 is welded onto the exterior of each of the sockets 118 centrally between the side plates of the sockets. The bore of the boss is coaxial with a radial penetration hole 122 extending from the interior bore 119 of the socket. An externally threaded hex headed cylindrical keeper pin 125 is threadedly engaged with the threads of the boss 121. The threads permit easy insertion and retraction of keeper pin 125 through penetration hole 122 so that locking pin pocket 113 of the field mateable pin 101 can be engaged to prevent inadvertent disengagement of the pin 101 from the socket 118. Jam nut 126 mounted on the outer end of keeper pin 125 serves to lock the keeper pin 125 in position in the boss 121. The hex head of the keeper pin 125 and the hex jam nut 126 both can be engaged by a wrench operated by either a diver or a ROV in the event that the pin is underwater or awash.

3. Mateable Pin Leg End

Figure 6:
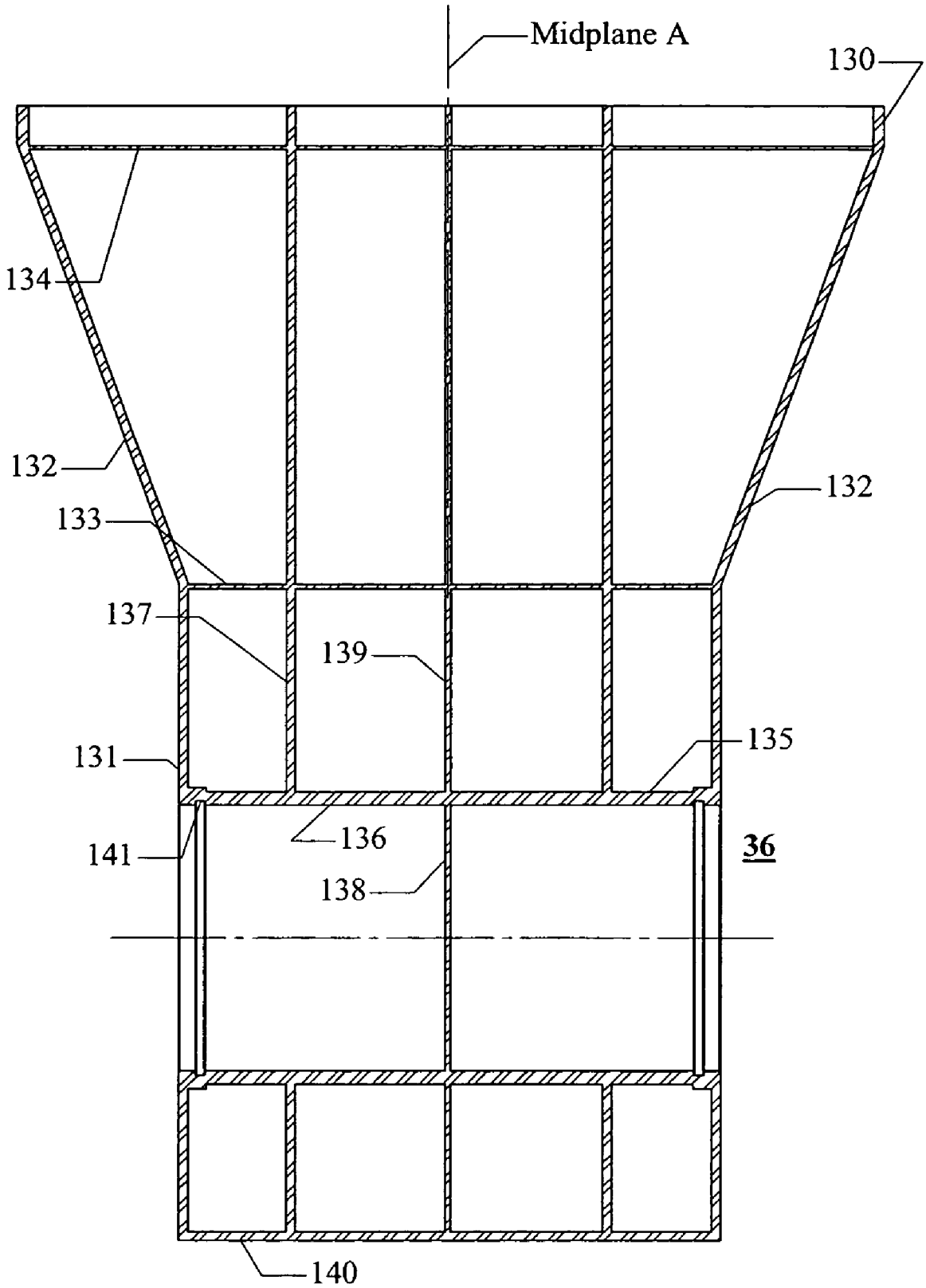
FIG. 6 shows a longitudinal cross-sectional view of a platform leg end taken through the plane containing the centerlines of the leg axis and the pin mounting pockets of the leg end.

Each leg 26 and 43 of platform 10 has a leg end 36 with a pair of field mateable pins 101 at each of its distal ends. A cross-section through both the longitudinal axis of the field mateable pins 101 mounted in a leg end 36 and the longitudinal axis of the leg end is shown in FIG. 8. Referring to FIG. 6, the leg ends 36 are symmetrical about the leg midplane (midplane A in FIG. 6) perpendicular to the leg cross bore for the permanent pin 70. The leg end 36 is cylindrical at its attachment point to the central leg body, but has symmetrically opposed flats consisting of outside plates 131 at its outer end. The flats are parallel to the midplane A of the leg and are spaced from the midplane A by a distance approximately 30-40% of the leg diameter.

A constant diameter through hole intersecting the leg longitudinal axis and normal to midplane A is adjacent the outer end of the leg end 36 and penetrates from one outside plate 131 to the other. The outer end 140 of the leg end 36 is radiused about the axis of the flat-to-flat through hole. The outer periphery of leg end 36 consists of the arcuate distal portion of the radiused leg end 140 adjacent its intersection with the flats formed by outside plates 131. This outer periphery is abutted by the abutting surfaces 129 of the travel stops 128 of the field mateable pin sockets 118 when a leg end 36 is being aligned for engagement of its pin assemblies 100. A pair of symmetrical plate flats 132 flare outwardly from the outside plates 131 of the leg ends 36 to intersect the cylindrical portion 130 of the leg ends.

Mounted by welding in the transverse through hole of the leg end 36 is a heavy wall right circular cylindrical tube 135 having a concentric latch pin bore 136, as shown in FIG. 6. A central bore middle diaphragm 138, extending longitudinally in midplane A of the leg end, spans through the interior of the transverse tube 135 and is connected to the interior wall of tube 135. Although shown in FIG. 6 as a simple plate structure, middle diaphragm 138 alternately may be constituted as a reinforced plate structure 159 in order to better resist transverse loads in the direction of the axis of tube 135, as shown in more detail in FIG. 28.

Extending in the midplane A from the outer diameter of tube 135 to the interior of the outer shell of leg end 36 is a stiffened central diaphragm 139. Symmetrically spaced apart from and parallel to the central diaphragm 139 are two intermediate inboard longitudinal diaphragms 137 which extend outwardly from the outer cylindrical wall of the transverse tube 135 to the interior of the shell wall of the leg end. The intermediate diaphragms 137 are positioned so that when the transverse midplane of the middle diaphragm 107 of the pin 101 is at the outer end of the pin mounting bore 136, the intermediate diaphragms are substantially coplanar with the interior end diaphragm 108 of the pin.

One or more transverse bulkheads 133, 134 are positioned in the interior of leg end 36 perpendicular to the midplane A. One transverse bulkhead 133 is positioned where the outside plates 131 intersect the flaring symmetrical flats 132 of the leg end. Typically, a second transverse bulkhead 134 would be located close to the end of the flaring symmetrical flats 132 near to where the leg end 36 connects to the central leg body. The middle diaphragm 139, the intermediate diaphragms 137, and the transverse bulkheads 133, 134 are shown with plate construction, but may be stiffened plates, watertight bulkheads, or double walled shells with interior reinforcing. The transverse tube 135 may be locally thickened as required; the outside plates 131 and the intermediate diaphragms 137 may be locally reinforced and thickened at their intersections with the tube 135.

The middle diaphragm 138 of the tube 135 is provided with multiple through bolt holes in a pattern consistent with the mounting base flange of the body 61 of the hydraulic cylinder assemblies 60 which are used to latch by extending and unlatch by retracting the field mateable pin 101. The mounting bolt holes are positioned concentrically with the axis of the latch pin bore 136.

An O-ring type groove 141 is provided near the mouth of each side of the latch pin bores 136. An inflatable seal 142 is mounted in each of the grooves 141 and used to seal between the exterior of the pin 101 and the leg end 36. A pin cavity is formed between the pin mounting bore 136, the bore middle diaphragm 138, and the pin 101 and is sealed by the pin O-ring 52. This cavity is sealed so that the ball valve 57 on the access flange 55 of the pin 101 must be open in order to permit the pin to be moved freely in its pin mounting bore 136 without experiencing hydraulic lock.

Second Embodiment of the Pin Assembly

Figure 11:
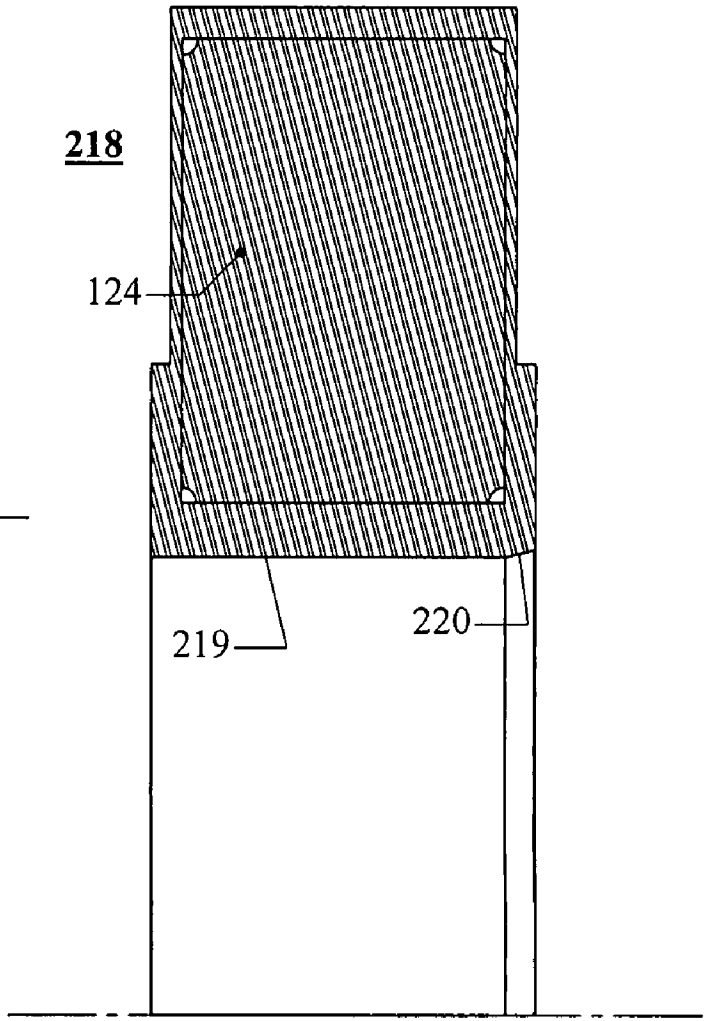
FIG. 11 is a partial transverse quarter-sectional view of a pin socket for the second embodiment of the pin shown in FIG. 10.
Figure 10:
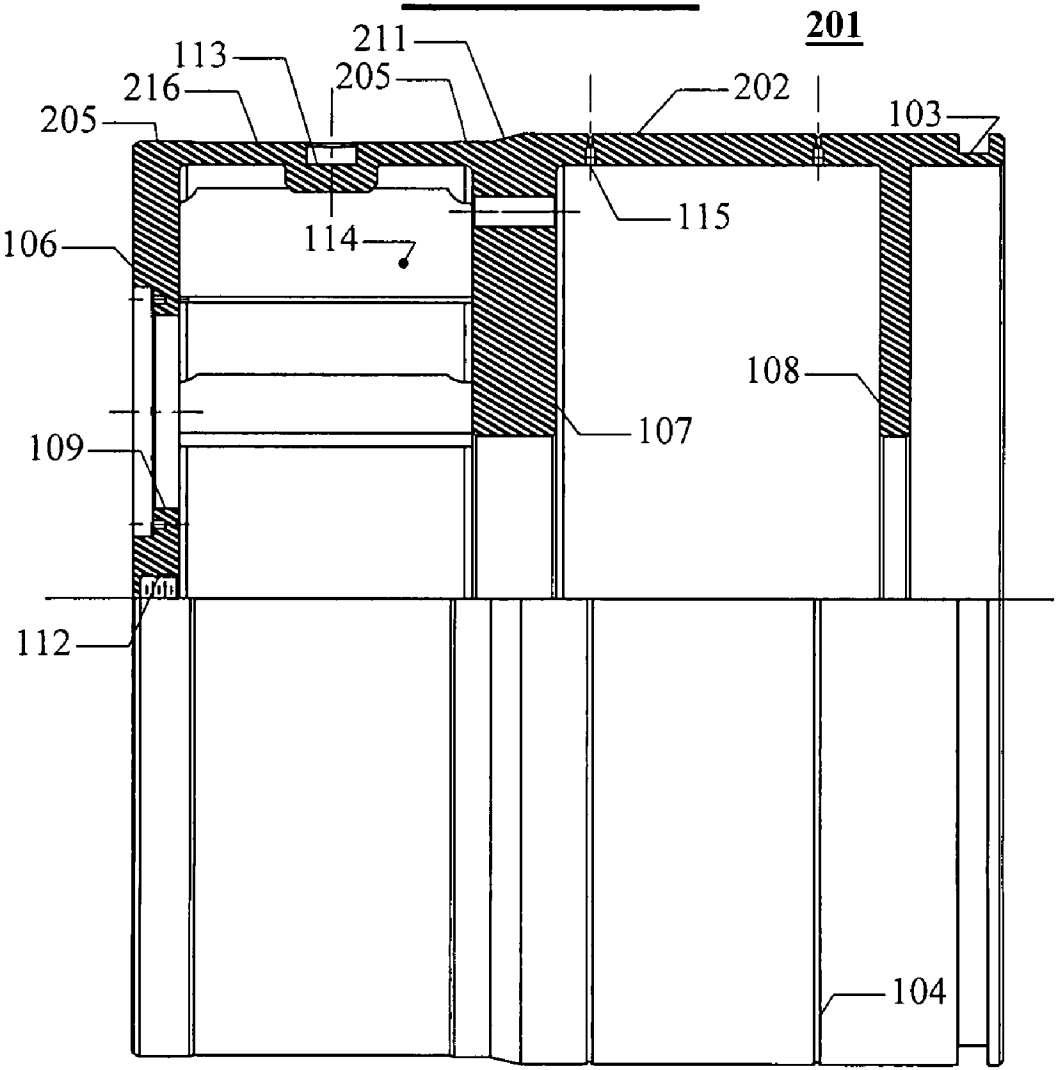
FIG. 10 is a longitudinal quarter-sectional view along the pin axis of a second embodiment of a pin.

The second embodiment 200 of the pin assembly of the present invention is shown in FIGS. 10 to 13. The pin 201 of this pin assembly 200 differs only slightly from that of pin assembly 100, but operationally functions somewhat differently in its engagement and interaction with its pin socket 218. Likewise, the pin socket 218 also only differs slightly from socket 118 of pin assembly 100, as can be seen in FIG. 11. Only differences with pin assembly 100 will be discussed herein.

Pin 201 has a cylindrical outer surface 202 which is a close sliding fit with the bore 136 of leg end 36. Adjacent the outer end of pin 201 and extending for a length of slightly less that the through thickness of the second pin socket embodiment 218 is a entry cylindrical outer surface 205 which has a slightly smaller diameter than surface 202. For instance, if the outer diameter of surface 202 is 120 inches, the outer diameter of surface 205 might be 118 inches. The central portion of the surface 205 has slightly undercut surface 216 with a diameter less than that of surface 205 for the purpose of reducing the chances of binding during insertion of pin 201 into socket 218. A short frustro-conical transition 211 is located between the entry cylindrical outer surface 205 and the main cylindrical outer surface 202.

Figure 12:
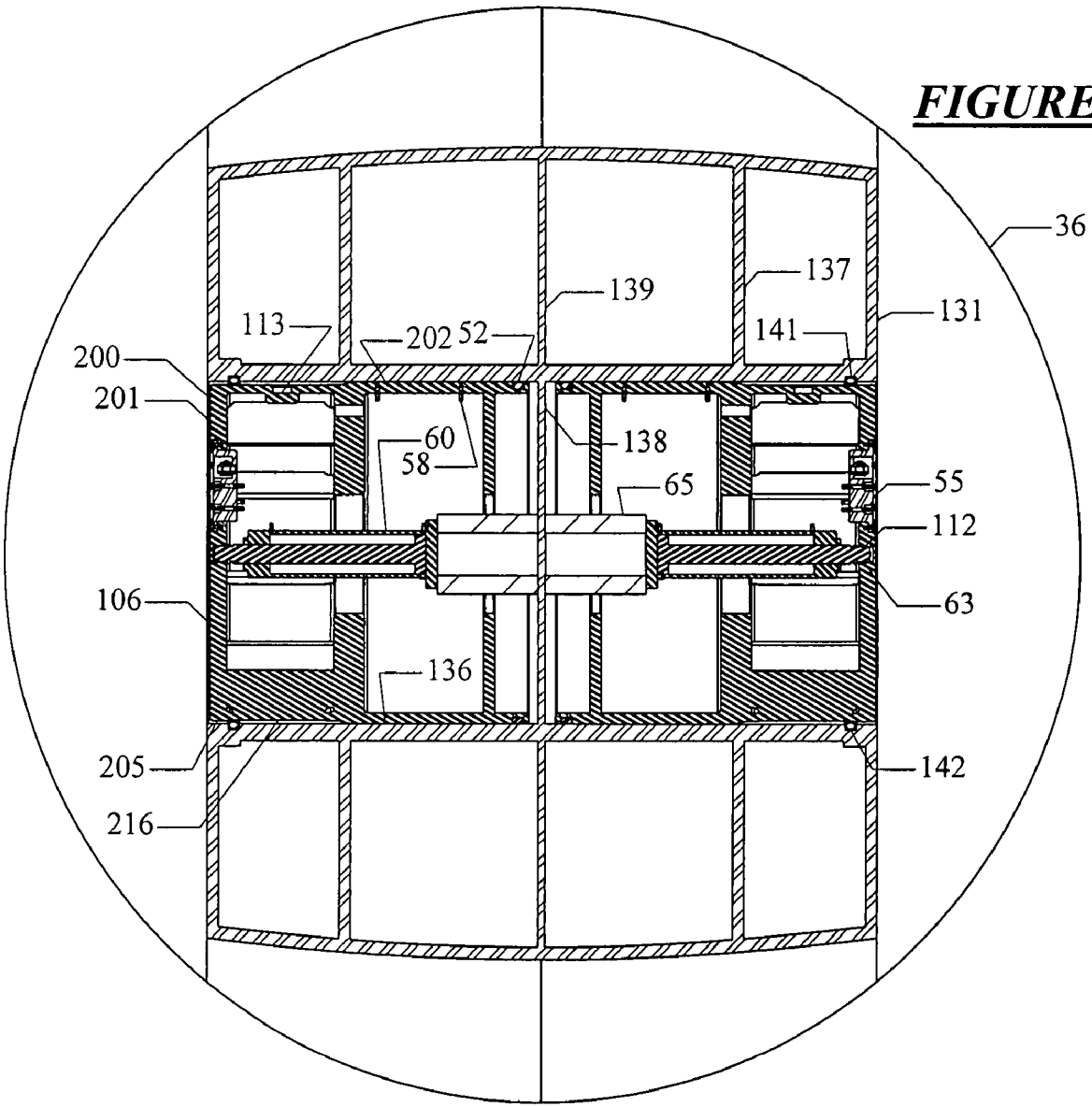
FIG. 12 is a transverse cross-section normal to the leg axis and through the pin axes for the retracted pins of FIG. 10 mounted in the leg end.

The pins 201 are shown assembled into the leg end 36 in FIG. 12. Note that inflatable seal 142 has to be expanded slightly to seal between the pin 201 and the bore 136 of the leg end 36.

The second pin socket embodiment 218, shown in FIG. 11, has a constant diameter through bore 219 except for a short frustro-conically tapered bore 220 at its pin entrance inner side. The diameter of through bore 219 is slightly more than that of the entry cylindrical outer surface 205 of the pin 201 in order to provide sufficient clearance to permit the pin to slide freely. The frustro-conical tapered bore 220 has the same angle as the frustro-conical transition section 211, while its length is approximately the thickness of the reinforced side plates on the entry side of the bore of socket 218. The diameter of the frustro-conical bore 220 at its intersection with the inner side plate of the socket 218 is only slightly larger than the outer diameter of the cylindrical surface 202 of pin 201.

Figure 13:
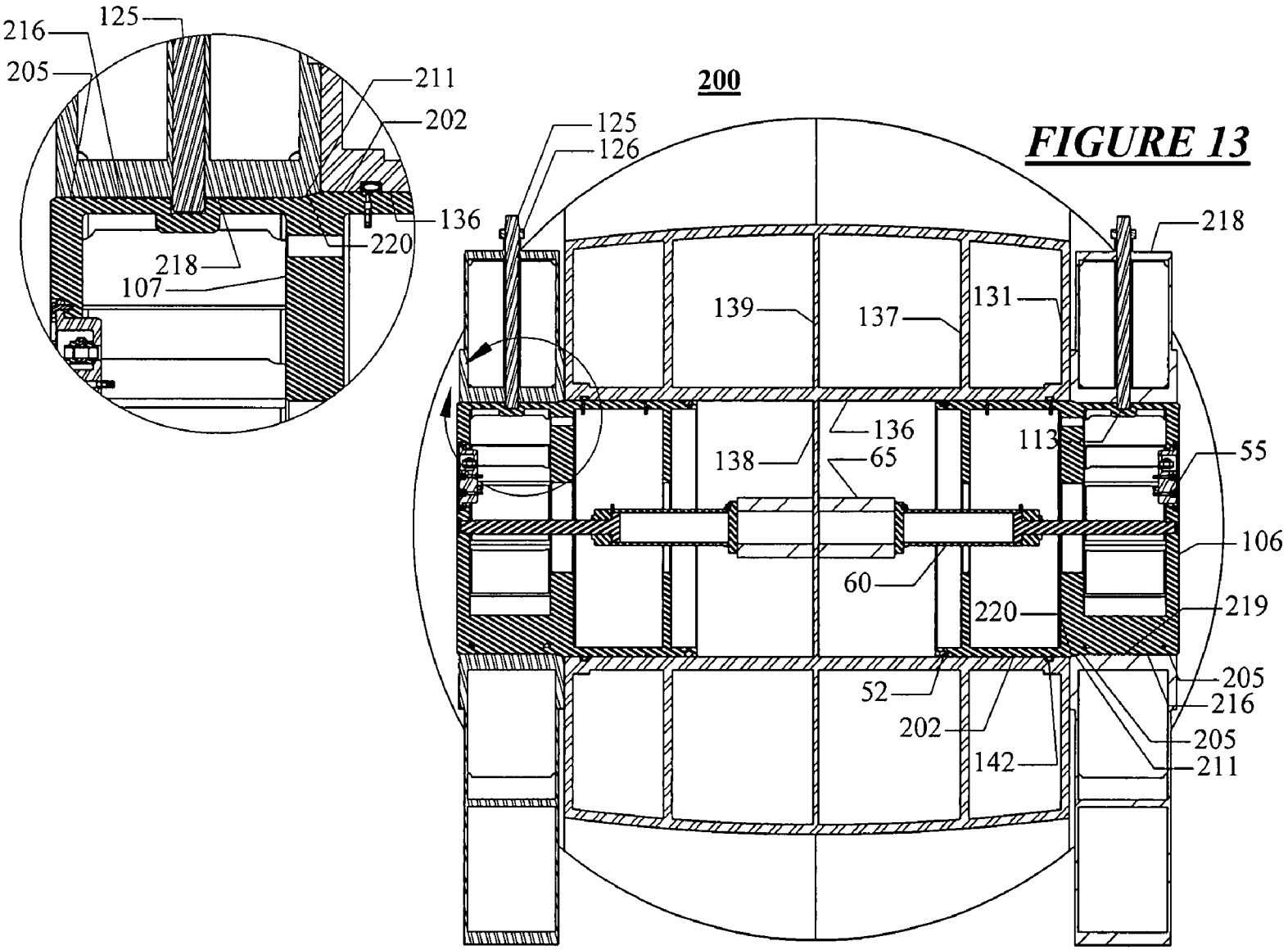
FIG. 13 is a view corresponding to FIG. 12, but showing the pins extended outwardly to engage the pin sockets (from FIG. 11) of the connection.

Referring to FIG. 13, the pins 201 are shown engaged into the sockets 218. The frustro-conical sections 211 of the pin 201 and 220 of the socket 218 abut when the pins 101 are fully inserted into the sockets. The outer end of the entry cylindrical outer surface 205 of the pin 201 is then closely fitted to the outer end of the through bore 219 of socket 218.

Third Embodiment of the Pin Assembly

The third embodiment 300 of the pin assembly of the present invention is shown in FIGS. 14 to 17. The pin 301 of this pin assembly 300 differs only slightly from that of pin assembly 100 or pin assembly 200, but operationally functions somewhat differently in its engagement and interaction with its pin socket 318. Likewise, the pin socket 318 also only differs slightly from socket 118 of pin assembly 100. Reference FIG. 14 for the construction of pin 301 and FIG. 15 for the construction of pin socket 318. Only differences with pin assembly 100 will be discussed herein.

Figure 16:
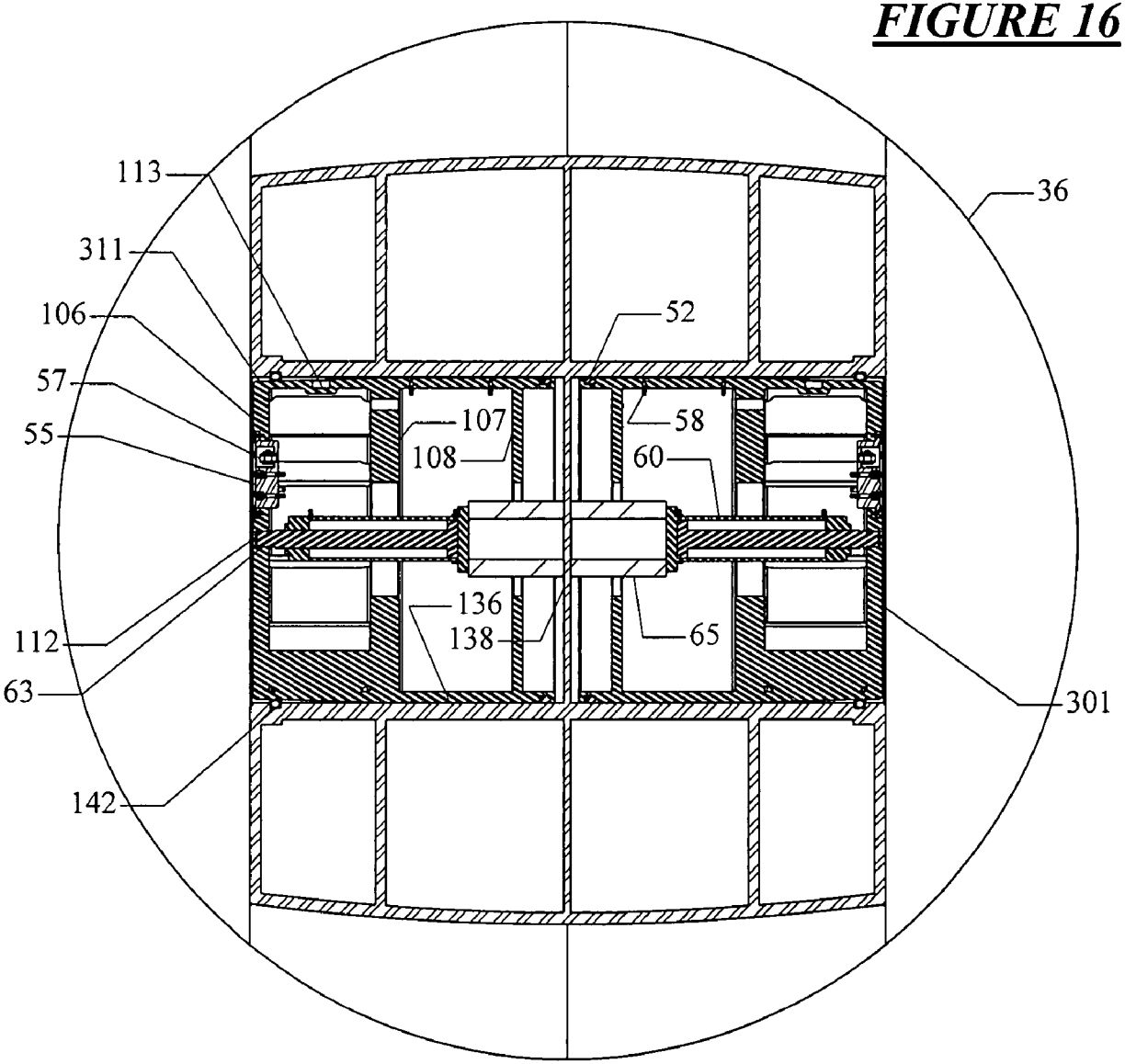
FIG. 16 is a transverse cross-section normal to the leg axis and through the pin axes for the retracted pins of FIG. 14 mounted in the leg end.

Pin 301 has a cylindrical outer surface 302, which is a close slip fit with the bore 136 of the leg end 36. Frustro-conical section 311, which is the entire outer tip of pin 301, has an external frustro-conical taper which uniformly reduces in diameter from approximately the middle of interior transverse diaphragm 107 to the outer end of pin 301 at the outer transverse diaphragm 106. The single-side angle of taper is typically 4 degrees or less. The outer tip of the pin 301 is chamfered. As seen in FIG. 16, where the pins 301 are shown housed in the leg end 36, the inflatable seals 142 have to be expanded to seal between frustro-conical sections 311 and the bore 136 when the pins 301 are retracted.

Figures 14, 15:
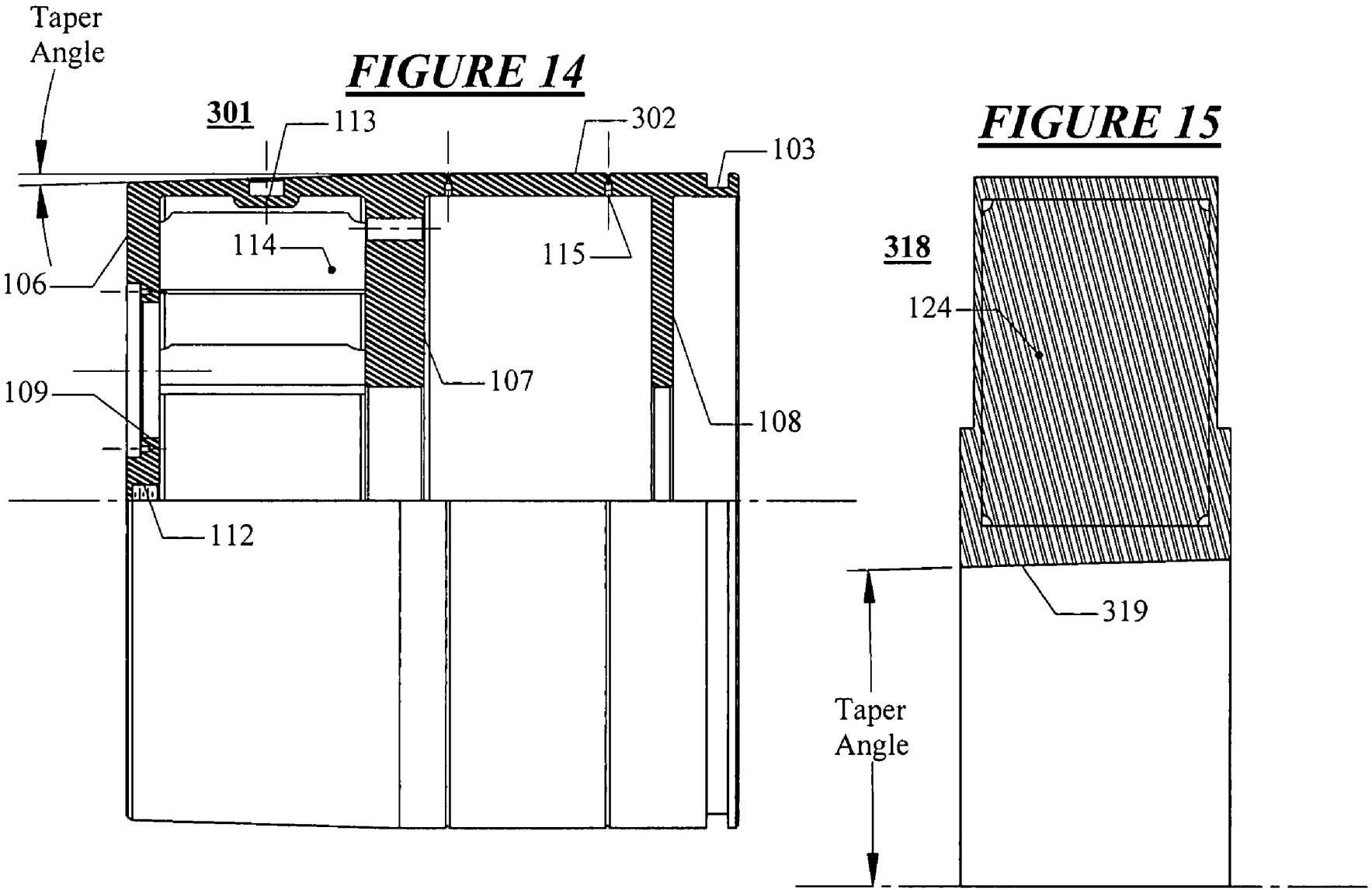
FIG. 14 is a longitudinal quarter-sectional view along the pin axis of a third embodiment of a pin.
FIG. 15 is a partial transverse quarter-sectional view of a pin socket for the third embodiment of the pin shown in FIG. 14.
Figure 17:
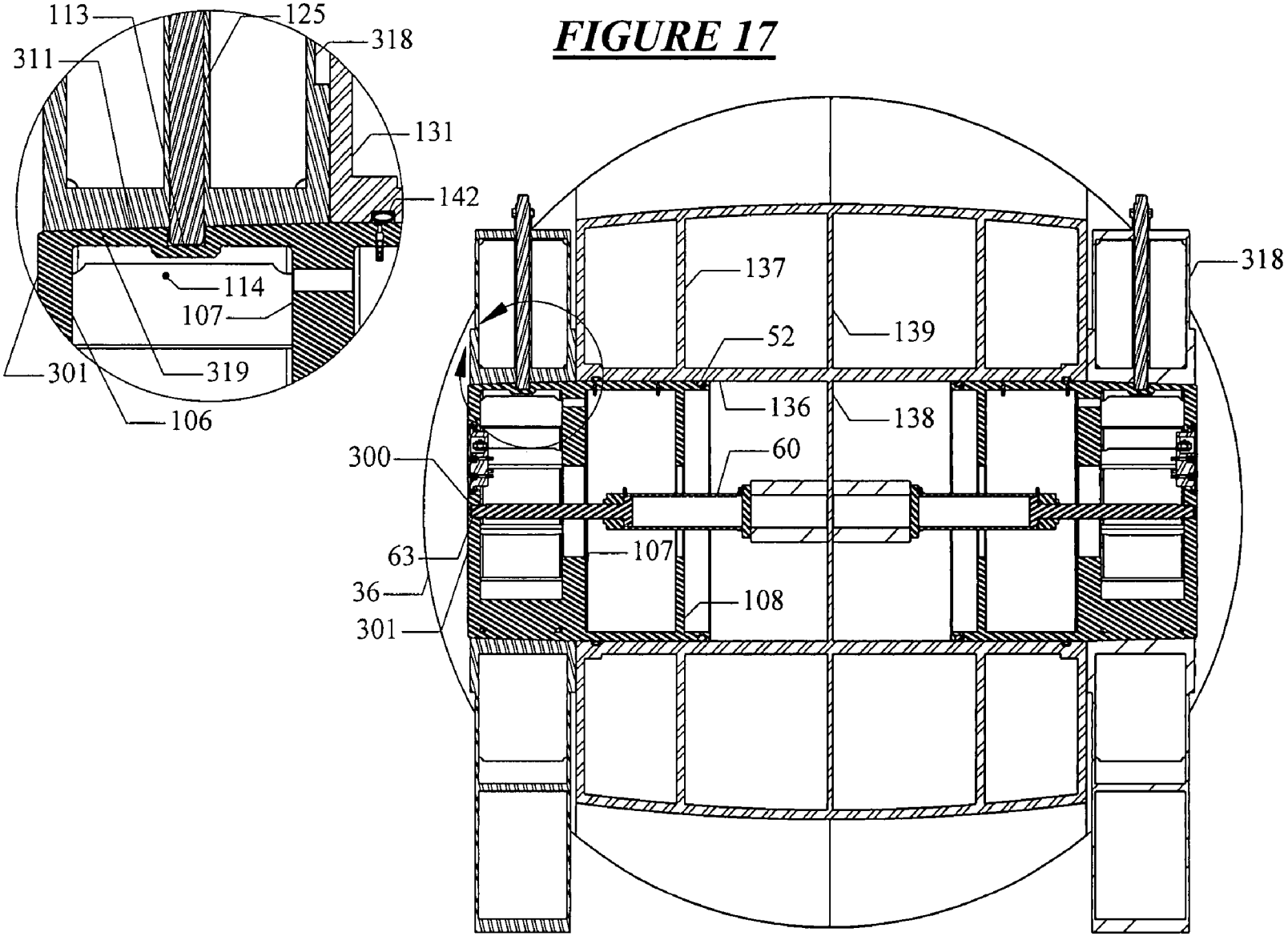
FIG. 17 is a view corresponding to FIG. 16, but showing the pins extended outwardly to engage the pin sockets (from FIG. 15) of the connection.

The third pin socket embodiment 318 differs from pin socket 118 only in having its bore uniformly tapered, as shown in FIG. 15. Frustro-conical bore 319 has the same taper angle as frustro-conical taper 311 of pin 301 and is sized so that the pin is snuggly engaged when or slightly before it reaches its cylinder travel limit during pin engagement, as is shown in FIG. 17.

Fourth Embodiment of the Pin Assembly

Figure 18:
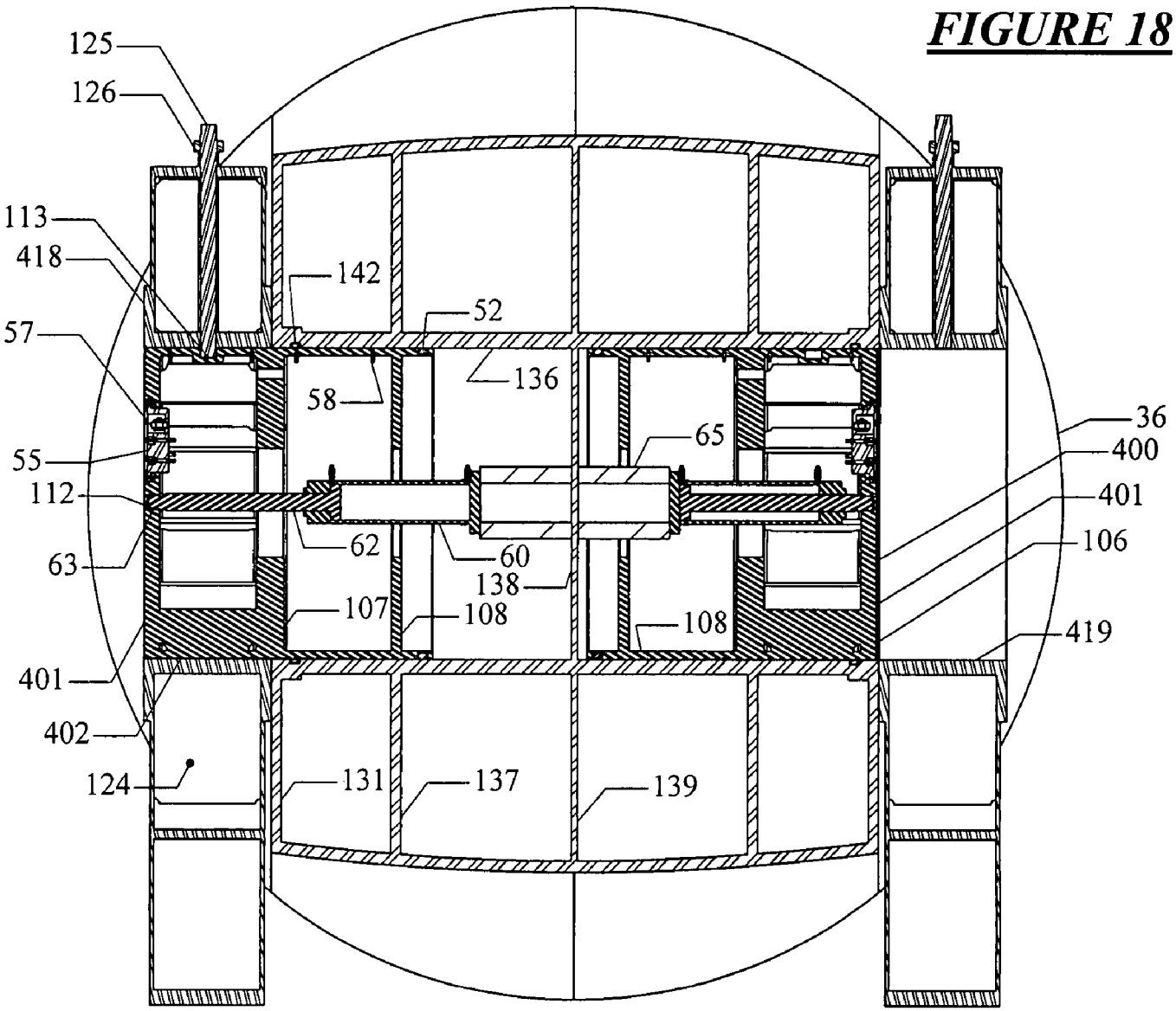
FIG. 18 is a partial longitudinal cross-sectional view of a fourth embodiment of the pin, wherein the pins are mounted in the leg end and one pin is extended and the other retracted.
Figure 24:
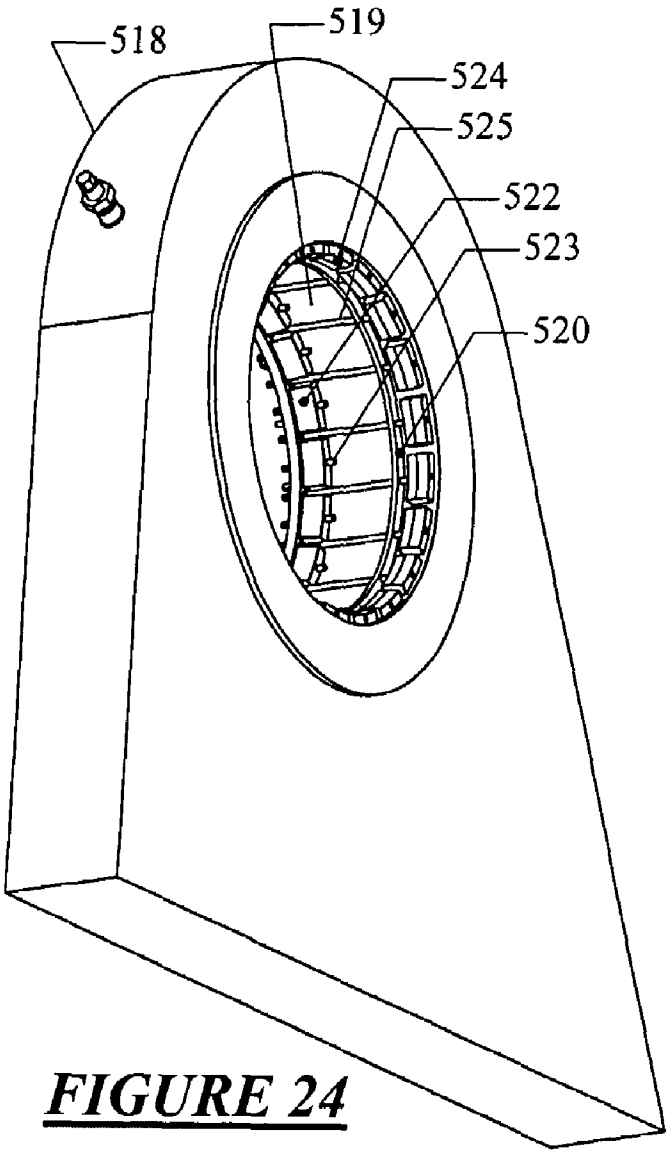
FIG. 24 is an oblique view of the pin socket assembly of FIG. 19.
Figure 19:
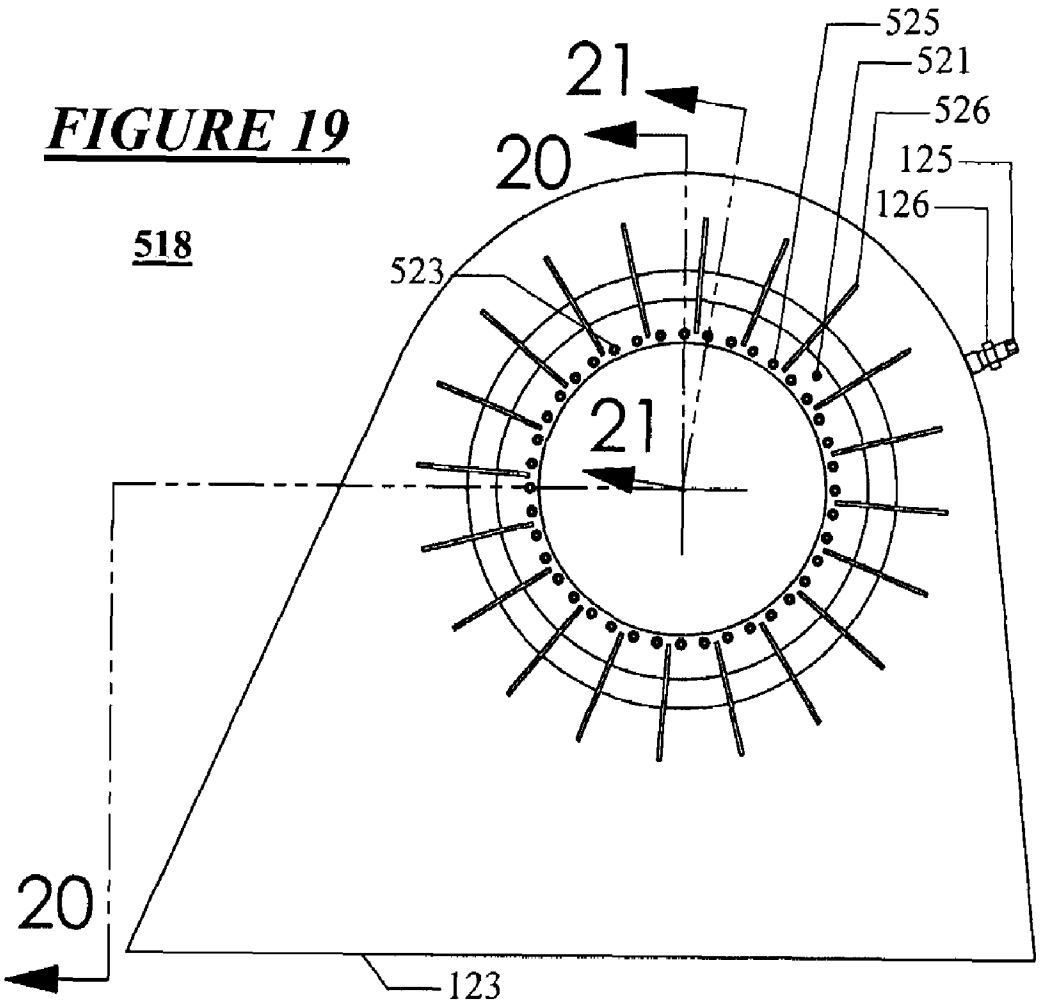
FIG. 19 is a profile view of a fifth embodiment of a pin socket taken from obverse to the pin entry side.
Figure 21:
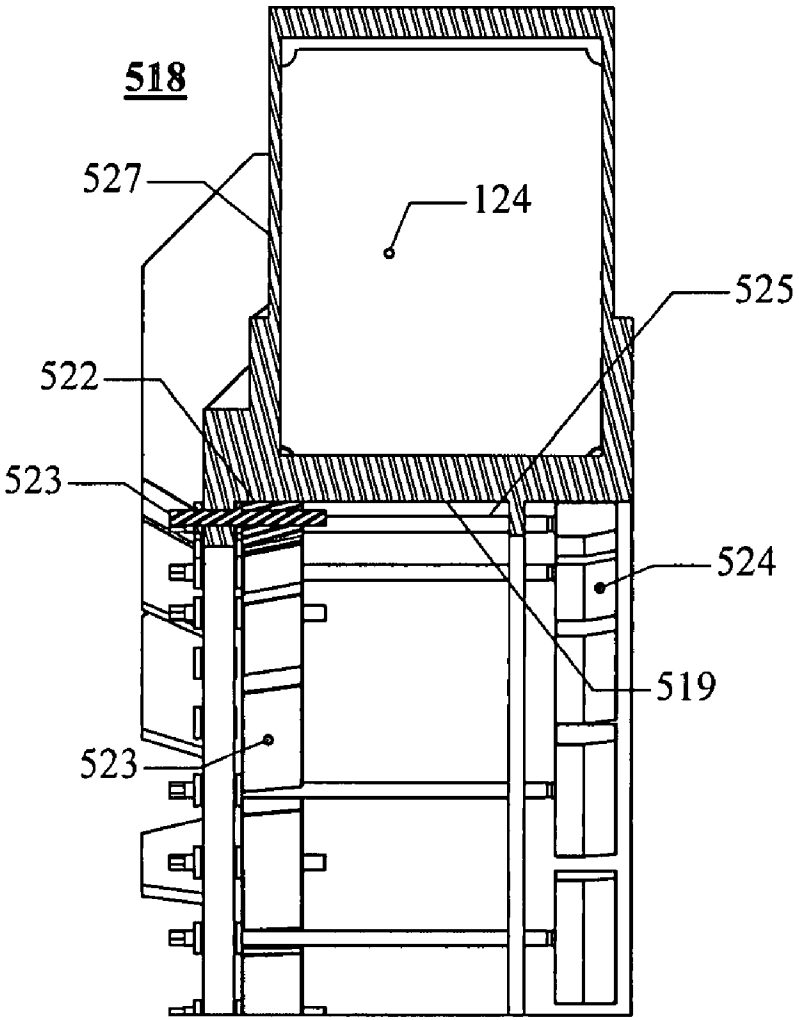
FIG. 21 is a partial cross-sectional view taken along line 21-21 of FIG. 19.
Figure 20:
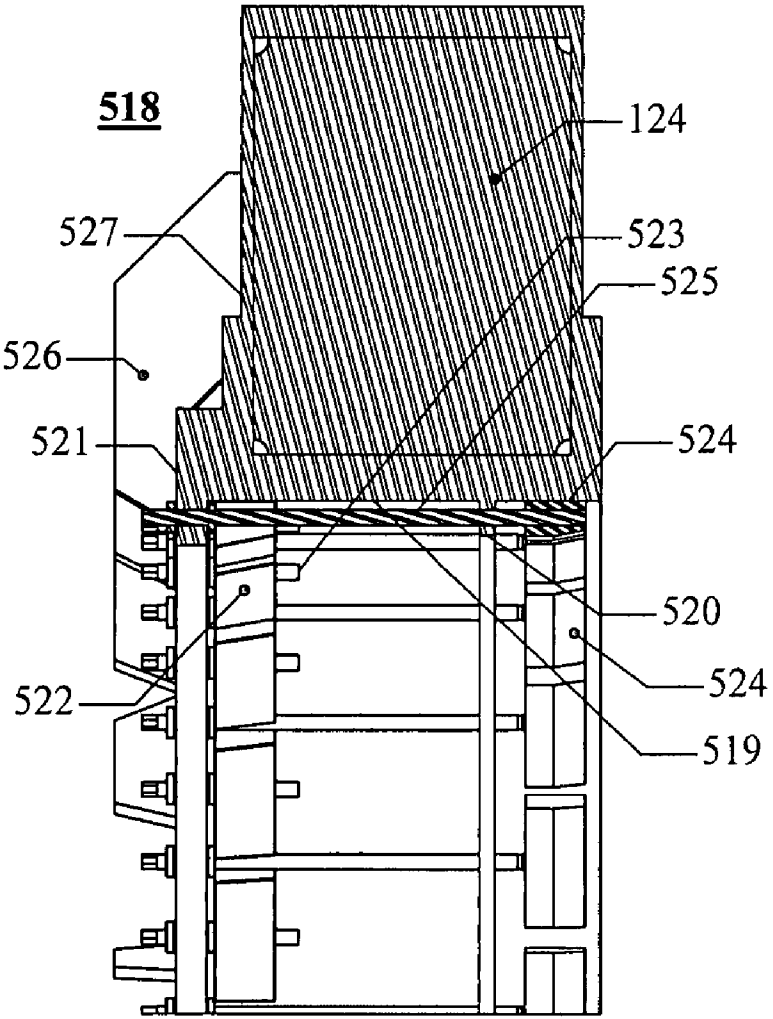
FIG. 20 is a partial cross-sectional view taken along line 20-20 of FIG. 19.

The fourth embodiment 400 of the pin assembly of the present invention is shown in FIG. 18. The pin 401 of this pin assembly 400 differs only slightly from that of pin assembly 100 or pin assemblies 200 and 300, but operationally functions somewhat differently in its connection to and interaction with its pin socket 418. Likewise, the pin socket 418 also only differs slightly from socket 118 of pin assembly 100. Reference FIG. 18 for the construction of pin 401 and pin socket 418. Only differences with pin assembly 100 will be discussed herein.

The basic differences are that the pin 401 has a constant diameter external cylindrical surface section 402 throughout its length, and the pin socket 418 has a constant diameter through bore 419. The exterior surface 402 of pin 401 is a close slip fit to the bore 419 of the pin socket 418. FIG. 18 shows the lefthand pin 401 engaged in its socket 418 and the righthand pin still retracted in the leg end 36.

Fifth Embodiment of the Pin Assembly

The fifth embodiment 500 of the pin assembly of the present invention is shown in FIGS. 19 to 25 and 33. The fifth pin embodiment 501 of this pin assembly 500 differs only slightly from that of pin assemblies 100, 200, 300 and 400, but operationally functions differently in its engagement and interaction with its pin socket 518. For this fifth embodiment 500, the pin socket 518 differs significantly from socket 118 of pin assembly 100. Reference FIGS. 19 to 21, 25, and 33 for the construction of pin socket 518. Only differences with pin assembly 100 will be discussed herein.

Figure 23:
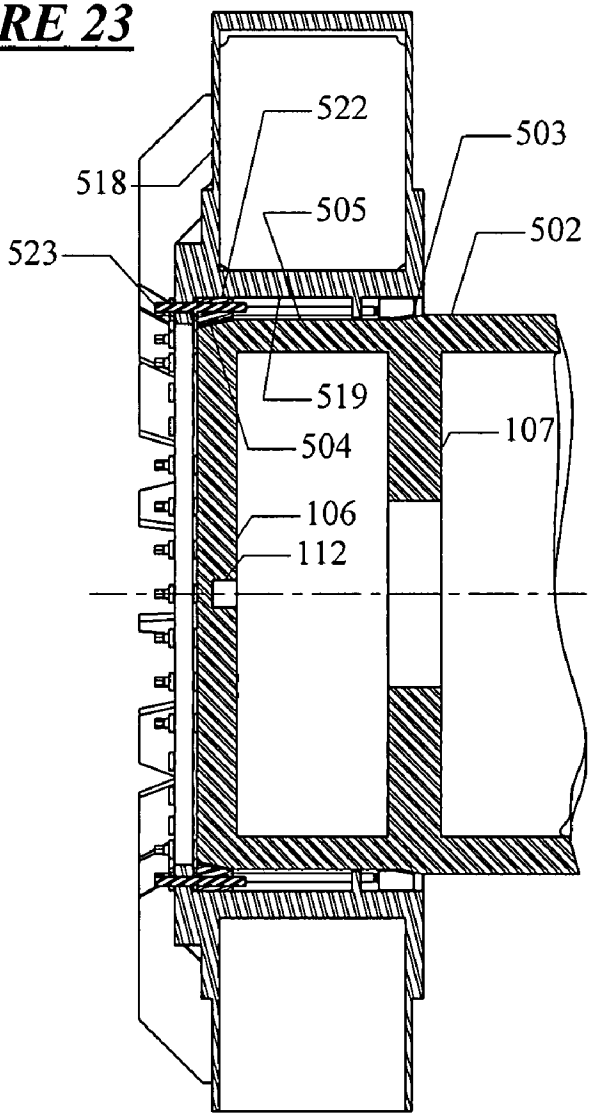
FIG. 23 is a partial cross-sectional view corresponding to FIG. 21, but with the fifth embodiment of a pin extended in to the bore of the pin socket.
Figure 22:
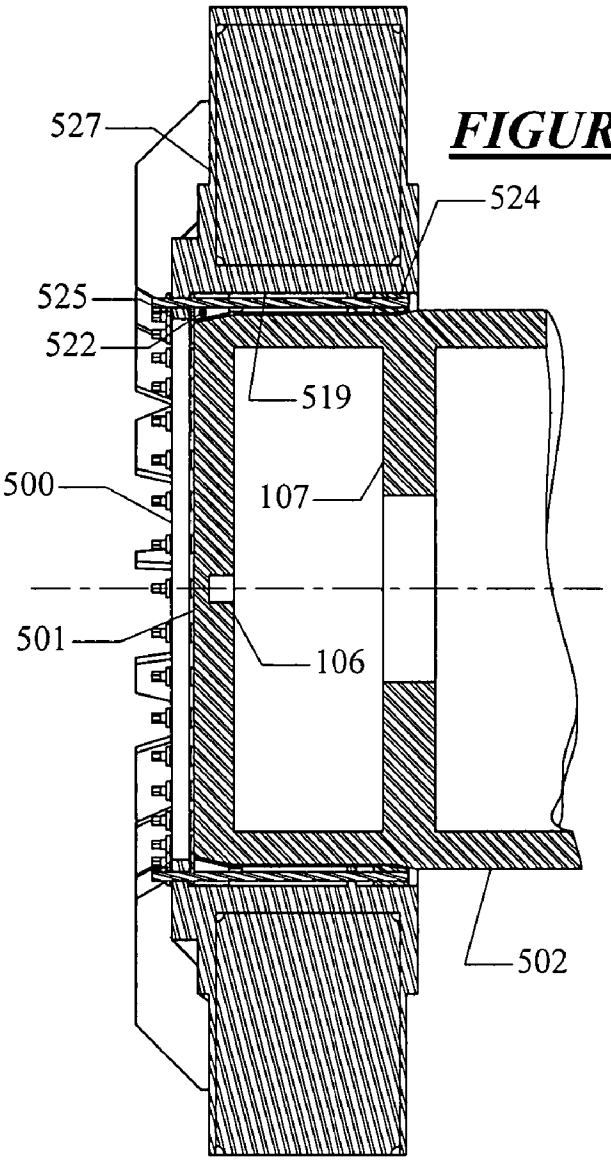
FIG. 22 is a partial cross-sectional view corresponding to FIG. 20, but with a fifth embodiment of a pin extended in to the bore of the pin socket.
Figure 25:
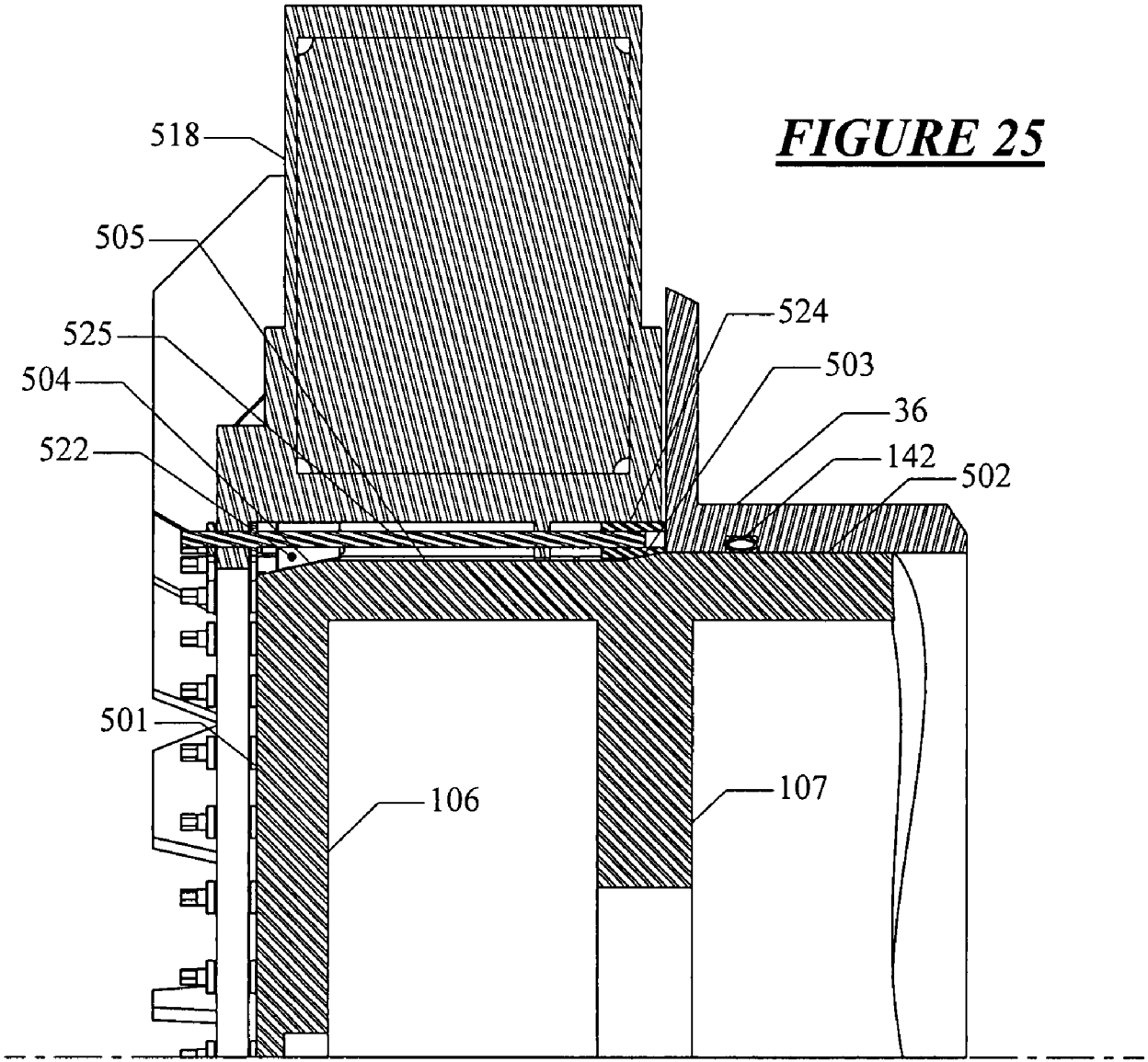
FIG. 25 is a partial cross-sectional view corresponding to FIG. 22, but with the wedges of the socket tightened against the conical surfaces of the pin.

The basic difference from the other embodiments for pin 501 is that the pin, seen in simplified form in FIGS. 22 and 23, has two spaced-apart frustro-conical sections on its outer surface. The main section of the pin has cylindrical outer surface 502 which is a close slip fit into the bore 136 of leg end 36. Cylindrical outer surface 502 extends from the interior end of the pin 501 to approximately the middle of the thickness of the intermediate transverse diaphragm 107.

Starting at the outer end of cylindrical surface 502 at approximately the middle of the thickness of intermediate transverse diaphragm 107 and moving toward the outer end of pin 501, the diameter is reduced from that of section 502 in intermediate frustro-conical transition section 503. Frustro-conical intermediate section 503 is adjoined at its outer end by outwardly extending intermediate cylindrical surface 505. At the outer tip of pin 501, outer frustro-conical surface 504 further reduces the diameter. All of the cylindrical and frustro-conical external surfaces of pin 501 are concentric.

The lengths of the frustro-conical sections 503 and 504 are slightly more than the contact bearing lengths which will be established with pin 501 by the set of first wedges 522 and set of second wedges 524 of the pin socket 518 when the pin is engaged. The single-side taper angles of the frustro-conical sections are typically 4 degrees or less, and the taper angles of surfaces 503 and 504 are typically the same. As before, the inflatable seal 142 will have to be expanded to seal between retracted pin 501 and leg end 36.

Pin socket 518 has a straight cylindrical bore 519 which is interrupted by a radially inwardly projecting transverse annular ring intermediate guide 520 intermediate to its length. At the outer end of the bore 519 of socket 518, an integral radially outwardly projecting annular spacer ring having an inner diameter equal to or greater than bore 519 is lapped onto and welded to the exterior of the outside end side plate 527. The spacer ring mounts a welded-on annular ring reaction plate 521 on its outer side. The bore of reaction plate 521 is less than that of bore 519, but slightly more than the intermediate cylindrical surface 505 of the pin 501. Multiple through holes parallel to and equally offset from the axis of bore 519 on a regular bolt hole circle pattern coaxially penetrate both reaction plate 521 and intermediate guide 520. Plate radial braces 526 serve to further reinforce and stiffen the attachment of the spacer plate and the reaction plate 521 to the outside side plate 527.

Figure 33:
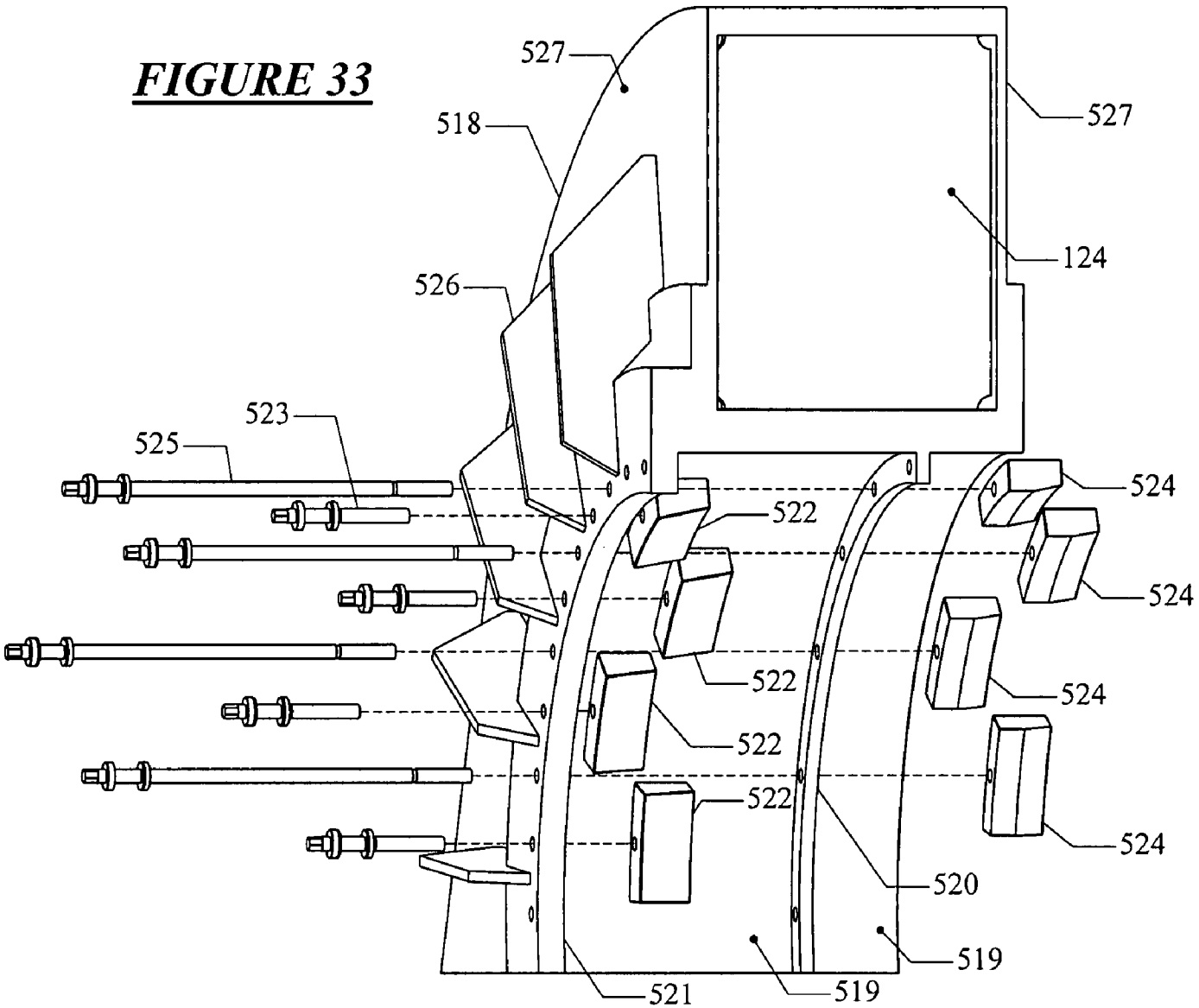
FIG. 33 is an oblique exploded partial cross-sectional view of the fifth embodiment pin socket showing how the wedges and their actuator screws are positioned.

Referring to FIG. 33, an exploded partial view of the socket 518 shows the interrelationship of the socket and the first wedge 522 with its first actuator screw 523 and of second wedge 524 with its second actuator screw 525. Positioned in a regular circumferential array at the outside end inner surface of bore 519 are multiple first wedges 522. First wedges 522 are short arcuate segments of a ring having a right circular cylindrical outer face, transverse end faces, and frustro-conical inner faces which are a close fit to the outer frustro-conical surface 504 of pin 501. The diameter of the outer cylindrical face of first wedges 522 is the same as that of cylindrical bore 519 of socket 518, so that the installed first wedges bear against the bore 519. The arc length of first wedges 522 is slightly less than the arc length between the outer holes in a set of three adjacent bolt holes in the ring reaction plate 521 minus the diameter of a second wedge actuator screw 525. Accordingly, when the first wedges 522 are mounted in the bore 519 of the socket 518, there are gaps between the wedges.

A drilled and tapped through hole is centrally positioned on the radial midplane of the first wedge 522. First wedge actuator screw 523 has, from its outer end, a hex head for wrench engagement, an outwardly extending transverse flange, a continuation of its shank, a second outwardly extending transverse flange spaced apart from the first by slightly more than the thickness of reaction plate 521, and at its distal end its helically threaded shank. The threads of a screw 523 are engaged with the female threads of each first wedge 522. Every other hole of reaction plate 521 mounts a first wedge actuator screw 523 where the screws project towards the entry end of bore 519. The shaft of each screw 523 between its upset flanges is engaged in its mounting hole in reaction plate 521 so that its flanges can resist inward or outward reactions by bearing on the transverse faces of the ring reaction plate when the screw is torqued. Turning the first screw 523 in a first direction advances the first wedge 522 toward the leg end 36, while turning the screw in its opposed second direction withdraws the first wedge from the leg end. Disk shaped plain bearings can be provided between the screw flanges and the reaction plate 521 to reduce the friction there. These structural features permit the first wedge actuator screws 523 to serve as screw jacks for the first wedges 522.

The second wedges 524 are similar in construction to the first wedges 522, but they are supported on second wedge actuator screws 525 and their frustro-conical inner faces are a close fit to the intermediate frustro-conical transition surface 503 of pin 501. The cylindrical outer surfaces of the second wedges 524 are positioned against the bore 519 spaced apart from but adjacent the inner or entry end of the pin socket 518. The second wedge actuator screws 525 are longer than the screws 523, but otherwise are of the same double-flanged construction. The screws 525 are inserted into the holes in reaction plate 521 between the screws 523 and extend also through the holes in the intermediate guide 520 to where they are threadedly engaged with the tapped holes of the second wedges 523.

The second wedge actuator screws 525 extend through the gaps between adjacent first wedges 522, so that the radial midplanes of the first 522 and second wedges 524 alternate when seen from an axial direction. Turning the second screw 525 in a first direction-advances the second wedge 524 toward the leg end 36, while turning the screw in its opposed second direction withdraws the second wedge from the leg end. The weight of the second wedges 524 is largely supported by reactions of the second wedge actuator screws 525 with the holes in the intermediate guide plate 520. These structural features permit the second wedge actuator screws 525 to serve as screw jacks for the second wedges 524.

When the pin 501 is fully extended into the bore 519 of pin socket 518, it has its frustro-conical surfaces 503 and 504 positioned inside of and radially slightly inwardly of the retracted wedges 522 and 524 prior to tightening of the connection. Additionally, the frustro-conical surfaces of the first and second wedges 522 and 524, respectively, are axially slightly spaced apart from their respective comatable frustro-conical surfaces 504 and 503. This condition is shown in FIGS. 22 and 23.

Advancing the first and second wedges 522 and 524 towards the leg end 36 by means of the screws 523 and 525, respectively, causes the wedges to encounter and firmly engage against the frustro-conical surfaces 504 and 503, respectively. This tightening eliminates radial play in the made-up connection. Further, since the wedges 522 and 524 are segmented, advancing the wedges until refusal can treat an off-center positioning of the pin 501. In such a case, the wedges will travel different distances to tighten between the bore 519 and the eccentric pin 501, but the eccentric joint will still be stabilized by being firmly wedged by both sets of wedges. The screws 523 and 525 can be rotated in reverse from their rotation for tightening the wedges 522 and 524 in order to loosen the connection 500 for pin retraction.

Sixth Embodiment of the Pin Assembly

Figure 26:
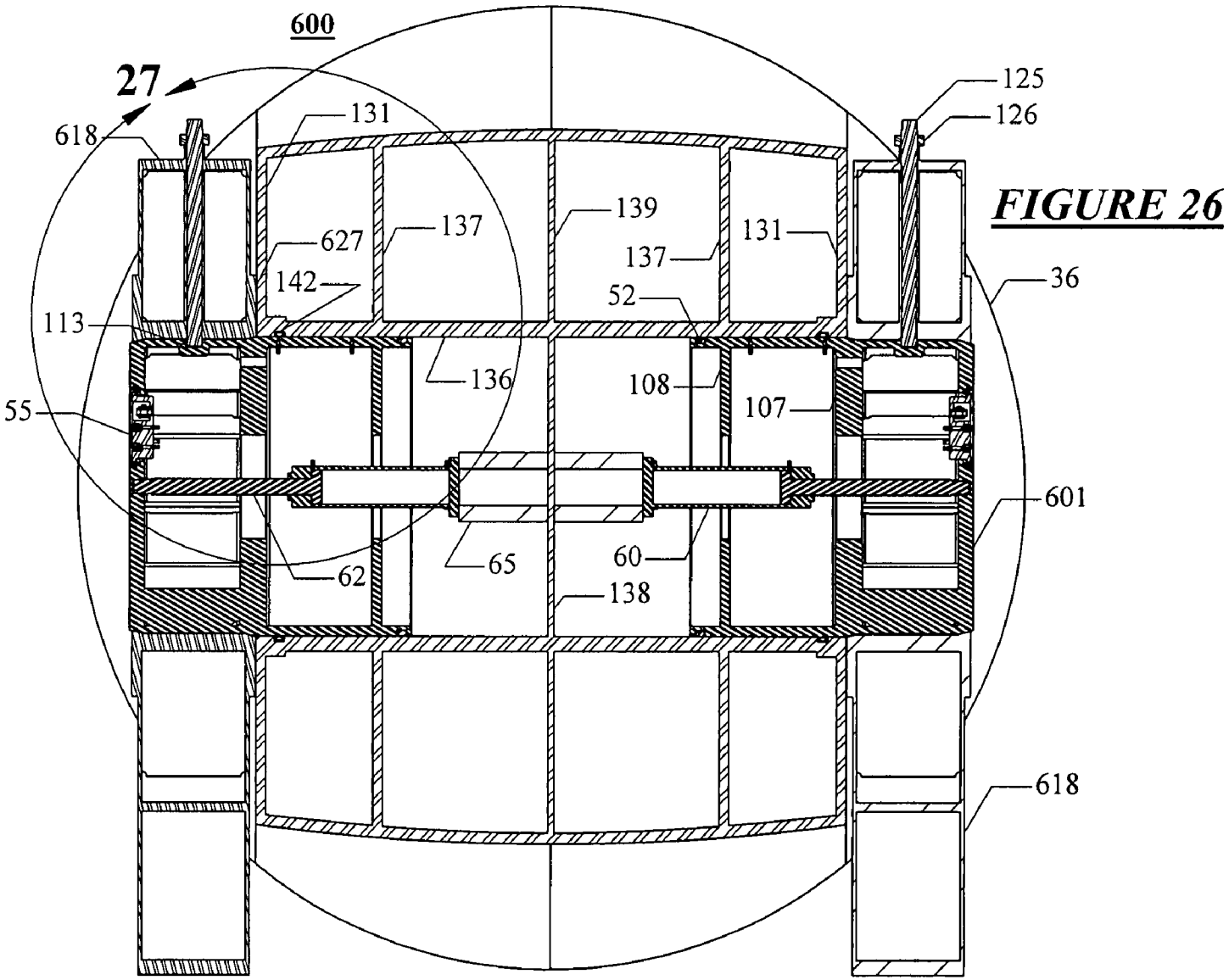
FIG. 26 is a cross-sectional view through the engaged pins and sockets of the sixth pin and socket embodiment of the present invention.
Figure 27:
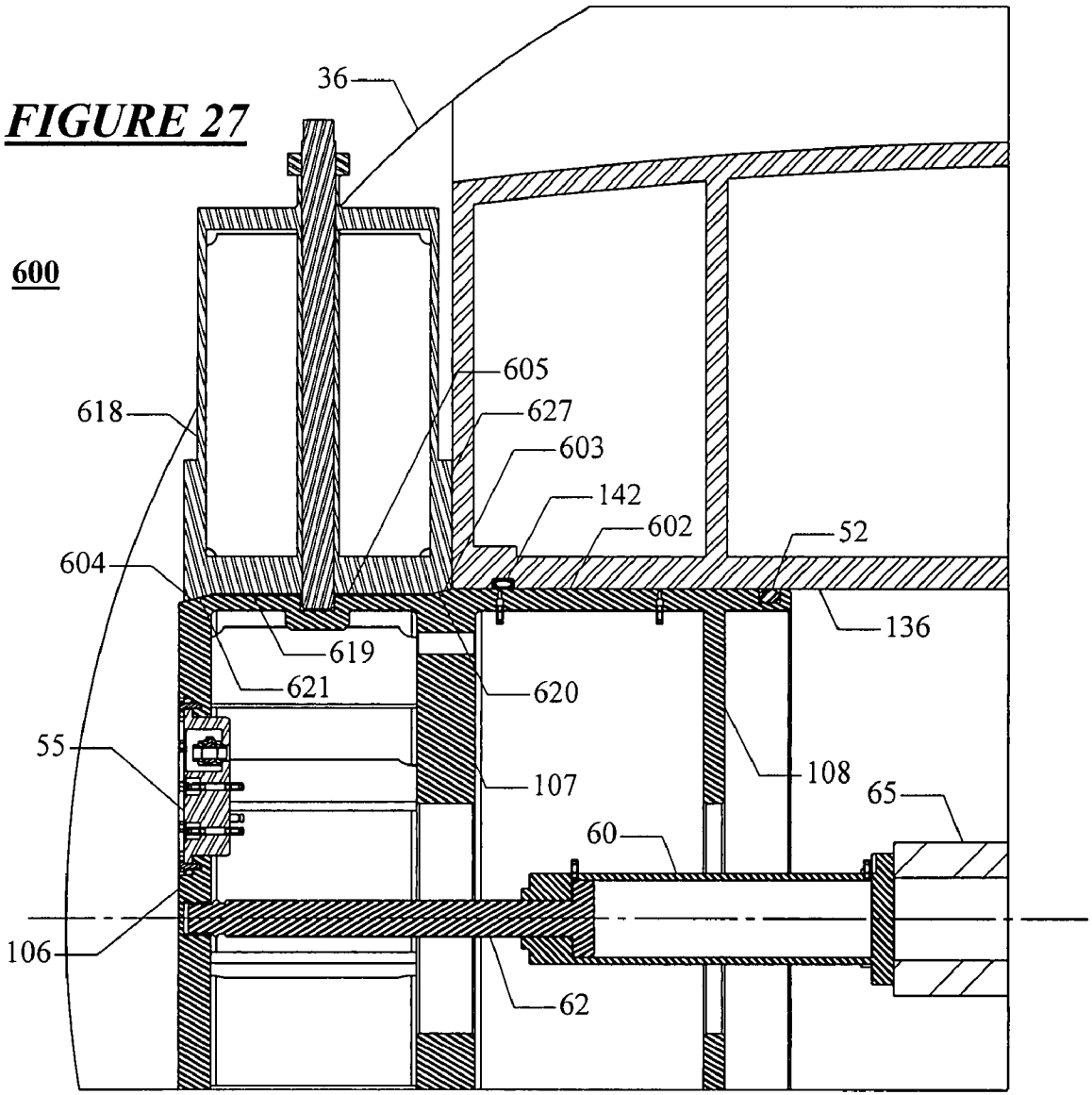
FIG. 27 is an enlargement of the pin and socket connection of FIG. 26, taken within the circle 27 of FIG. 26.

The sixth embodiment 600 of the pin assembly of the present invention is shown in FIGS. 26 and 27. The pin 601 of this pin assembly 600 differs only slightly from that of pin assemblies 100 and, particularly, 500, but operationally functions differently in its engagement and interaction with its pin socket 618. Likewise, the pin socket 618 also differs from socket 118 of pin assembly 100. Only differences with pin assembly 100 will be discussed herein.

Pin 601 has a right circular cylindrical outer surface 602 which extends for slightly more than half of its length from its open inner end, which is on the righthand side of FIG. 27, to approximately midthickness of the intermediate transverse diaphragm 107 of the pin. Cylindrical surface 602 is a close sliding fit with the bore 136 of leg end 36. Pin 601, seen in FIGS. 26 and 27, also has two frustro-conical sections on its outer surface. Starting at approximately the middle of the thickness of intermediate transverse diaphragm 107 and moving toward the outer end of pin 601, the diameter is reduced from that of cylindrical section 602 at intermediate frustro-conical transition 603. The axial length of frustro-conical section 603 is slightly more than the thickness of the interior side reinforced side plate 627 of the socket embodiment 618. Frustro-conical intermediate section 603 is adjoined at its outer end, on the lefthand side of FIGS. 26 and 27, by outwardly extending intermediate cylindrical surface 605.

Near the outer tip of pin 601 and starting at the outer end of cylindrical surface 605, outer frustro-conical surface 604 further reduces the diameter. The lengths of the frustro-conical sections 603 and 604 are slightly more than the contact bearing lengths which will be established by pin 601 with their corresponding and comatable frustro-conical surfaces 620 and 621 of the pin socket 618 when the pin is engaged. The taper angles of frustro-conical surfaces 603 and 604 are the same. As before, the inflatable seal 142 will have to be expanded to seal between retracted pin 501 and leg end 36.

The sixth pin socket embodiment 618, shown in FIGS. 26 and 27, has a constant diameter straight bore 619 except for a short frustro-conically tapered bore 620 at its pin entrance side and a second short frustro-conical bore 621 at its pin exit side. The diameter of through bore 619 is slightly more than that of the entry cylindrical outer surface 605 of the pin 601 in order to provide sufficient clearance to permit the pin 601 to slide freely in the bore. The frustro-conical tapered bore 620 has the same angle as the frustro-conical transition section 603, while its length is approximately the thickness of the reinforced side plates 627 on the entry (interior) side of the bore of socket 618.

The diameter of frustro-conical transition section 620 at its pin entry end is the same as or slightly larger than the bore 136 of the leg end 36. The taper angle of frustro-conical bore 621 is the same as surface 604 of pin 601, and the axial length of the bore 621 is approximately the thickness of the outer side plate of the socket 618. The tolerances for the machining of the pin 601 and the socket 618 are such that pin frustro-conical surface 604 abuts or very nearly abuts socket frustro-conical surface 621 when pin frustro-conical surface 603 fully abuts socket frustro-conical surface 620.

Thus, the only radial gaps in the connection of pin 601 to socket 618 of embodiment 600 are between pin 601 and its housing bore 136 in the leg end 36 and, possibly, in the region of frustro-conical pin surface 604 and socket surface 621. Both gaps are maintained small due to the selection of operational clearances and careful monitoring of machining tolerances. Referring to FIG. 26, the pins 601 are shown engaged into the sockets 618. The frustro-conical sections 603 and 620 respectively of the pin 601 and the socket 618 abut and frustro-conical sections 604 and 621 respectively of the pin and socket respectively abut or nearly abut when the pins are fully inserted into the sockets.

Alternate Bore Middle Diaphragm Assembly for Leg End 36

FIG. 28 shows an alternate bore middle diaphragm assembly 159 for the bore middle diaphragm 138 shown elsewhere in FIGS. 1-27 and described above. For simplicity, the bore middle diaphragm 138 for leg end 36 is shown as a single thick plate without reinforcement for all of the preceding figures describing the different pin embodiments 100, 200, 300, 400, 500, and 600. In general, however, a reinforced alternate bore middle diaphragm 159 will be required, due to the likelihood of the thrust and retraction loads exerted by the hydraulic cylinders 60 being excessive for a single plate diaphragm of reasonable thickness. As shown in FIG. 28, the alternate diaphragm 159 consists of two spaced apart parallel circular disk outer plates 160 separated by welded-in rectangular radial plate stiffeners 161 which have their corners nipped to avoid triaxial stresses at three plane plate intersections.

Although not shown in FIG. 28, a right circular cylindrical plate ring may be positioned in the center of the spaced apart plates 160 in order to provide additional reinforcement to the diaphragm 159 for the loadings imposed by the cylinders 60 and transmitted by the spacer blocks 65. As a substitution for the diaphragm 138, the outer periphery of the disks 160 is welded into the pin mounting bore 136 of pin housing tube 135 when the transverse midplane of alternate diaphragm 159 is placed on Midplane A of the leg end 36 shown in FIG. 6.

A pipe vent line 164 is located on Midplane A of the leg end 36 and connects to the upper end of the leg 26 or 43 at its first end and has a teed vent line branch 165 projecting perpendicularly through each of the outer plates 160 of the alternative diaphragm 159. On the outer end of each vent line branch 165 is located a two-position ball valve 166 controlled by a selectably operable rotary actuator 167. The control lines for the rotary actuator are not shown for clarity, but extend to the exterior of the leg end 36 in which the diaphragm 159 is mounted so that the valve 166 can be remotely controlled.

A pin cavity formed between the pin mounting bore 136, the alternate bore middle diaphragm 159, and the pin O-ring 52 seals the pin. When it is desired to move the pin assembly operated by the hydraulic cylinder 60, the ball valve 166 is opened so that the pressure inside the pin cavity can be equalized with the pressure outside of the pin cavity, to avoid hydraulic lock and permit pin movement. Pipe vent line 164 and its-valves 166 are able to perform the same function as the ball valve 57 on the access flange assembly 55 of the pin. Provision of this second means of providing flow communication with the pin cavity offers operational convenience and redundancy.

A second pipe serves as a control and lubrication line conduit 170 from the leg end 36 of the leg 26 or 43 to the middle diaphragm 159. Control and lubrication lines 175 from the deck 11 and/or leg end 36 extend down through conduit 170 to the diaphragm 159. Conduit 170 intersects two branching tee lines, the control and lubrication conduit first branch 171 and second branch 172, extending perpendicularly through the outer plates 160 of the diaphragm 159 into the pin cavities on either sides.

Control and lubrication flexible hose lines 176 from the quick connects 58 on the interior of access flange 55 of the pin extend to the conduit first branch 171 on either side and there connect to the corresponding control and lubrication lines 175 from the leg end 36. The connections can be made with simple tee connections, with shuttle valves, or with more involved valved connections so that applying pressure to one set of lines (either 175 or 176) permits-overriding control from the other set of lines.

Figures 35, 36:
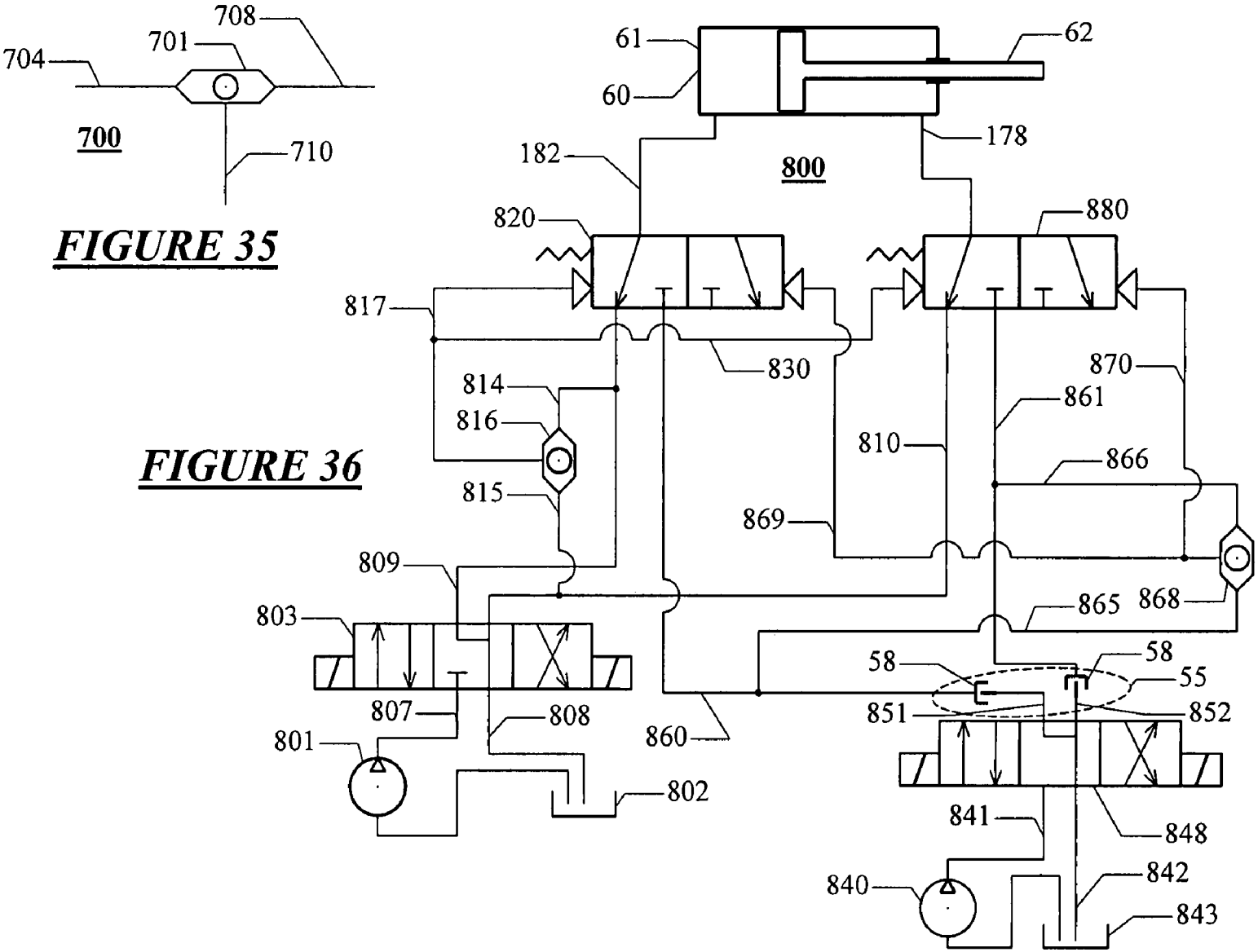
FIG. 35 is a hydraulic schematic diagram showing how the grease lines supplying the lubricant distribution grooves can be arranged with a shuttle valve in order to permit supply from more than one source.
FIG. 36 is a hydraulic schematic diagram showing a flow circuit that permits control of the hydraulic cylinder assembly from more than one source.

FIGS. 35 and 36 illustrate means for operating the grease injection and the hydraulic cylinder 60 from two separate locations. The outlet lines 177 from the interconnected lines 175 and 176 pass through the conduit second branch 172 and thence to the cylinder 60 and by flexible hose to the quick connects 58 on the grease injection ports 115 in the pin. As shown in FIG. 28, the cylinder retract line 178 and the cylinder extend line 182 are included in the set of control and lubrication lines 177. The penetrations of the control and lubrication lines 176 and 177 into the pin chamber are sealed in order to permit isolation of that chamber.

The alternative middle diaphragms 159 of the leg ends are provided with multiple through bolt holes in a pattern consistent with the spacer blocks 65 and the mounting base of the hydraulic cylinder assemblies 60 which are used to latch by extending and unlatch by retracting the field mateable pin 101. The mounting bolt holes are positioned concentrically with the axis of the latch pin bore 136. The cylinders 60 are mounted to the spacer blocks 65 and the diaphragm 159 by means of mounting studs 66 and hex nuts 67.

FIG. 35 is a hydraulic schematic drawing illustrating how a shuttle valve circuit 700 can be used in order to independently permit grease injection for lubrication of the pin 101 from multiple sources. Shuttle valve 701 permits the higher pressure of its two optional inlet lines 704 and 708 to freely flow to the outlet 710 of the shuttle. Line 704 is assumed to be the one of the control and lubrication flexible hose lines 176 extending from the quick connects 58 on the access flange assembly 55 for feeding the outlet line 710 to a particular lubricant injection port 115 in the pin. Line 708 is assumed to be the corresponding injection line from the set of lines 175 from the conduit 170 in the leg end 36. The outlet line 710 is one of the outlet lines 177 which extends to the injection port 115.

FIG. 36 is a hydraulic schematic diagram illustrating how a hydraulic circuit 800 utilizing either of two different, independent hydraulic power sources 801 or 840 can be used to operate the hydraulic cylinder 60 to actuate the pin 101 of the present invention. The circuit 800 is somewhat simplified for purposes of illustration, so relief valves, filters, bleed-off orifices, pilot-to-open check valves, counterbalance valves, and the like are omitted for the sake of clarity.

A first hydraulic power system consists of major components pump 801, tank 802, four-way valve 803, and shuttle valve 816. Hydraulic pump 801 draws hydraulic fluid from tank 802 and delivers the fluid to a solenoid-controlled three-position four-way valve 803 with its outlet ports drained to the tank when the valve is centered. The return line 808 from four-way valve 803 flows back to the tank 802.

Valve 803 is selectably controlled by its solenoids. The valve 803 typically would be spring-centered and detented, although this is not shown for sake of clarity. The outlet lines from valve 803 are 809 and 810, which are each respectively connected to the preferred inlet/return ports of double-pilot-operated two-position spring-biased three-way valves 820 and 880. Lines 814 and 815 respectively are connected at their first ends to intermediate points of the outlet lines 809 and 810 from valve 803 and at their second ends to the inlet ports of shuttle valve 816. The outlet line 817 from shuttle valve 816 serves as a pilot line and connects to the first pilot port of valve 820 to urge the valve 820 in the same direction as its spring bias. Pilot line 830 is branched from line 817 at an intermediate point and connects to the first pilot port of valve 880 to urge the valve 880 in the same direction as its spring bias. Thus shuttle valve 816 provides a first pilot pressure to each of the valves 820 and 880.

A second hydraulic power system consists of major components pump 840, tank 843, four-way valve 848, and shuttle valve 868. This second hydraulic power system is assumed to act through the flow passages provided by the quick connects 58 on the access flange assembly 55. Hydraulic pump 840 draws hydraulic fluid from tank 843 and delivers the fluid to a solenoid-controlled three-position four-way valve 848 with its outlet ports drained to the tank when the valve is centered. The return line 842 from four-way valve 848 flows back to the tank 843. Valve 848 is selectably controlled by its solenoids. The valve 848 typically would be spring-centered, although this is not shown for sake of clarity.

The outlet lines from valve 848 are 851 and 852, which are each connected to two of the quick connects 58 on the exterior side of access flange assembly 55 and corresponding quick connects 58 on the interior side of the flange. The flange assembly 55 is schematically indicated by the dashed ellipse on FIG. 36. For clarity, only one pair of quick connects are shown herein. The outlet sides of the interior quick connects 58 are connected to outlet lines 860 and 861, which are in turn connected to the nonpreferred inlet/return ports of double-pilot-operated two-position spring-biased three-way valves 820 and 880. Lines 865 and 866 respectively are connected at their first ends to intermediate points of the outlet lines 860 and 861 from valve 820 and at their second ends to the inlet ports of shuttle valve 868. The outlet line 869 from shuttle valve 868 serves as a pilot line and connects to the second pilot port of valve 820 to urge the valve 820 in the opposite direction as its spring bias. Pilot line 870 is branched from line 869 at an intermediate point and connects to the second pilot port of valve 880 to urge the valve 880 in the opposite direction as its spring bias. Thus shuttle valve 868 provides a second pilot pressure to each of the valves 820 and 880.

The outlet port from valve 880 is connected to the cylinder retract line 178 and the outlet port from valve 820 to the cylinder extend line 182 of the actuator cylinder 60 for the pin 101. The flows in the lines 178 and 182 and the valves 820 and 880 can be bidirectional, depending on the positions of the valves 803 and 848. As arranged in FIG. 36, the spring bias of valves 820 and 880 make power source with its control valve 803 the preferred power source for the control system 800 of the cylinder 60.

OPERATION OF THE INVENTION

The operation of the inclined leg floating production platform 10 that utilizes the pin assembly embodiments of the present invention is largely concerned with the assembly of the structural system from its component subassemblies. There are three main subassemblies: the deck structure 11, the set of cojoined buoyant legs 25, and the damper plate assembly 90. Two types of pins connect these main subassemblies: the field mateable pin assemblies 100, 200, 300, 400, 500, or 600, and the permanent hinge pins 70. Additionally, cross bracing from the diagonal braces 78, as well as the combination boat landing and strongback 84, are also needed to complete the structural preassembly of the platform 10.

For the purposes of general operational description, either the deck 11 or the damper plate 90 is considered as a first structure for the mounting of the pin sockets of the different embodiments. Similarly, the leg ends 36 of the legs 26 or 43 are considered as a second structure for the mounting of the pins of the different embodiments. The pins are used for interconnecting the first and second structures.

Once the platform is preassembled as shown in copending U.S. patent application Ser. No. 11/051,691: "Inclined Leg Floating Production Platform with a Damper Plate", filed Feb. 4, 2005, it can be towed to a deep water location at or in route to its final installation site for its final assembly. The assembly operations for platform 10 can be fully or partly reversed at any step of the operation, unlike the situation for other types of floating platforms. This capability is due to the reversibility of the pin connection procedure, which is based on the pins of the present invention.

This flexibility permits the platform to be readily salvaged, refurbished, reconfigured, or moved on a heavy lift vessel long distances to new locations. The reconfiguration of the platform 10 in the sequence of steps described earlier is also due to the ability of the pins to be rotated relative to their sockets, thereby permitting the linked primary platform sub-assemblies to be moved relative to each other.

A critical operation in the preassembly of the legs 26 and 43 is the insertion of the field mateable pin assemblies into the bores 136 of the field mateable pin leg end 36. This assembly is described for the first pin embodiment 100, but the procedures are common to the other pin embodiments. This assembly is done by preassembling the hydraulic cylinder assemblies 60 to the interior drilled and tapped holes 112 on the centerlines of the end diaphragms 106 of the pins 101 and then aligning the cylindrical bodies 102 of the pins with the bores 136 of the field mateable pin leg end 36 of the leg 26 or 43.

After the pins 101 are well into the bore 136, the hydraulic cylinder assembly 60 and the spacer block 65 for each pin are attached to the middle diaphragm 138 or 159 of the field mateable pin leg end 36 using studs 66 and nuts 67. Access to the interior of the pins 101 is available through the access holes 109 in their end diaphragms 106 after removal of their access flange assemblies 55.

First Embodiment Operation

For the first embodiment of the pin assembly 100, the pinning operation proceeds as follows. The travel stops 128 on the interior faces of the pin sockets 118 abut and centralize the leg end 36 of a leg brought into the gap between a pair of pin sockets. The leg can be steered and roughly positioned in the gap between the sockets 118 by means of a pulling cable.

Following the positioning of the leg in the detent for the periphery of the leg end 36 formed y the arcuate abutting surfaces 129 of the travel stops 128 on the interior faces of the sockets 118, the ball valve 57 in the access flange assembly 55 of each pin 101 is opened or, alternatively, the ball valves 166 mounted on the alternative bore middle diaphragm assembly 159 are opened by their respective actuators 167. The opening of the ball valves 57 or 166 permits the pin cavities on the interior sides of the pins 101 to be hydrostatically pressure-balanced so that the differential of the hydrostatic forces on the opposed sides of the end diaphragms 106 of the pins 101 is minimized.

This hydrostatic balancing ensures that the forces exerted on the pins 101 by their cylinders 60 will be fully available to overcome friction and misalignment induced forces between the pins and the bores of the sockets 518 during the pin insertion process. After the leg ends 36 are positioned by the travel stops 128 so that the pins 101 are coaxial or nearly coaxial with the bores of their corresponding pin sockets 118, the opposed pins 101 are extended outwardly from their pin mounting bores 136 in the leg end 36 by applying hydraulic pressure to the piston side of the hydraulic cylinders 60 affixed to the pin. The pressure can be applied through connections attached to the appropriate fittings 58 on the access flange 55 of the pin or by lines extending through the leg of the platform 10, using the hydraulic circuit of FIG. 36 to permit control from either attachment point.

Lubricant is injected into the interface between the pin 101 and the pin mounting bore 136 during pin extension, and the socket 118 is assumed to be prelubricated. The lubricant is supplied through connections attached to the appropriate fittings 58 on the access flange 55 of the pin or by lines extending through the leg of the platform 10.

In the event of slight axial misalignment, the chamfer at the exposed outer end of the pin 101 aids in the initial stabbing of the pin 101 into the straight bore 119 of the socket 118. As the pin advances into the straight bore 119, its conical transition section 111 may possibly abut the entrance of the straight bore 119, further aiding in producing axial alignment of the pin and socket. The cylindrical outer surface 102 of pin 101 is a close fit to bore 119 of the socket, so that axial alignment is fairly closely obtained when the outer surface 102 of the pin has entered bore 119.

Pin extension is complete when the frustro-conical section 111 of pin 101 has abutted the frustro-conical bore transition 127 of the socket 118. When this abutment occurs between frustro-conical section 111 of pin 101 and the frustro-conical bore transition 127 of socket 118, the joint is tightened on the outer side of the socket. The inner end of the pin 101 is slightly loose in the straight bore 119 of the socket 118 due to the need for sliding clearance, so that some relative movement can be experienced in the event of load reversals. Additionally, sliding clearance is necessary between the pin 101 and the pin housing bore 136 of the leg end 36. Again, this clearance permits relative movement in the event of load reversals. For this reason, the first pin assembly embodiment 100 is best used when load reversals are uncommon and the connection is not highly loaded.

Resistance to loads on the leg end 36 in the direction of the axis of pins 101 normally is provided by the abutment of frustro-conical surfaces 111 of the pin and 127 of the socket. This abutment of frustro-conical surfaces is also common to pin assembly embodiments 200, 300, 500, and 600. In the case of embodiment 500, the abutment of the pin frustro-conical surfaces is with the wedges 522 and 524 of the socket 518, with the wedges supported by their actuator screws 523 and 525, which are in turn supported by the socket 518. In the event of excessive loading producing movement in a made up connection in the pin axial direction, an outside plate 131 of the leg end 36 will abut the interior transverse face of the pin socket side plate 116. This behavior is common to all of the embodiments of the present invention. For the fourth pin assembly embodiment 400, the abutment of the outside plates 131 of the leg end 36 against the pin socket side plates 116 is the only means other than friction of resisting loads in the pin axial direction.

After the completion of pin extension, the ball valves 57 or 166 are closed and, since pressure is bled off the cylinder extend line, the passive rod locks of the cylinder 60 are engaged to lock the cylinder rod 62. Finally, the threaded keeper pin 125 on the socket 118 is extended into the locking pin socket 113 of the pin 101 by applying torque to its hex head, and then the keeper pin is locked by jam nut 126. Thus, the pin 101 is prevented from disengaging by the keeper pin 125, the cylinder rod lock, and the hydraulic lock due to the isolation of the pin cavity by the ball valves 57 and 166 and O-ring 52.

Reversing the installation procedure can retract the pin 101. This keeper pinning operation for the keeper pin 125 can be performed at or near the surface by a diver or possibly by a ROV following completion of assembly of the platform 10. It should be noted that the connections of the pins 101 of the legs 43 to the damper plate 90 are made in the air, so that use of a diver is not required for installation of the keeper pins 125 for those pin connections.

Note that the pin 101 can also still be caused to extend in event of failure or inadequate output of its hydraulic cylinder 60. This alternate means of extension can be affected by pumping into the pin cavity through one of the ball valves 57 or 166 with the other ball valve closed. Because the cross-sectional area of the pin is so large, only moderate pressures are necessary in order to produce very substantial forces. The procedure can be reversed to cause pin retraction in the event that the pin is submerged and hence subject to external hydrostatic pressure. In such a case, the water in the pin cavity can be ejected by pumping or by displacing the water with nitrogen and then partially venting the nitrogen pressure in a controlled manner.

The insertion of the pins 101 into sockets 118 can be reversed at any time during the process or after completion of the insertion. This permits reversing the platform assembly operation partially or fully.

Second Embodiment Operation

The operation of the second pin and socket embodiment 200 is very similar to that of the first embodiment 100, with the only differences being related to the stabbing and abutment of frustro-conical shoulders. For the second pin assembly embodiment 200, the reduced diameter of the entry cylindrical surface 205 of pin 201 relative to the mouth of the frustro-conical tapered bore 220 of the socket 218 eases initial stabbing of the pin. The undercut external cylindrical surface 216 of pin 201 minimizes contact area between the pin and socket during stabbing so that, in the event of major misalignment, only the cylindrical surface 205 of the pin will contact the straight bore 219 of the socket. The connection becomes fully tight when the frustro-conical shoulder 211 of the pin 201 fully abuts the frustro-conical tapered bore 220 of the socket 218. At that time, the pin can then be immobilized by use of the rod locks, the isolation of the pin cavity, and the keeper pin 125.

The advantage of connection 200 relative to embodiment 100 is that the most highly loaded portion of the joint is tightened, rather than the relatively lightly loaded outer tip of the pin. The largest load transfer between the pin 201 and the socket 218 is in bearing between the frustro-conical tapered bore 220 of the socket and the frustro-conical shoulder 211 of the pin. The amount of load transfer in bearing between the entry cylindrical surface 205 of the pin 201 and the straight bore 219 of the socket 218 is much lower than the load transfer between the frustro-conical surfaces 211 and 220 at the entry end of the connection.

While there is necessarily sliding clearance provided between the pin 201 and the pin mounting bore 136, this second pin connection embodiment 200 is still fairly tightly connected in comparison with the first embodiment 100. This reduction in the clearances in the most highly loaded region of the connection renders the second pin assembly embodiment 200 more resistant to load reversals than the first pin assembly embodiment 100. Additionally, compared to the first pin assembly embodiment 100, this second pin assembly embodiment 200 is easier to stab and is better able to make two sides of the connection coaxial due to its relatively shorter beam length for the pin 201 between the pin mounting bore 136 and the engaged frustro-conical surfaces.

Third Embodiment Operation

The third embodiment 300 of the pin assembly again works in a manner very similar to that of the first and second embodiments, with the only differences being in the stabbing and abutment of frustro-conical shoulders. The frustro-conical portion 311 of the pin 301, which enters the socket 318, has a constant taper that can be fully abutted against the corresponding frustro-conical surface 319 of the socket 318. Stabbing is easy and self-aligning. The joint is fully tightened when the two frustro-conical faces 311 and 319 abut, at which point the pin position can be locked using closure of the ball valves 57 and 166, the cylinder rod locks, and the insertion of the keeper pin 125. This third embodiment 300 is able to fully tighten in the socket of the connection, so that it is very fatigue resistant. However, the third pin assembly embodiment 300 is more difficult to machine properly than the other embodiments disclosed herein.

Fourth Embodiment Operation

The fourth pin assembly embodiment 400 is structurally the simplest and easiest embodiment to machine, but it is only satisfactory for applications with very minimal dynamic loads, since it cannot be tightened by abutting frustro-conical shoulders. The pin 401 and the bore 419 of the socket 418 are straight right circular cylindrical surfaces. A relatively larger gap between these cylindrical surfaces than for the other pin assembly embodiments shown herein is necessary in order to enable stabbing and sliding to obtain full connection. Initial stabbing is somewhat eased by the entry chamfer on the outer tip of the pin 401. The locking of the pin 401 is done in the same manner as for the other embodiments.

Fifth Embodiment Operation

The fifth pin assembly embodiment 500 functions in a different manner than the other pin assembly embodiments in that it relies upon separate, externally actuated wedging to fully tighten the connection after the pin 501 is fully extended into the socket 518. The pin 501 is fully extended into the bore 519 of the socket 518 before the connection is tightened. Both the frustro-conical surfaces 503 and 504 of the pin 501 are inside the bore 519 of the socket 518 when the pin 501 is fully extended. The extension operation for the pin 501 into the socket 518 using the cylinder 60, the ball valves 57 or 166, and the lubrication is identical to that used for the other embodiments.

Once the pin 501 is fully extended, the wedges are tightened using the screws 523 and 525 as screw jacks. The first wedges 522, on the outer side of the socket 518 and for engaging the outer conical surface 504 at the outer end of the pin 501, are moved in the pin axial direction toward the leg end 36 by rotating their first wedge actuator screws 523 to produce wedge translation due to interaction of the actuator screw threads and the first wedge threads. This axial translation of the wedges 522 causes their frustro-conical interior faces bear against the outer conical surface 504 of the pin 501, while their outer cylindrical faces bear against the cylindrical bore 519 of the socket. The transverse shoulders of the second flanges of the first wedge actuator screws bear against the interior side of the reaction plate 521 of the socket in reaction to the thrust applied by the threads of the screws to the first wedges 522 as they tighten against the outer conical surface 504 of the pin 501.

The second wedges 524 are similarly moved axially by rotating their second wedge actuator screws 525 so that their frustro-conical interior faces bear against the intermediate conical transition 503 of the pin 501 and the outer cylindrical faces of the second wedges bear against the cylindrical bore 519 of the socket 518. For connections that are underwater or which are awash, these screw rotations to actuate the wedges can be performed by divers or by a suitably equipped remote operated vehicle (ROV) to engage the hex heads of the first and second wedge actuator screws 523 and 525, respectively. The wedges 522 and 524 of this fifth pin assembly embodiment 500 are able to firmly grip the pin 501 even when it is eccentrically positioned in the socket 518. All radial gaps can be eliminated with this connection, so that tendencies to structural fatigue due to load amplification with loose connections are minimized. Connection release is accomplished by reversing the engagement procedure described above.

Sixth Embodiment Operation

The sixth pin assembly embodiment 600, except for differences in stabbing and abutment of frustro-conical shoulders, operates in a manner similar to that of the first four embodiments 100, 200, 300, and 400. In the case of this sixth embodiment, the initial entry of the pin 601 into the frustro-conical bore 620 on the entrance side of the socket 618 is simplified due to the relatively large diametrical difference between the cylindrical surfaces 605 of the pin 601 and 619 of the socket 618.

When the pin 601 is fully inserted into the socket 618, the intermediate frustro-conical transition 603 of the pin fully abuts the socket entrance frustro-conical bore 620, while the outer end frustro-conical section 604 of the pin abuts or nearly abuts the socket exit frustro-conical bore 621. The tolerances on the machining are selected so that contact of comating surfaces 603 and 620 is ensured. Thus the most highly loaded portion of the connection is tight and without rattle or play. A minimal gap or no gap exists in the less heavily loaded region between the outer end frustro-conical section 604 of the pin 601 and the exit frustro-conical bore 621 of the socket 618. While there is still some looseness in the connection 600 due to the necessary sliding clearance between the pin 601 and the pin mounting bore 136, this looseness is minimal. Accordingly, tendencies to structural fatigue due to load amplification with loose connections are expected to be minimal for this sixth pin assembly embodiment 600.

The making of the connection can be completed and the connection 600 locked after pin insertion is completed in the same manner as for the other pin assembly embodiments. Connection release is accomplished by reversing the engagement procedure described above.

Operation of the Alternative Lubrication and Cylinder Control Source Hydraulic Circuits Referring to FIG. 35, a shuttle valve circuit is shown for permitting injection of grease lubricant from either of two separate, independent supplies. The shuttle valve circuit 700 shows a first inlet line 704 and a second, alternate inlet line 708 connected to the shuttle valve 701. Pressurized lubricant, typically heavy grease suitable for high-pressure lubrication of the pin in a marine environment, can be selectably supplied from either inlet line 704 or 708.

If higher pressure is applied to line 704, the shuttle will shift and block the flow passage 708 from serving as a leak route while permitting flow from line 704 to pass to exit line 719 and thence to the pin lubricant injection ports 115. If higher pressure is applied to line 708, then line 704 will be blocked and lubricant will flow from line 708 to line 710. Accordingly, if one line is blocked or leaky, the other line can still be used to lubricate the pin.

Referring to FIG. 36, the control system for permitting the hydraulic cylinder 60 to be operated from two separate, independent power sources 801 or 840 is shown. Assume initially that the hydraulic system containing pump 801 is operating and the system with pump 840 is idle. When the valve 803 is selectably operated to either extend or retract the cylinder 60, shuttle valve 816 delivers the higher pressure from the output lines 809 and 810 to the pilot line 817 and thence to the first pilot port of control valve 820. This same pressure is communicated from pilot line 817 to its branch line 830 and thence to the first pilot port of control valve 880. This pilot pressure holds the valves 820 and 880 so that the two lines 809 and 810 communicating with control valves 820 and 880 are also in communication with the extension and retraction lines, 182 and 178 respectively, of the cylinder 60. Thus, the cylinder 60 can be operated from the four-way valve 803 of the first power source 801, and the circuit for the pump 840 is isolated. Hence, even if the circuit for the pump 840 is leaky, the cylinder 60 can be controlled with the alternate circuit containing pump 801.

When it is desired to use the other pump circuit with pump 840 to operate the cylinder 60, the pilot pressure of the other circuit with pump 801 is released because that pump is idle and its control valve 803 is returned to its venting center position. In the same manner as for the circuit with pump 801, the shuttle valve 868 of the pump circuit with pump 840 selects the higher of the two line pressures from the inlet lines 860, 861 of that circuit to pilot the control valves 820 and 880 to their second position. The pilot pressure from valve 868 permits valves 820 and 880 to overcome their spring bias and shift so that the flow lines 860 and 861 are in communication with the cylinder 60. Again, the cylinder can be operated by the circuit with pump 840 even if the circuit with pump 801 is leaky.

Load Paths and Stresses in the Connections

Because the pins typically will be in a marine environment for a period of many years, it is necessary to make the pins serviceable and inspectable. Thus, the pins should have a large diameter and be hollow so that there is reasonable access for inspection and service personnel. The construction of the pins and the leg ends with their internal diaphragms is a consequence of the need to transfer the loads from the leg end to the pin and thence to the socket in the most efficient manner.

During extension of the pins into their sockets, the legs are ballasted or supported so that misalignment loads to be overcome by the pins are small. By far the largest loadings on the pin connections occur in service when the deck is elevated above the water surface and the platform is exposed to wave loadings. Due to the large diameter of the pins and their relatively short length between load reaction points, the pins experience only limited bending stresses in the direction of their longitudinal axes.

The transfer of load in the pin connection system is described herein for the first embodiment 100 of the pin system, but the load transfer means is substantially the same for all the embodiments in the present invention. The loads from the leg are transferred to the pin by direct bearing between the pin mounting bore 136 and the outer cylindrical surface of the pin 102, with the loads highest due to relative rigidity in the sections where the pin middle 107 and interior end 108 diaphragms are substantially in respective alignment with the leg end outside longitudinal plate 131 and the inboard longitudinal diaphragm 137. Similarly, the loads from the pin are transferred to the socket 118 by direct bearing between the mutual contact surfaces of the pin and socket, with the loads highest due to relative rigidity in the sections where the pin middle 107 and outer end 106 diaphragms are substantially in respective alignment with the socket side plates 116 and 117.

Figure 34:
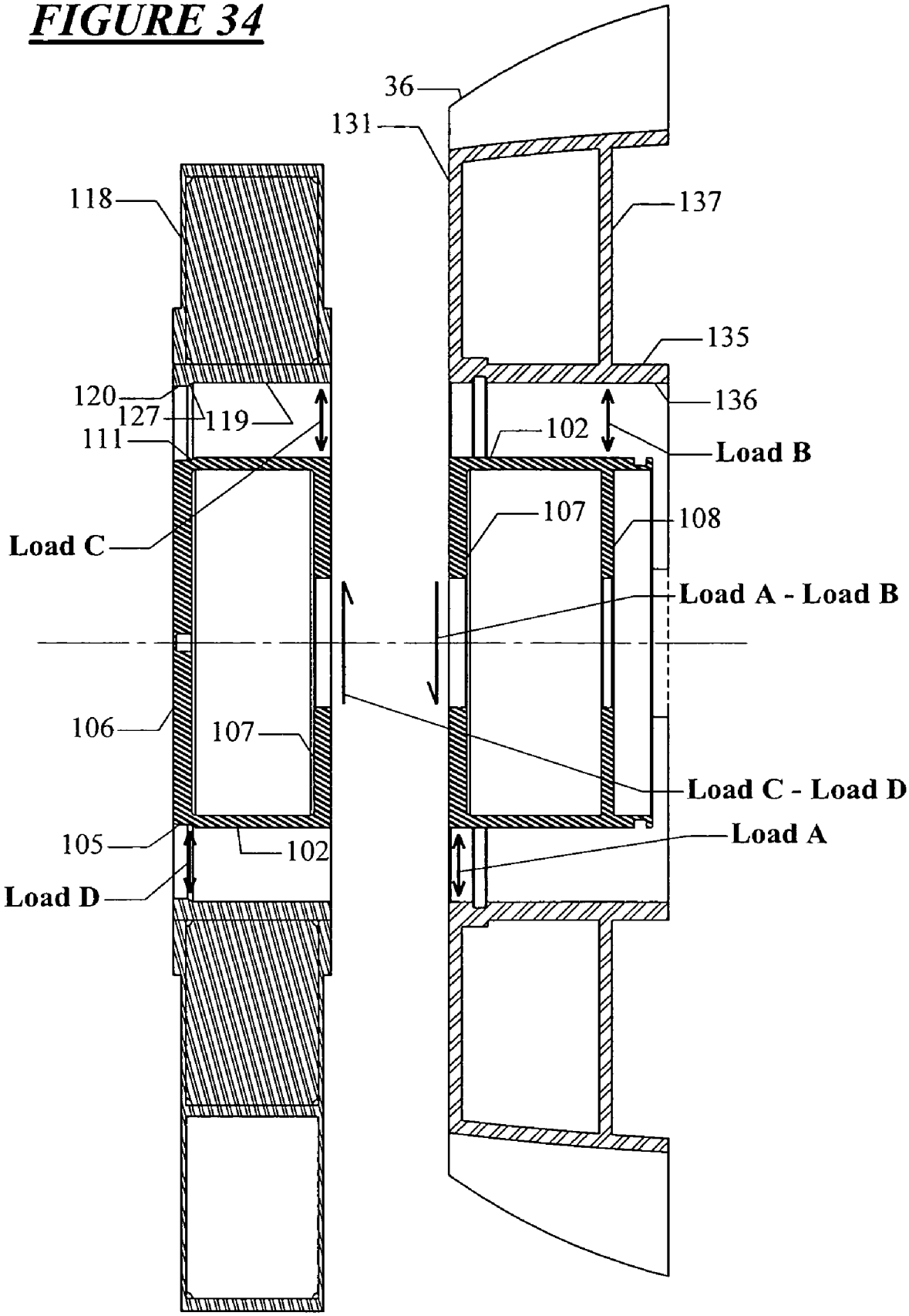
FIG. 34 is a modified free-body diagram of the first embodiment of the pin assembly, where the gaps are exaggerated between the pin mounting bore of the leg end and the pin, between the pin and the socket, and between the side plate of the leg end and the socket. This gap exaggeration permits a clearer illustration of the internal forces within the connection. Additionally, the pin is separated on the transverse midplane of its intermediate transverse diaphragm, again to illustrate the load transfer within that portion of the pin.

In FIG. 34, a modified free-body diagram is shown to indicate load paths for the situation when the pin is subjected to a net upward load applied from the leg end 36. Compressive loads, indicated by double-ended arrows with their heads pointed outwardly, are shown in the regions of overlapping diaphragms of the connection 100, where the loads are highest. In order to illustrate the internal forces acting within intermediate transverse diaphragm 107, that diaphragm is shown as split on its midplane transverse to the longitudinal axis of pin 101.

Referring to FIG. 34, the load (Load A) transferred from the leg end 36 between the outside longitudinal plate 131 into the wall of pin housing tube 135 and thence by bearing to the pin cylindrical outer surface 102 directly radially outward of the pin middle diaphragm 107 is significantly higher than the load transfer occurring farther into the interior of the leg. In particular, this Load A is greater than that load (Load B) transferred from the inboard longitudinal diaphragm 137 to the pin housing tube 135 and thence by bearing to the cylindrical outer pin surface 102 directly radially outward of the interior end transverse diaphragm 108. Vectorially, Load A and Load B act in opposed directions.

Likewise, the direct bearing loads transferred from the pin 101 to the socket 118 are highest in the interface between pin right circular cylindrical surface 102 and straight bore 119 of socket 118 in the immediate vicinity of the overlap between intermediate transverse diaphragm 107 and the inside side plate 116 of the socket (Load C). The transfer of loading in direct bearing between the engaged outer tip of the pin 101 at conical transition section 111 and the comating conical bore transition 127 of the socket 118 (Load D) is relatively higher where the outer transverse diaphragm 106 of the pin is aligned with the outer side plate 117 of the socket, but again, this pin tip loading is substantially less than the Load C transferred in the vicinity of the middle diaphragm 107 of the pin. Vectorially, Load C and Load D act in opposed directions.

As a first-order approximation, it may be assumed that all load transfer between the leg end 36 and pin 101 and between the socket 118 and pin 101 is discretized into the planes where the plates and diaphragms of these members overlap. Since the pin 101 is static once engaged, the sums of forces and moments on the pin are both zero. For this reason, a first order approximation is that: (Load A)−(Load B)=(Load C)−(Load D)=Shear Transferred internally in Diaphragm 107.

With the approximation above, the Load B transferred to the pin 101 from the interior of the leg end 36 is transferred to the middle diaphragm 107 by shear and bending in the tubular wall of the pin between those two diaphragms, but these stresses are relatively quite low. Likewise, the Load D transferred from the outer side plate of the socket 118 to the outer transverse diaphragm 106 of the pin 101 is also relatively low and is similarly transferred within the pin by shear and bending in its tubular portion between outer diaphragm 106 and middle diaphragm 107. The net force (Load A−Load B) on the leg side of the transverse midplane of middle diaphragm 107 of pin 101 is opposed by the equal and opposite net force (Load C−Load D) on the socket side of the transverse midplane of middle diaphragm 107. Vectorially, these two net loads act in opposite directions. The internal transfer of these net loads from the interior end of diaphragm 107 to the exterior end of diaphragm 107 is by direct shear in the transverse midplane of the diaphragm, again with the shear stresses being quite low.

The hoop bending stresses induced in the annular middle diaphragm 107 of the pin from the opposed net loads on the pin are appreciably higher than the middle diaphragm shear stresses, but are still acceptable. If necessary, the inner diameter of the middle diaphragm 107 of the pin can be flanged in order to reduce its bending stresses.

By providing stiff diaphragms 106, 107, and 108 in the interior of the engaged pin 101 that are substantially coplanar with and interacting with planar stiff members 131 and 137 in the leg end 36 and the side plates 116 and 117 in socket 118 to transfer loads, a very efficient pin structure is obtained. Thus, stiffness and strength both are concentrated for more efficient load transfer and use of material. At the same time this reliance upon stiffening diaphragms provides sufficient space in the interior of the pins of the present invention so that personnel can enter the pins to inspect and service the pins.

ADVANTAGES OF THE INVENTION

The inclined leg floating production platform 10 of the present invention offers a number of substantial improvements over the existing technology used for deepwater petroleum production platforms. One primary advantage for the inclined leg floating production platform is its relatively low cost of construction and installation. This low cost arises largely from the availability of the pinned connections disclosed herein, since the pinned construction can take place low to the ground rather than high in the air.

The critical features of the pins for assembly of the platform 10 include selectable and reversible pin insertion and the ability of the pinned connections to permit rotation about their axes. Other than requiring machining of the pin outer diameters and socket bores, the fabrication for the platform uses conventional shipyard construction methods. Roll-formed and press-broken plate construction is generally very inexpensive in a shipyard, and the use of cast or forged components for the pins leads to considerable economies. These and other advantages will be obvious to those skilled in the art. Additionally, the ability to rapidly interchange a drilling deck for a production deck while reusing the balance of the platform offers excellent economies due to time saving and construction cost savings. All of these advantages are a consequence of the ability to assembly the platform 10 by means of any of the different pin assembly embodiments of the present invention.

The ability to minimize or eliminate operational gaps between mated load carrying components is critical in the marine environment in order to avoid fatigue failure of the connections due to dynamic load amplification of impacts in loose joints. The pin connections of the present invention greatly minimize any tendencies of the connections to structural fatigue because of the low stresses resulting from their large sizes, which in turn result from the need for personnel access inside the pins. Additionally, for all embodiments except for pin assembly embodiment 400, loose joints are minimized or substantially eliminated. The minimization of looseness in these joints and the attendant "working" of these connections under varying loads helps to minimize fretting and galling on the mating surfaces of the connections.

The utilization of transverse diaphragms interior to the pin and their alignment with corresponding planar diaphragms and plates in the legs and sockets results in a very efficient design with relatively low weight and stresses for the size of the pins. These pin connections can be serviced in the field by access either through the manway passage 109 in the pin or by a through-leg tunnel entering the pin cavity. Likewise, the pin mechanisms can be inspected from the interior of the pin, so both thorough visual and ultrasonic inspection are possible in the field.

It should be appreciated by those skilled in the art that the conceptions and the specific embodiments disclosed herein might be readily utilized as a basis for modifying or redesigning the structures for carrying out the same purposes as the invention. As will readily be understood by those skilled in the art, a variety of substitutions or alterations in the invention could be made without departing from the spirit of the present invention. For instance, the routing or the number of hydraulic and grease injection hoses could be changed, along with their penetration points into the leg structure. Similarly, the control valve circuitry for permitting two independent controls for the hydraulic cylinder assembly 60 can be configured in a variety of ways to obtain substantially the same results as the approach shown herein.

Likewise, the geometry of the leg end cross-sections and framing and its proportions could be altered. Different seals could be used on the pins of the field mateable pin assemblies, and the cylinders could be of either the passive self-locking type or with a separately set locking means. Multiple cylinders could be used on individual pins. Screw jacks could be used in place of hydraulic cylinders to extend and retract the pins. For the case of the fifth embodiment 500 of the pin assembly, the pin could be made a straight right circular cylinder and the outer reaction surface for the wedges made frustro-conical. In such a case, the wedges would still tighten to grip the pin in substantially the same manner. None of these changes would depart from the spirit of the invention. It should be realized by those skilled in the art that such equivalent constructions do not depart from the spirit and scope of the invention as set forth in the appended claims.

What is claimed is:

1. A pin assembly comprising:

(a) a pair of pin sockets mounted on a first structure, wherein the pin sockets are spaced apart and have opposed coaxially aligned pin receiving bores;

(b) a second structure having a longitudinal midline and a through bore penetrating a distal end of the second structure defining a pin mounting bore, wherein the through bore has a through bore diaphragm coplanar with the midline of the second structure and fixedly mounted in the through bore;

(c) a pair of opposed pin members, with one pin member positioned on each side of the through bore diaphragm, wherein the pin members are coaxially aligned in the through bore and the pin members are reciprocably comateable with the pin receiving bores when the second structure is coaxially received between the pin sockets of the first structure, wherein each pin member has a hollow pin casing and at least one pin diaphragm disposed on the pin casing to support the casing;

(d) a pin chamber bounded by the pin members, the through bore and the through bore diaphragm;

(e) a sealing means for sealing a gap between each pin casing and the through bore, (f) a flow passage communicating between an inside of the pin chamber and an outside of the pin chamber;

(g) a selectably operable valve in communication with the flow passage, wherein whenever the valve is open flow is permitted through the flow passage and whenever the valve is closed flow is prevented through the flow passage; and (h) a pair of selectably operable, reciprocable actuators, each actuator fixedly attached at a first end to the through bore diaphragm and at a second end to a respective one of the pin members, wherein each pin member and actuator is selectably reciprocable between a first position wherein the pin member is partially extended from the through bore and comateably engages a respective one of the pin sockets and a second position wherein the pin member is within the through bore and an external face of the pin member is substantially flush with an outer end of the through bore.

2. The pin assembly of claim 1 wherein the through bore and the pin members are cylindrical and closely engaged with each other.

3. The pin assembly of claim 2, wherein each pin member has a longitudinal axis and the pin diaphragm is an annular transverse diaphragm located about midway along the longitudinal axis.

4. The pin assembly of claim 2, wherein each pin socket of the pair of pin sockets has:

(a) an annular tube housing for the pin receiving bore;

(b) a first side plate transversely extending from the first structure, wherein the first side plate is at a first end of the pin receiving bore facing the first side plate of the of the other pin socket of the pair of pin sockets; and (c) a second side plate transversely extending from the first structure, wherein the second side plate is at a second end of the pin receiving bore.

5. The pin assembly of claim 4, wherein the pin members each have at least three pin diaphragms including a transverse end diaphragm closing a first end of the pin casing, and a first and second transverse diaphragm fixedly attached to the pin casing and spaced apart from the end diaphragm and from each other; and the second structure has an annular tube housing for the pin mounting bore, a pair of transverse side plates of the pin mounting bore extending away from the pin mounting bore with one side plate positioned at each outer end of the pin mounting bore, and a transverse inboard diaphragm integral with the second structure and inset from the outer end of the pin mounting bore in the direction of the longitudinal midline and extending away from the tube housing for the pin mounting bore.

6. The pin assembly of claim 5, wherein when each pin member is in the first position and engaged in the pin receiving bore of the socket, the end diaphragm of the pin member is substantially coplanar with the second side plate of the socket, a midplane of the first side plate of the socket and a midplane of the inboard diaphragm of the second structure intersect the first transverse diaphragm of the pin member, and a midplane of the second transverse diaphragm of the pin member and the inboard diaphragm of the second structure are substantially coplanar.

7. The pin assembly of claim 1, wherein the through bore is a right circular cylindrical and a portion of the pin member remaining within the through bore when each pin member is in the first position is a right circular cylindrical.

8. The pin assembly of claim 1, wherein each pin member further includes a selectably openable access passage in the pin casing, wherein the access passage passes from the outside of the pin chamber to the inside of the pin chamber.

9. The pin assembly of claim 8, wherein the access passage is sufficiently large to permit entry of service personnel into the interior of the pin casing.

10. The pin assembly of claim 1, wherein each actuator is a double-acting hydraulic cylinder.

11. The pin assembly of claim 10, further including two hydraulic power sources and a power source control system wherein either power source selectably activates the double-acting hydraulic cylinder.

12. The pin assembly of claim 1, further including two power sources and a power source control system wherein either power source is selectably activated to operate the actuators.

13. The pin assembly of claim 1, wherein each pin casing has an external surface having a pin frustro-conical section and the pin receiving bore has an internal surface having a pin receiving bore frustro-conical section, wherein when the pin member is in the first position and a portion of the pin member is engaged in the pin receiving bore the pin frustro-conical section is abutted against the comateable pin receiving bore frustro-conical section, whereby the connection between the pin member and the pin receiving bore is urged into coaxial alignment.

14. The pin assembly of claim 1, wherein each pin socket includes a keeper pin for engaging a respective one of the pin members to prevent retraction of the pin member from the pin receiving bore.

15. The pin assembly of claim 1, wherein the through bore diaphragm includes two plates sandwiching at least one radial stiffener.

16. The pin assembly of claim 1, wherein each pin member has at least three pin diaphragms including an end transverse diaphragm closing a first end of the pin casing, and a first and second transverse diaphragm fixedly attached to the pin casing and spaced apart from the end diaphragm and from each other.

17. The pin assembly of claim 16, wherein each pin member further includes a selectably openable access passage in the end transverse diaphragm, wherein the access passage passes from the outside of the pin chamber to the inside of the pin chamber.

18. The pin assembly of claim 16, wherein radial stiffeners are attached to the end transverse diaphragm and the first transverse diaphragm.

19. The pin assembly of claim 1, wherein each pin member further includes a lubricant distribution groove on an external surface of the pin casing where the pin casing is mounted in the through bore.

20. The pin assembly of claim 19, wherein each pin member further includes a lubricant injection port for injecting lubricant into the lubricant distribution groove.

21. The pin assembly of claim 20, wherein lubricant is injected into the lubricant distribution groove whenever the pin member moves from a first position to a second position.

22. The pin assembly of claim 1, wherein an axis of the through bore is perpendicular to the longitudinal midline of the second structure.

23. The pin assembly of claim 1, further including a pumping means in communication with the flow passage for selectably pumping fluid into or out of the pin casing.

24. The pin assembly of claim 1, wherein each pin receiving bore extends through the axial thickness of the pin sockets.

25. The pin assembly of claim 1, wherein each pin member has a slip fit into a respective one of the pin receiving bores.

26. The pin assembly of claim 25, wherein each pin member is freely rotatable within the pin receiving bore when engaged therewith.

27. The pin assembly of claim 1, wherein the sealing means includes an O-ring mounted in an O-ring groove on an external surface of each pin casing, the O-ring sealingly mating with the pin mounting bore.

28. The pin assembly of claim 1, wherein a plurality of diaphragms are annular rings spaced apart and positioned coaxially within each pin casing between the first end of the pin member and a second end of the pin member.

29. The pin assembly of claim 1, wherein each pin socket has a laterally extending inward face transverse to the coaxially aligned pin receiving bore of the socket and attached to the laterally extending internal face is an arcuate travel stop concentric with the pin receiving bore, an inside arc of the travel stop is configured to abut the second structure having the pin mounting bore, whereby abutment of the second structure with the opposed travel stops of the pair of pin sockets urges alignment between the coaxially aligned pin receiving bores and the pins mounted in the pin mounting bore.

30. A pin assembly comprising:

(a) a pair of pin sockets mounted on a first structure, wherein the pin sockets are spaced apart and have opposed coaxially aligned pin receiving bores;

(b) a second structure having a longitudinal midline and a through bore penetrating a distal end of the second structure defining a pin mounting bore, wherein the through bore has a through bore diaphragm coplanar with the midline and fixedly mounted in the through bore;

(c) a pair of opposed pin members, with one pin member positioned on each side of the through bore diaphragm, wherein the pin members are coaxially aligned in the through bore and the pin members are reciprocably comateable with the pin receiving bores when the second structure is coaxially received between the pin sockets of the first structure, wherein each pin member has a hollow pin casing and three pin diaphragms including an end transverse diaphragm closing a first end of the pin casing, and a first and second transverse diaphragm fixedly attached to the pin casing and spaced apart from the end diaphragm and from each other;

(d) a pin chamber bounded by the pin members the through bore and the through bore diaphragm;

(e) a sealing means for sealing a gap between each pin casing and the through bore, (f) a flow passage communicating between an inside of the pin chamber and an outside of the pin chamber;

(g) a selectably operable valve in communication with the flow passage, wherein whenever the valve is open flow is permitted through the flow passage and whenever the valve is closed flow is prevented through the flow passage;

(h) a selectably openable access passage in the end transverse diaphragm of each pin member, wherein the access passage passes from the outside of the pin chamber to the inside of the pin chamber;

(i) a pair of selectably operable, reciprocable actuators, each actuator fixedly attached at a first end to the through bore diaphragm and at a second end to a respective one of the pin members, wherein each actuator reciprocates between a first position and a second position such that when the actuator is in the first position the pin member is partially extended from the through bore and comateably engages a respective one of the pin sockets and when the actuator is in the second position the pin member is within the through bore and an external face of the pin member is substantially flush with an outer end of the through bore;

(j) a pumping means in communication with the flow passage for selectably pumping fluid into or out of the pin casing; and (k) a lubricant injection port for injecting lubricant into a lubricant distribution groove in an external surface of each pin casing.

31. The pin assembly of claim 30, wherein each actuator is a double-acting hydraulic cylinder.

32. A method for using the pin assembly of claim 30 to interconnect structural components, the method comprising the steps of:

(a) positioning the pin members in the pin mounting bore of the second structure between the pin sockets mounted on the first structure such that the pin receiving bores and the pin members are coaxially aligned;

(b) injecting lubricant into the lubricant distribution groove of the pin members to lubricate the gap between each pin casing and the through bore;

(c) opening the valve to allow pressure equalization between an inside and an outside of the pin chamber;

(d) moving the actuators to a first position to extend the pin members into the pin receiving bores;

(e) closing the valve to prevent fluid from leaving the pin chamber; and (f) locking the pin members into the pin receiving bores using a keeper pin.

33. The method of claim 32, wherein the actuators are moved to the first position by selectably activating the actuators using a control system to select one of two power sources in communication with the actuators.

34. A method for disconnecting structural components connected using the pin assembly of claim 30, the method comprising the steps of:

(a) unlocking the pin members extended into the pin receiving bores by removing a keeper pin;

(b) injecting lubricant into the lubricant distribution groove to lubricate the gap between each pin casing and the through bore;

(c) opening the valve to allow pressure equalization between an inside and an outside of the pin chamber;

(d) moving the actuators to a second position to retract the pin members into the pin mounting bore; and (e) closing the valve.

35. A method for using the pin assembly of claim 30 to interconnect structural components, the method comprising the steps of:

(a) positioning the pin members in the pin mounting bore of the second structure between the pin sockets mounted on the first structure such that the pin receiving bores and the pin members are coaxially aligned;

(b) injecting lubricant into the lubricant distribution groove of the pin member to lubricate the gap between each pin casing and the through bore;

(c) closing the valve, if the valve is open;

(d) moving the actuators to a first position while pumping fluid into the pin chambers of the pin members to extend the pin members into the pin receiving bores; and (e) locking the pin members into the pin receiving bores using a keeper pin.

36. A method for disconnecting structural components connected using the pin assembly of claim 30, the method comprising the steps of:

(a) unlocking the pin members extended into the pin receiving bores by removing a keeper pin;

(b) injecting lubricant into the lubricant distribution groove to lubricate the gap between each pin casing and the through bore (c) closing the valve, if the valve is open;

(d) moving the actuators to a second position while pumping fluid out of the pin chamber so that the differential in hydrostatic pressure external to the pin chamber and pressure within the pin chamber urge the pin members to retract into the pin mounting bore.

* * * * *

UNITED STATES PATENT AND TRADEMARK OFFICE

CERTIFICATE OF CORRECTION

PATENT NO. : 7,527,450 B2
APPLICATION NO. : 11/344727
DATED : May 5, 2009
INVENTOR(S) : Larry Rayner Russell It is certified that error appears in the above-identified patent and that said Letters Patent is hereby corrected as shown below:

Title Page Item (73)

The name and address of the Assignee is incorrect.

RRI Holdings, Inc., Dallas, TX (US) should read Deepwater XLP Technology, LLC Houston, TX (US)

Signed and Sealed this
Eleventh Day of January, 2011

David J. Kappos

David J. Kappos
*Director of the United States Patent and Trademark Office*